US011267116B2

(12) United States Patent
Furumi et al.

(10) Patent No.: US 11,267,116 B2
(45) Date of Patent: Mar. 8, 2022

(54) DRIVE-IN MACHINE

(71) Applicant: Koki Holdings Co., Ltd., Tokyo (JP)

(72) Inventors: Masaaki Furumi, Ibaraki (JP); Masashi Nishida, Ibaraki (JP)

(73) Assignee: Koki Holdings Co., Ltd., Tokyo (JP)

( * ) Notice: Subject to any disclaimer, the term of this patent is extended or adjusted under 35 U.S.C. 154(b) by 331 days.

(21) Appl. No.: 16/462,533

(22) PCT Filed: Oct. 27, 2017

(86) PCT No.: PCT/JP2017/038895
§ 371 (c)(1),
(2) Date: May 21, 2019

(87) PCT Pub. No.: WO2018/100939
PCT Pub. Date: Jun. 7, 2018

(65) Prior Publication Data

US 2019/0344415 A1 Nov. 14, 2019

(30) Foreign Application Priority Data

Nov. 30, 2016 (JP) ..... JP2016-232705
Sep. 29, 2017 (JP) ..... JP2017-191731

(51) Int. Cl.
*B25C 1/04* (2006.01)

(52) U.S. Cl.
CPC ..... *B25C 1/047* (2013.01)

(58) Field of Classification Search
CPC ..... B25C 1/008; B25C 1/04; B25C 1/043; B25C 1/045; B25C 1/046; B25C 1/047
See application file for complete search history.

(56) References Cited

U.S. PATENT DOCUMENTS 3,612,379 A * 10/1971 Panock ..... B27F 7/34 227/8
6,186,386 B1 * 2/2001 Canlas ..... B25C 1/008 227/142

(Continued)

FOREIGN PATENT DOCUMENTS

CN 102039580 5/2011
CN 105324215 2/2016

(Continued)

OTHER PUBLICATIONS

"International Search Report (Form PCT/ISA/210)" of PCT/JP2017/038895, dated Dec. 19, 2017, with English translation thereof, pp. 1-4.

(Continued)

*Primary Examiner* — Anna K Kinsaul
*Assistant Examiner* — Daniel Jeremy Leeds
(74) *Attorney, Agent, or Firm* — JCIPRNET

(57) ABSTRACT

The present invention is to prevent a drive-in position of a fastening member with respect to a material to be driven from being shifted. The drive-in machine according to the present invention comprises: an operation member; a contact member; a striking portion; and a first pressure chamber, the drive-in machine further comprising: a valve element for opening and closing a first passage through which a compressed fluid is sent to the first pressure chamber; a control mechanism having a first state and a second state in which the valve element is controlled; and a restriction mechanism for allowing and restricting the switching between the first state and the second state of the control mechanism. The restriction mechanism has first and second functions for allowing or restricting the control mechanism to be switched from the second state to the first state according to a time from a reference time point.

15 Claims, 45 Drawing Sheets

(56) References Cited

U.S. PATENT DOCUMENTS

| | | | | |
|---|---|---|---|---|
| 6,371,348 | B1 * | 4/2002 | Canlas | B25C 1/008 123/46 SC |
| 6,431,429 | B1 * | 8/2002 | Canlas | B25C 1/047 227/130 |
| 2014/0110452 | A1 | 4/2014 | Moore et al. | |
| 2015/0034693 | A1 * | 2/2015 | Ronconi | B25C 1/047 227/8 |

FOREIGN PATENT DOCUMENTS

| | | |
|---|---|---|
| CN | 105682861 | 6/2016 |
| JP | H0261580 | 5/1990 |
| JP | H0270980 | 5/1990 |
| JP | H0733575 | 6/1995 |
| JP | 2002254348 | 9/2002 |
| JP | 2012115922 | 6/2012 |
| TW | 200510140 | 3/2005 |
| TW | 200518888 | 6/2005 |
| TW | 201527054 | 7/2015 |
| WO | 2016179081 | 11/2016 |

OTHER PUBLICATIONS

"Office Action of China Counterpart Application", dated Aug. 31, 2021, with English translation thereof, pp. 1-15.

Office Action of Taiwan Counterpart Application, with English translation thereof, dated May 12, 2020, pp. 1-20.

Office Action of Taiwan Counterpart Application, with English translation thereof, dated Jan. 29, 2021, pp. 1-15.

* cited by examiner

30 : control mechanism
13 : contact member
100 : drive-in machine
154 : restriction mechanism

DRIVE-IN MACHINE

CROSS-REFERENCE TO RELATED APPLICATION

This application is a 371 application of the international PCT application serial no. PCT/JP2017/038895, filed on Oct. 27, 2017, which claims the priority benefit of Japan application no. 2016-232705, filed on Nov. 30, 2016 and Japan application no. 2017-191731, filed on Sep. 29, 2017. The entirety of each of the above-mentioned patent applications is hereby incorporated by reference herein and made a part of this specification.

TECHNICAL FIELD

The present invention relates to a structure of a drive-in machine that drives a fastening member.

BACKGROUND ART

A drive-in machine is used to drive a fastening member into a planar material as a material to be driven, for example, wood, a gypsum board, and a steel plate. Examples of the fastening member include a nail and a screw. Examples of a drive-in machine include a nailing machine and a screwing machine. A nailing machine performs an operation of driving a nail into a material to be driven in one direction with a strong driving force. A screwing machine performs operations of driving a screw in one direction into a material to be driven over a distance shorter than a total length of the screw, and fastening the screw to the material to be driven by rotating the screw driven into the material to be driven. A configuration in which compressed air is used as a power source for a drive-in machine is described in, for example, Patent Literature 1.

The drive-in machine described in Patent Literature 1 includes a main body, a handle, a nose, a cylinder, a piston, a push lever, a trigger, an accumulation chamber and a piston upper chamber. The cylinder and the piston upper chamber are provided in the main body. The piston is movable reciprocally in the cylinder. A driver blade is fixed to the piston. The handle is connected to the main body, and the nose is fixed to the main body. The accumulation chamber is provided over the interior of the main body and the handle. The trigger is provided at a portion connecting the main body and the handle. The push lever is attached to the nose.

When compressed air is introduced into the piston upper chamber, the piston rapidly moves in a driving direction in the cylinder with a large force. The driver blade moves together with the piston, and the fastening member is driven into the material to be driven. When the push lever and the trigger are operated, the drive-in machine starts a driving operation.

The push lever is movable with respect to the nose. The push lever is biased in a direction away from the main body by a spring. Then, when the fastening member is driven into a planar material positioned below the push lever, an operator points the nose down and presses the tip of the push lever against the planar material. According to this operation, the push lever is in contact with the planar material and moves toward the main body along the nose. On the other hand, the trigger is provided at a portion connecting the main body and the handle part, that is, a portion of the handle part that the operator grasps. The trigger is rotatable around a support shaft, and when the operator operates the trigger, the trigger rotates.

Thus, when the situation in which both of the push lever is being pressed against a planar material and the operator operates the trigger is established, the drive-in machine starts a driving operation.

Therefore, for example, after the operator brings the push lever in contact with a part into which the fastening member will be driven, when the operator operates the trigger, the fastening member can be accurately driven into a desired part. In this case, when the trigger is being operated, compressed air is supplied to the piston upper chamber, and the drive-in machine starts a driving operation. In this manner, when the operator presses the push lever against the planar material and then the operator operates the trigger, there is an operation in which the drive-in machine performs driving which is a single striking operation, which is suitable for operations in which there is a requirement of aiming to drive a fastening member into a part to be driven into all at once.

On the other hand, the operator can perform a driving operation with the drive-in machine by bringing the push lever into contact with the planar material or the like while maintaining a state in which a trigger is being operated, that is, a continuous striking operation. In this case, when the operator presses the push lever against a planar material, compressed air is supplied to the piston upper chamber, and the drive-in machine starts a driving operation. Such a continuous striking operation is suitable for driving the fastening member into a plurality of parts of a planar material consecutively over short time intervals. When a continuous striking operation is performed, a driving operation of the fastening member can be particularly efficient. The operator selects which of a single striking operation and a continuous striking operation to perform according to operational details.

CITATION LIST

Patent Literature

[Patent Literature 1]
Japanese Unexamined Patent Application Publication No. 2012-115922

SUMMARY OF INVENTION

Technical Problem

When the push lever comes in contact with the material to be driven after a predetermined time has elapsed from a time point at which the situation in which both of the operator is applying an operating force to a trigger and the push lever is separated from a material to be driven is established, there is a possibility of the fastening member being driven into a material to be driven at a position slightly deviating from a desired position.

The present invention provides a drive-in machine that can prevent a fastening member from being driven into a material to be driven at a position deviating from a desired position.

Solution to Problem

A drive-in machine of an embodiment includes an operation member that is operated by an operator; a contact member that is brought into contact with a material to be driven; a striking portion that is movably provided and drives a fastening member into the material to be driven; and a first pressure chamber that causes operation of the striking portion using a pressure of a compressed fluid when the operation member is operated and the contact member is in contact with the material to be driven, wherein, in the drive-in machine, a valve element that is able to operate such that a first passage through which the compressed fluid is sent to the first pressure chamber is opened or closed, a control mechanism having a first state and a second state for controlling opening and closing of the valve element, and a restriction mechanism that allows or restricts switching of the control mechanism between the first state and the second state, are provided, wherein, in the first state, when a situation in which both of the operation member is being operated and the contact member is in contact with the material to be driven is established, the first passage is opened by the valve element, in the second state, when at least one of the situation in which the operation member is being operated and the contact member is in contact with the material to be driven is not established, the first passage is blocked by the valve element, wherein the restriction mechanism has a first function of, within a predetermined time from a reference time point at which the situation in which both of the operation member is being operated and the contact member is separated from the material to be driven into is established, allowing the contact member to come into contact with the material to be driven and allowing the control mechanism to be switched from the second state to the first state, and a second function of, when a predetermined time has elapsed from a reference time point at which the situation in which both of the operation member is being operated and the contact member is being separated from the material to be driven is established, even if the contact member is in contact with the material to be driven, restricting changing of the state of the control mechanism from the second state to the first state.

Advantageous Effects of Invention

A drive-in machine of an embodiment can prevent deviation of a position at which a fastening member is driven into a material to be driven.

BRIEF DESCRIPTION OF DRAWINGS

FIG. 4 shows Specific Example 1 of the trigger valve, the push lever valve, and the restriction mechanism shown in FIG. 2 and is a cross-sectional view showing a state of the push lever valve after a short time has elapsed from when only the trigger is turned on.

FIG. 5 shows Specific Example 1 of the trigger valve, the push lever valve, and the restriction mechanism shown in FIG. 2 and is a cross-sectional view showing a state of the push lever valve after a long time has elapsed from when only the trigger is turned on.

FIG. 6 shows Specific Example 1 of the trigger valve, the push lever valve, and the restriction mechanism shown in FIG. 2 and is a cross-sectional view showing a state in which the push lever is pushed up after a short time has elapsed from when only the trigger is turned on.

FIG. 8 shows Specific Example 1 of the trigger valve, the push lever valve, and the restriction mechanism shown in FIG. 2 and is a cross-sectional view showing a state in when the push lever is pushed up after a short time has elapsed from when only the trigger is turned on.

FIG. 10 shows Specific Example 1 of the trigger valve, the push lever valve, and the restriction mechanism shown in FIG. 2 and is a cross-sectional view of a state in which the trigger valve is turned off from a state in which the push lever valve cannot be switched from off to on.

FIG. 18 shows Specific Example 2 of the trigger valve, the push lever valve, and the restriction mechanism used in the drive-in machine in FIG. 1 and is a cross-sectional view of a state in which the trigger valve and the push lever valve are both turned on.

FIG. 23 shows Specific Example 3 of the trigger valve, the push lever valve, and the restriction mechanism used in the drive-in machine in FIG. 1 and is a cross-sectional view of a state in which the trigger valve and the push lever valve are both turned on.

DESCRIPTION OF EMBODIMENTS

Drive-in machines according to embodiments of the present invention will be described below in detail with reference to the drawings.

Embodiment 1

Figure 1:
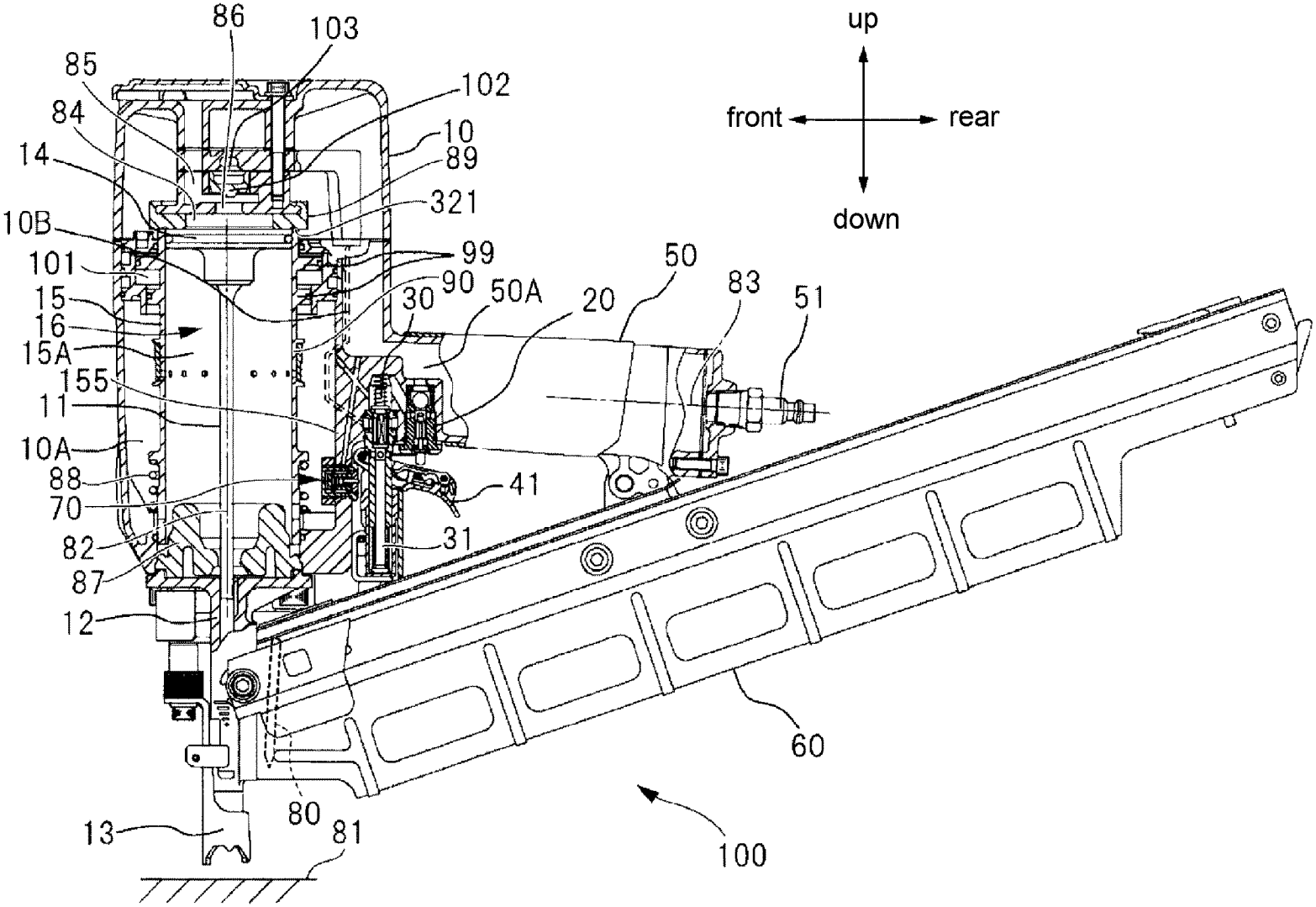
FIG. 1 is a cross-sectional view showing a drive-in machine corresponding to Embodiment 1 in the present invention.

FIG. 1 is a cross-sectional view showing a drive-in machine 100 corresponding to Embodiment 1. As the drive-in machine 100, a nailing machine is disclosed as an example. In the drive-in machine 100, a nail 80 which is an example of a fastening member, is driven into a material to be driven 81. FIG. 1 shows a cross-sectional view before the nail 80 is driven into the material to be driven 81. FIG. 1 is a cross-sectional view including an axis 82 of the drive-in machine 100 and is a perspective view of a part of the drive-in machine 100. The drive-in machine 100 shown in FIG. 1 is an example in which the nail 80 is driven in the perpendicular direction with respect to the material to be driven 81. Therefore, the axis 82 in FIG. 1 is disposed in the vertical direction. The vertical direction is the up and down direction in FIG. 1. The drive-in machine 100 shown in FIG. 1 is an example in which a downward driving force in FIG. 1 is applied to the nail 80, and the nail 80 is driven into the material to be driven 81.

The drive-in machine 100 includes a main housing 10, a handle 50, a nose 12, and a striking portion 16. The main housing 10 has a substantially cylindrical shape that extends in the up and down direction in FIG. 1. The handle 50 is connected to the main housing 10 and protrudes radially outward from the main housing 10. In addition, the nose 12 is attached to an end of the main housing 10 in the longitudinal direction.

In the present embodiment and the drawings, the longitudinal direction of the main housing 10, and the direction of the axis 82 are described as the up and down direction. Here, the longitudinal direction of the main housing 10 is the same as any of the direction along the axis 82, the direction parallel to the axis 82, and the direction of the axis 82. The direction along the axis 82, the direction parallel to the axis 82, and the direction of the axis 82 are technically synonymous. With respect to the up and down directions in FIG. 1, a direction toward the nose 12 is represented by any term of downward, toward a lower side, down, and a downward direction in the present embodiment. With respect to the up and down directions in FIG. 1, a direction away from the nose 12 is represented by any term of upward, toward an upper side, up, and upward direction in the present embodiment.

In addition, an air valve 51 is provided at an end of the handle 50 positioned opposite to an end connected to the main housing 10. The air valve 51 is detachable from an air hose for supplying compressed air. The air hose is not shown.

In FIG. 1, the direction along an imaginary line 83 connecting the air valve 51 and a part of the main housing 10 positioned opposite to a part to which the handle 50 is connected or the direction parallel to the imaginary line 83 may be described as the front to rear direction in the present embodiment. In addition, within the front to rear direction, a direction away from the air valve 51 may be represented by any term of forward, toward a front side, and frontward. In addition, within the front to rear direction, a direction toward the air valve 51 is represented by any term of rearward, toward a rear side, and backward. Here, in FIG. 1 showing a side view of the drive-in machine 100, the imaginary line 83 and the axis 82 cross each other.

The striking portion 16 is provided in the main housing 10. The striking portion 16 is a mechanism in which a driving force is applied to the nail 80 toward the lower side in FIG. 1 using compressed air.

A cylinder 15 is provided in the main housing 10. The center line in the cylinder 15 is represented as the axis 82 in FIG. 1. In the handle 50, an accumulation chamber 50A is provided on the upper side of the cylinder 15 and the outer circumference of the cylinder 15. Compressed air supplied from an air hose is stored in the accumulation chamber 50A. Here, a known pressure reducing valve can be provided in an air passage between the air valve 51 and the accumulation chamber 50A. The pressure reducing valve adjusts a pressure of compressed air using a differential pressure between a spring pressure and an air pressure. That is, a pressure of compressed air supplied to the accumulation chamber 50A can be adjusted.

A piston 14 is provided in the cylinder 15, and the piston 14 can reciprocate in the cylinder 15 in the direction of the axis 82. In the main housing 10, an exhaust valve chamber 103 is provided above the cylinder 15. A piston upper chamber 84 is provided between the exhaust valve chamber 103 and the piston 14. The exhaust valve chamber 103 is connected to a cylinder valve chamber 101. In the main housing 10, an exhaust passage 85 is provided above the cylinder 15. A port 86 connecting the exhaust passage 85 and the piston upper chamber 84 is provided. An exhaust valve 102 is provided between the exhaust valve chamber 103 and the port 86. The exhaust valve 102 opens and closes the port 86. In the main housing 10, a bumper 89 is provided above the cylinder 15. The bumper 89 is of, for example, synthetic rubber.

In the cylinder 15, a piston lower chamber 15A is provided below the piston 14. A return chamber 10A is provided between the main housing 10 and the outer circumferential surface of the cylinder 15. The cylinder 15 has a check valve 90 that connects or disconnects the piston lower chamber 15A to or from the return chamber 10A. In addition, a bumper 87 is provided between the cylinder 15 and the nose 12. The bumper 87 is a cushion member made of synthetic rubber. In addition, a return elastic member 88 is provided in the main housing 10, and the elastic member 88 biases the cylinder 15 upward. The elastic member 88 is, for example, a compression spring made of a metal.

An operation of the drive-in machine 100 driving the nail 80 downward is performed when the piston 14 and a driver blade 11 move in the direction of the axis 82. When the driver blade 11 moves downward in FIG. 1, the nail 80 is driven into the material to be driven 81. FIG. 1 shows a state before the driver blade 11 drives the nail 80 into the material to be driven 81, that is, an initial state.

The nose 12 protrudes downward from the main housing 10 in FIG. 1. The nose 12 has an injection path, and the driver blade 11 is movable in the injection path in the direction of the axis 82.

A lower end of the driver blade 11 moves the interior of the injection path in the up and down direction in FIG. 1. A push lever 13 is attached to the nose 12, and the push lever 13 is movable along the nose 12 in the up and down direction. When an operator presses the push lever 13 against the material to be driven 81, the push lever 13 moves upward along the nose 12. In addition, a magazine 60 in which a plurality of nails are housed is attached to the rear side of the nose 12. Whenever the driver blade 11 drives one nail 80, the next one nail 80 is automatically sent to the injection path from the magazine 60. The nail 80 sent to the injection path is driven into the material to be driven 81 by the driver blade 11.

The piston 14 is fixed to the upper side of the driver blade 11, and the piston 14 moves up and down in the cylinder 15. The striking portion 16 includes the piston 14, the driver blade 11, and the piston upper chamber 84. A port 321 is closed by an end of the cylinder 15 being pressed against the bumper 89 with a force of the elastic member 88. The port 321 is formed between an end of the cylinder 15 and the bumper 89. When the port 321 is closed, the accumulation chamber 50A and the piston upper chamber 84 are disconnected from each other.

The piston 14 and the driver blade 11 are biased upward due to an air pressure of the piston lower chamber 15A. When both a trigger plunger 21 and a push lever plunger 31 are turned off, the piston 14 is pressed against the bumper 89, and the piston 14 and the driver blade 11 are stopped at the top dead center shown in FIG. 1.

Figure 2:
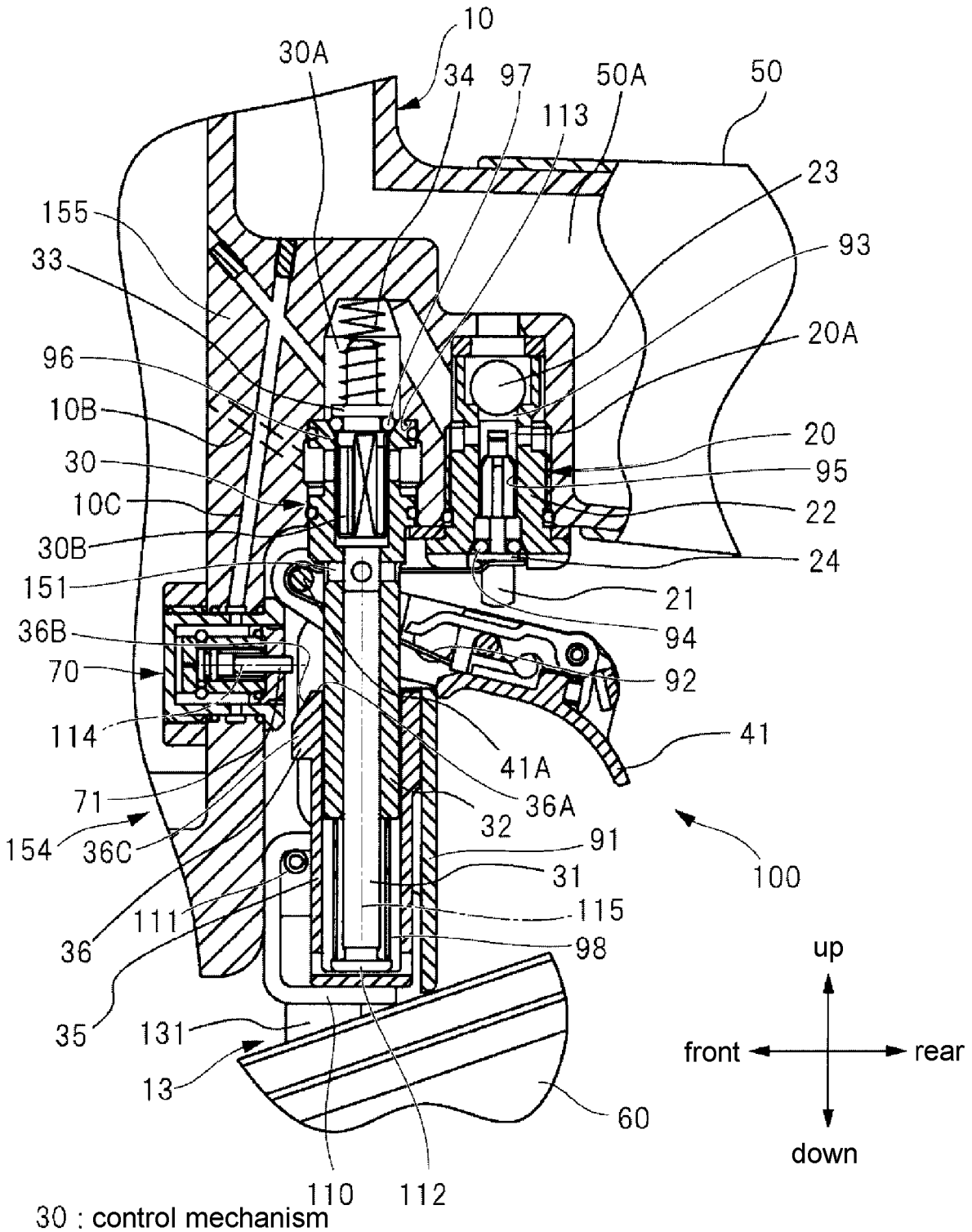
FIG. 2 is an enlarged cross-sectional view showing a structural example of a trigger valve and a push lever valve when a trigger and a push lever are both in an off state in the drive-in machine shown in FIG. 1, and Specific Example 1 of a restriction mechanism that restricts an operation of the push lever valve.

Turning the trigger plunger 21 off means that, as shown in FIG. 2, an operating force applied to a trigger 41 is released and a trigger valve 20 is closed. When the trigger plunger 21 is turned off, the trigger plunger 21 is stopped at the initial position. Turning the push lever plunger 31 off means a state in which an operating force of the push lever 13 is not transmitted to a push lever valve 30 and the push lever valve 30 is closed. When the push lever 13 is separated from the material to be driven 81, the push lever plunger 31 is turned off. When the push lever plunger 31 is turned off, as shown in FIG. 2, the push lever plunger 31 is stopped at the initial position.

Figure 8:
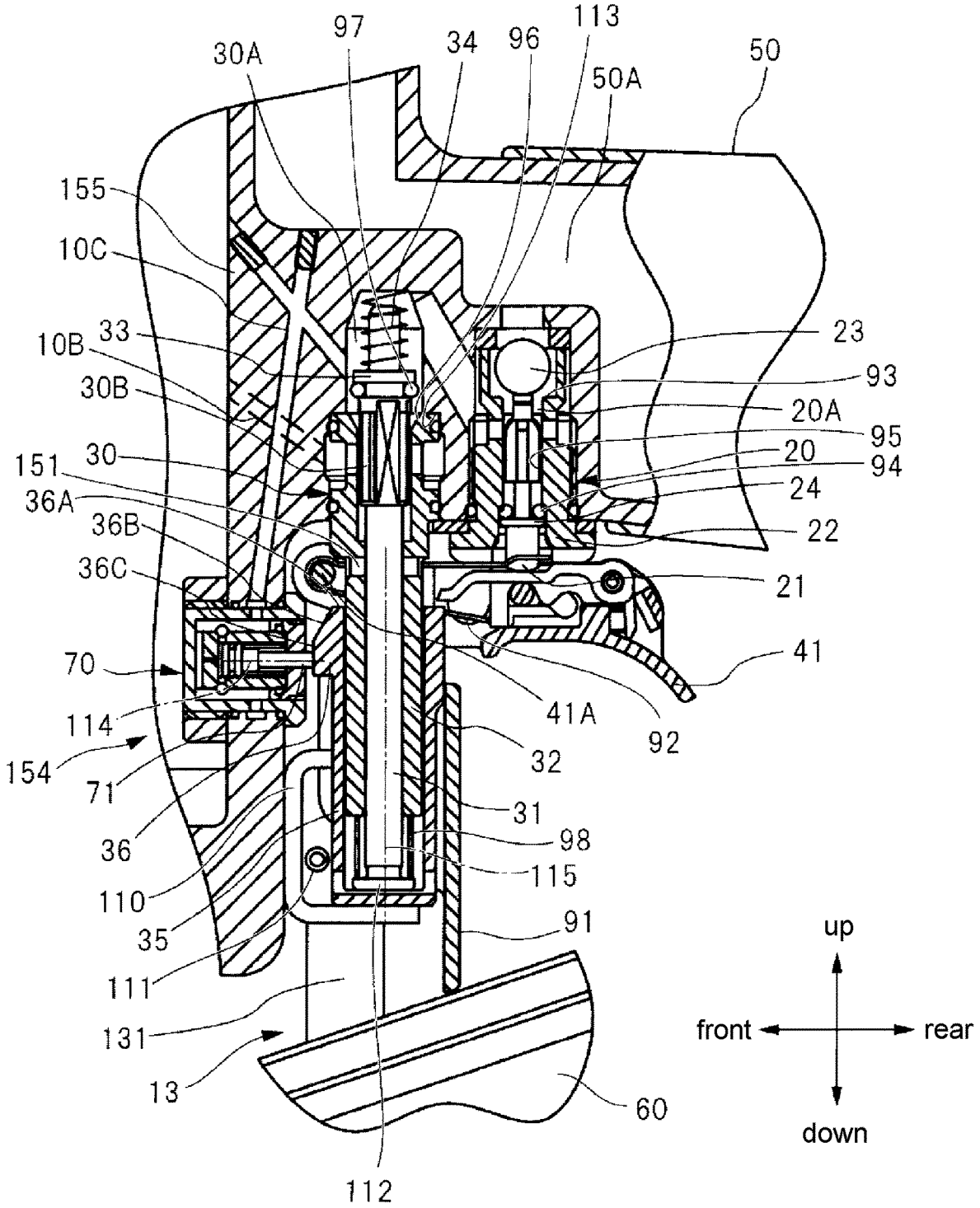

On the other hand, when the operator turns both of the trigger plunger 21 and the push lever plunger 31 on, a driving operation of the striking portion 16 is performed. The driving operation of the drive-in machine 100 includes an operation in which the cylinder 15 moves downward in FIG. 1 and an operation in which the driver blade 11 and the piston 14 move toward the bottom dead center from the top dead center. Turning the trigger plunger 21 on means a state in which an operating force of the trigger 41 shown in FIG. 8 is transmitted to the trigger valve 20 and the trigger valve 20 is opened. Turning the push lever plunger 31 on means that a force moving the push lever 13 in the direction of an axis 115 is transmitted to the push lever valve 30, and the push lever valve 30 is opened.

A pressure chamber 30A is provided at a part connecting the main housing 10 and the handle 50. When the operator turns the trigger plunger 21 and the push lever plunger 31 on, compressed air in the accumulation chamber 50A flows into the cylinder valve chamber 101 via the pressure chamber 30A. The push lever valve 30 is disposed downstream from the trigger valve 20 in an air flow direction in which compressed air in the accumulation chamber 50A is supplied to the cylinder valve chamber 101. When an air pressure in the cylinder valve chamber 101 increases, the cylinder 15 moves downward against a biasing force of the elastic member 88, the port 321 is opened, and the accumulation chamber 50A and the piston upper chamber 84 communicate with each other. Then, the compressed air in the accumulation chamber 50A is supplied to the piston upper chamber 84, an air pressure in the piston upper chamber 84 increases, and the piston 14 descends in FIG. 1.

When the piston 14 descends in FIG. 1 and an air pressure in the piston lower chamber 15A increases, the check valve 90 is opened. Therefore, air in the piston lower chamber 15A is discharged into the return chamber 10A. In this manner, when an air pressure in the piston lower chamber 15A decreases, the piston 14 and the driver blade 11 are lowered in FIG. 1, the driver blade 11 strikes the nail 80 so that it is driven into the material to be driven 81. In addition, the piston 14 collides with the bumper 87. When the piston 14 collides with the bumper 87, the positions of the piston 14 and the driver blade 11 in the direction of the axis 82 are at the bottom dead center. In addition, when compressed air in the accumulation chamber 50A is supplied to the cylinder valve chamber 101, some of the compressed air of the cylinder valve chamber 101 is supplied to the exhaust valve chamber 103. Therefore, the exhaust valve 102 operates according to an air pressure in the exhaust valve chamber 103 and blocks the port 86. Therefore, the compressed air in the piston upper chamber 84 is not discharged to the exhaust passage 85.

The piston 14 and the driver blade 11 move to the bottom dead center and stop and the driving operation of the drive-in machine 100 ends. When the operator turns at least one of the trigger plunger 21 and the push lever plunger 31 off, a cylinder valve 99 is closed, the accumulation chamber 50A and the piston upper chamber 84 are disconnected from each other, and an air pressure in the cylinder valve chamber 101 decreases. Therefore, the cylinder 15 moves upward due to a biasing force of the elastic member 88. In addition, compressed air in the cylinder valve chamber 101 and the exhaust valve chamber 103 is discharged to the outside of the main housing 10. Therefore, the exhaust valve 102 operates and the port 86 is opened, and compressed air in the piston upper chamber 84 is discharged to the outside of the main housing 10 via the exhaust passage 85. Therefore, an air pressure in the piston upper chamber 84 decreases. When an air pressure in the piston upper chamber 84 decreases, air in the return chamber 10A flows into the piston lower chamber 15A. Therefore, the piston 14 and the driver blade 11 move upward from the bottom dead center toward the top dead center, and as shown in FIG. 1, the piston 14 comes in contact with the bumper 89, and the piston 14 is stopped at the top dead center.

In this manner, by supplying compressed air to the piston upper chamber 84, the drive-in machine 100 moves the driver blade 11 and starts an operation of driving the nail 80 into the material to be driven 81. A structure of a passage through which compressed air in the accumulation chamber 50A is supplied to the piston upper chamber 84 and blocked, and a structure around the passage in the drive-in machine 100 will be described.

In the drive-in machine 100, a state in which compressed air is supplied to the piston upper chamber 84 and a state in which supply of compressed air to the piston upper chamber 84 is blocked are switched between according to operations of the trigger valve 20 and the push lever valve 30. When the trigger valve 20 and the push lever valve 30 are both turned on, the drive-in machine 100 supplies compressed air to the piston upper chamber 84 and starts a driving operation. When at least one of the trigger valve 20 and the push lever valve 30 is turned off, the drive-in machine 100 blocks supply of compressed air to the piston upper chamber 84 and ends the driving operation.

Both the trigger valve 20 and the push lever valve 30 are provided near a part connecting the handle 50 and the main housing 10. The trigger valve 20 and the push lever valve 30 being turned on and turned off can be switched between independently.

FIG. 2 is an enlarged cross-sectional view showing a structure around the trigger valve 20 and the push lever valve 30. FIG. 2 shows an example in which the trigger valve 20 and the push lever valve 30 are both in an off state. The trigger valve 20 being turned on and turned off are switched between by operating the trigger 41. The trigger 41 is attached to the main housing 10 so that it is rotatable around a trigger shaft 41A.

The trigger 41 is provided below the trigger valve 20 in the direction of the axis 82. A guide member 91 is attached to the main housing 10. An elastic member 92 is provided, and the elastic member 92 biases the trigger 41 clockwise about the trigger shaft 41A in FIG. 2. The trigger 41 is biased by the elastic member 92 and is stopped at a position at which it comes in contact with the guide member 91, that is, the initial position, as shown in FIG. 2.

The trigger valve 20 has a function of connecting and disconnecting the accumulation chamber 50A to and from the pressure chamber 30A. When the trigger valve 20 is turned on, that is, in an open state, the accumulation chamber 50A and the pressure chamber 30A are connected. When the trigger valve 20 is turned off, that is, in a closed state, the accumulation chamber 50A and the pressure chamber 30A are disconnected from each other.

The trigger valve 20 includes a cylindrical guide portion 22 attached to the handle 50, a trigger valve chamber 20A provided in the guide portion 22, a port 93 that is provided in the guide portion 22 and connects the accumulation chamber 50A and the trigger valve chamber 20A, a ball-shaped valve member 23 that opens and closes the port 93, and the trigger plunger 21 that is movably provided in a shaft hole 95 in the guide portion 22. The guide portion 22 guides the trigger plunger 21 so that it moves in the up and down direction in FIG. 2. A part of the trigger plunger 21 in the longitudinal direction is disposed outside the guide portion 22, specifically, outside the handle 50. The valve member 23 is pressed against the guide portion 22 by an air pressure in the accumulation chamber 50A and closes the port 93. The trigger valve chamber 20A is connected to the pressure chamber 30A.

In the trigger plunger 21, a flange 24 is provided at a part disposed outside the handle 50, and a sealing member 94 is attached to the outer circumferential surface of the trigger plunger 21. The sealing member 94 seals the shaft hole 95. The sealing member 94 is, for example, an O-ring made of synthetic rubber.

When no operating force is applied to the trigger 41, and as shown in FIG. 2, the trigger 41 is stopped at the initial position, the valve member 23 is pressed against the guide portion 22 by an air pressure in the accumulation chamber 50A, and the valve member 23 blocks the port 93. That is, the trigger valve 20 is turned off, in other words, in a closed state. When the trigger valve 20 is turned off, compressed air in the accumulation chamber 50A does not flow into the pressure chamber 30A.

In addition, when the trigger valve 20 is turned off, the flange 24 does not push the sealing member 94 into the shaft hole 95. That is, the sealing member 94 does not seal the shaft hole 95. Therefore, compressed air in the trigger valve chamber 20A and the pressure chamber 30A is discharged from the shaft hole 95 to the outside of the main housing 10.

Figure 4:
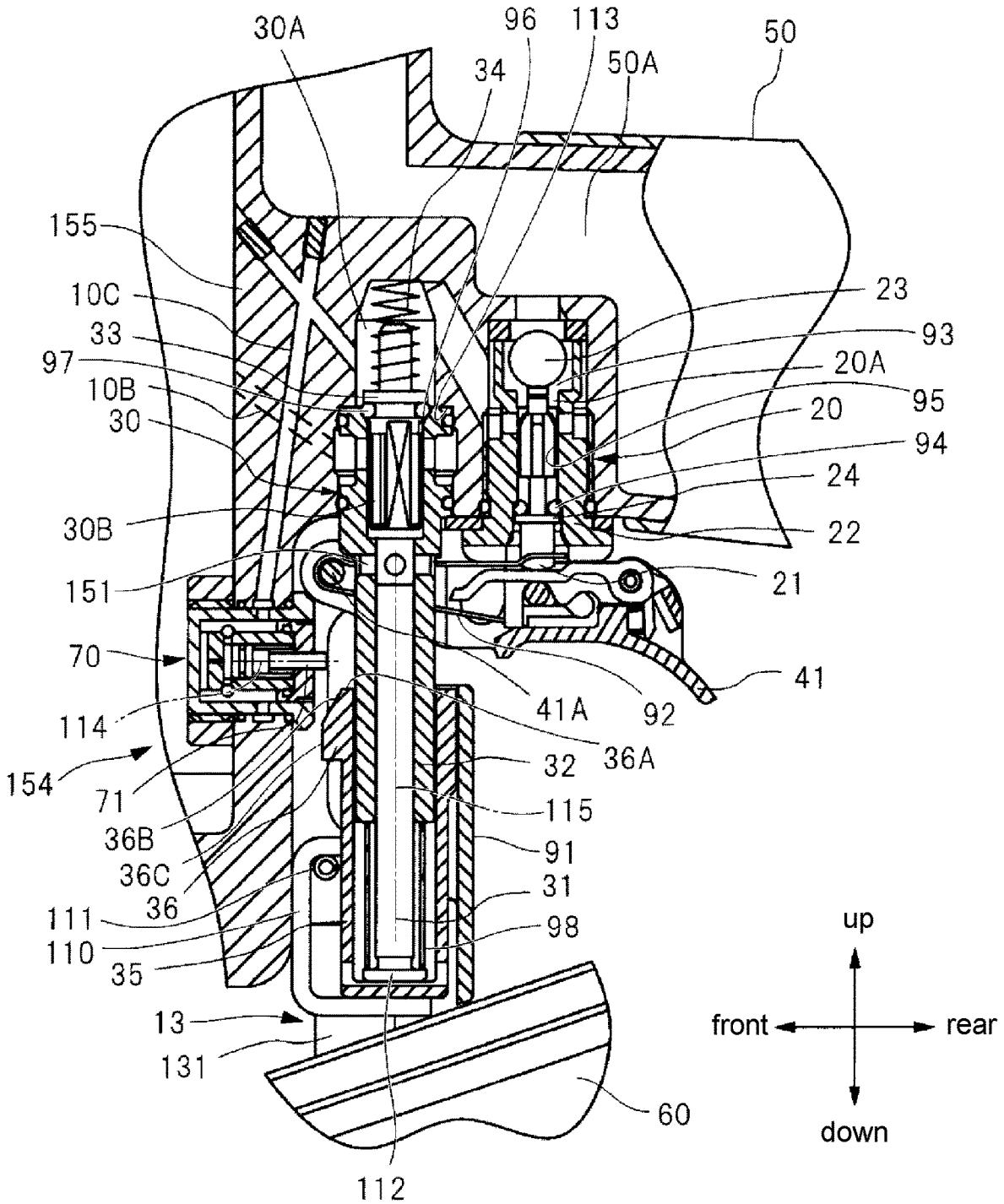

On the other hand, when the operator applies an operating force to the trigger 41 that is stopped at the initial position, the trigger 41 rotates counterclockwise in FIG. 2, and the trigger 41 is pressed against the trigger plunger 21. Then, the trigger plunger 21 moves upward in FIG. 2 and pushes the valve member 23 up, and as shown in FIG. 4, the port 93 is opened. In addition, the flange 24 pushes the sealing member 94 into the shaft hole 95, and the sealing member 94 seals the shaft hole 95. That is, the trigger valve 20 is turned on, in other words, in an open state. When the trigger valve 20 is turned on, compressed air in the accumulation chamber 50A flows into the pressure chamber 30A via the port 93 and the trigger valve chamber 20A.

The push lever valve 30 is provided between the cylinder 15 and the trigger valve 20 in the main housing 10. The push lever valve 30 includes the pressure chamber 30A, a push lever valve chamber 30B, the push lever plunger 31, a cylindrical valve body 32 in which the push lever plunger 31 is movably housed, a valve member 33, and a spring 34 that biases the valve member 33. The push lever plunger 31 and the valve member 33 are disposed concentrically around the axis 115. In a side view of the drive-in machine 100 shown in FIG. 1, the axis 115 is parallel to the axis 82. The push lever plunger 31 and the valve member 33 are relatively movable in the up and down direction in FIG. 2 and are disposed so that they are in contact with each other. The up and down direction in FIG. 2, FIG. 4, FIG. 5, FIG. 6, FIG. 8 and FIG. 10 is a direction parallel to the axis 115. The front to rear direction in FIG. 2, FIG. 4, FIG. 5, FIG. 6, FIG. 8 and FIG. 10 is a direction crossing the axis 115, specifically, a direction perpendicular to the axis 115.

The pressure chamber 30A is provided in the valve body 32. A port 96 is provided in the valve body 32, and the port 96 connects the pressure chamber 30A and the push lever valve chamber 30B. The valve body 32 has an exhaust passage 151 connected to the push lever valve chamber 30B. A sealing member 97 is attached to the valve member 33, and the sealing member 97 opens and closes the port 96. The spring 34 biases the valve member 33 downward in FIG. 2, and the valve member 33 is pressed against the push lever plunger 31.

Figure 9:
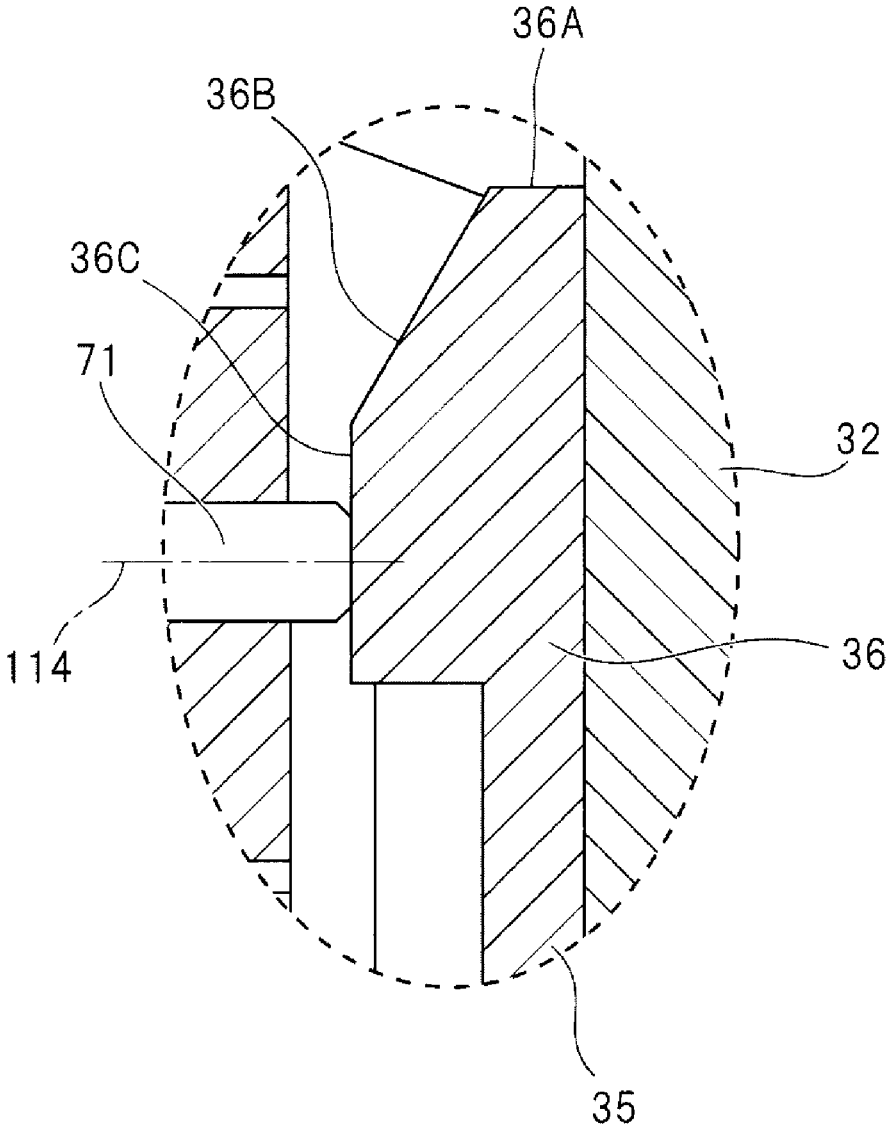
FIG. 9 is a cross-sectional view showing main parts in FIG. 8.

In addition, an outer tubular member 35 is provided. The outer tubular member 35 is supported by the guide member 91, and is movable in the direction of the axis 115 with respect to the main housing 10, that is, in the up and down direction in FIG. 2. A part of the valve body 32 is disposed in the outer tubular member 35. A lock pin locking portion 36 is provided at a part of the outer circumferential surface of the outer tubular member 35 close to the trigger shaft 41A in the direction of the axis 115. The lock pin locking portion 36 has a lock pin locking surface 36A, an inclined surface 36B, and a vertical surface 36C as shown in FIG. 9. The lock pin locking surface 36A is perpendicular to the axis 115, the inclined surface 36B is inclined with respect to the axis 115, and the vertical surface 36C is parallel to the axis 115.

A flange 112 is provided at the lower end of the push lever plunger 31. An elastic member 98 is provided between the flange 112 and the valve body 32. The elastic member 98 is, for example, a compression coil spring made of a metal. The elastic member 98 imparts an elastic force in the up and down direction in FIG. 2.

The push lever 13 has a push lever arm portion 131, and the push lever arm portion 131 has a hook 110. A stopper 111 is provided on the guide member 91. The push lever plunger 31 that is pushed downward in FIG. 2 due to a biasing force of the elastic member 98 is pressed against the outer tubular member 35. In addition, the outer tubular member 35 is pressed against the push lever arm portion 131. Then, as shown in FIG. 2, the hook 110 is engaged with the stopper 111, the push lever 13 is stopped at the initial position, and the push lever plunger 31 is stopped at the initial position. Here, the valve body 32 is biased downward in FIG. 2 due to an elastic force of the elastic member 98 and is pressed against a step 113 and stopped. The step 113 is provided at a part connecting the main housing 10 and the handle 50.

When the push lever 13 is separated from the material to be driven 81 as shown in FIG. 1, the push lever plunger 31 that is biased due to a biasing force of the elastic member 98 is stopped at the initial position as shown in FIG. 2. When the push lever plunger 31 is stopped at the initial position, the flange 112 is stopped at a position farthest from the valve body 32 in the up and down direction in FIG. 2.

When the push lever plunger 31 is stopped at the initial position as shown in FIG. 2, the push lever plunger 31 is not in contact with the valve member 33. Therefore, the valve member 33 that is biased by the spring 34 presses the sealing member 97 against the valve body 32 and is stopped. That is, the sealing member 97 closes the port 96, and the pressure chamber 30A and the push lever valve chamber 30B are disconnected from each other.

In addition, the push lever plunger 31 opens the exhaust passage 151, and a drive flow path 10B is connected to the outside of the main housing 10 via the push lever valve chamber 30B and the exhaust passage 151.

In this manner, when the push lever valve 30 is turned off, that is, in a closed state, compressed air in the pressure chamber 30A is not supplied to the drive flow path 10B and the cylinder valve chamber 101. Therefore, the striking portion 16 does not start a driving operation.

On the other hand, when the operator presses the push lever 13 against the material to be driven 81, the push lever 13, the outer tubular member 35 and the push lever plunger 31 move upward from the initial position in FIG. 2 against a biasing force of the elastic member 98. Then, the push lever plunger 31 blocks the exhaust passage 151 and the pressure chamber 30A. Thus, when the push lever plunger 31 comes in contact with the valve member 33, a movement force of the push lever 13 is transmitted to the valve member 33 through the push lever plunger 31. Then, the valve member 33 moves upward from the initial position in FIG. 2, the sealing member 97 is separated from the valve body 32 as shown in FIG. 8, and the port 96 is opened. That is, the push lever valve 30 is in an open state.

In this manner, when the push lever valve 30 is turned on, that is, in an open state, compressed air in the pressure chamber 30A is supplied to the cylinder valve chamber 101 via the push lever valve chamber 30B and the drive flow path 10B. Then, the cylinder 15 descends in FIG. 1, the port 321 is opened, and compressed air in the accumulation chamber 50A is sent to the piston upper chamber 84. Therefore, the striking portion 16 performs a driving operation.

When the trigger valve 20 and the push lever valve 30 are both turned on, the drive-in machine 100 supplies compressed air to the piston upper chamber 84 and the striking portion 16 drives the nail 80. On the other hand, when at least one of the trigger valve 20 and the push lever valve 30 is turned off, the drive-in machine 100 does not supply compressed air to the piston upper chamber 84, and the drive-in machine 100 does not perform a driving operation.

Here, the driving operation using the drive-in machine 100 includes a single striking operation which is a first driving operation, a continuous striking operation which is a second driving operation, and a third driving operation. In the single striking operation, the push lever 13 is pressed against the material to be driven 81, the push lever valve 30 is turned on, the trigger valve 20 is then turned on, and the striking portion 16 is operated. When one driving ends, the operator separates the push lever 13 from the material to be driven 81, turns the push lever valve 30 off, and turns the trigger valve 20 off. Thereafter, the above operation is repeated, and the nail 80 is driven into the material to be driven 81.

The continuous striking operation is an operation in which, while the operator keeps the trigger valve 20 in an on state, an operation of switching the push lever valve 30 from off to on and an operation of switching the push lever valve 30 from on to off are alternately repeated, and the nail 80 is driven into the material to be driven 81.

Here, in the third driving operation, the trigger valve 20 is turned on, the push lever valve 30 is then turned on, and the striking portion 16 is operated. When one driving ends, the operator separates the push lever 13 from the material to be driven 81, turns the push lever valve 30 off and turns the trigger valve 20 off. Thereafter, the above operation is repeated, and the nail 80 is driven into the material to be driven 81.

In order to perform an operation of driving the nail 80 continuously into a part close to the material to be driven 81, the continuous striking operation is performed so that the operation can be particularly efficiently performed. In either the single striking operation or the continuous striking operation, after an operation of driving the nail 80 into the material to be driven 81 ends, compressed air is discharged from the piston upper chamber 84, the piston 14 and the driver blade 11 move upward from the bottom dead center, the piston 14 and the driver blade 11 are stopped at the top dead center shown in FIG. 1, that is, at the initial position.

When the operator performs a continuous striking operation using the drive-in machine 100, while the operator keeps the trigger 41 in an on state, an operation of pressing the push lever 13 against the material to be driven 81 and an operation of separating the push lever 13 from the material to be driven 81 are alternately repeated. According to this operation, while the trigger valve 20 remains in an on state, off and on of the push lever valve 30 are alternately switched, and an operation of continuously driving the nail 80 into the material to be driven 81 is performed.

A timing at which the push lever 13 is pressed against the material to be driven 81 is decided by the operator. Therefore, a waiting time from a time point at which the situation in which the trigger valve 20 is being turned on and the push lever valve 30 is being turned off is established until the push lever valve 30 is switched from off to on, that is, a time interval, is not constant, but the waiting time varies depending on situations. During the waiting time, the push lever 13 may be close to the material to be driven 81. Thus, during the waiting time, when the drive-in machine 100 slightly moves and the push lever 13 comes in contact with the material to be driven 81, the push lever valve 30 is switched from off to on, and the nail 80 may be driven into a position away from a desired position on the material to be driven 81.

In order to prevent the nail 80 from being driven into a position away from a desired position on the material to be driven 81, driving the nail 80 with the striking portion 16 may be restricted when the waiting time exceeds a predetermined time. On the other hand, in order to prevent the workability from decreasing when the striking portion 16 drives the nail 80 into the material to be driven 81 next time, it is desirable that restriction for driving with the striking portion 16 can be easily released in a short time.

Here, the drive-in machine 100 has a restriction mechanism 154 in order to restrict a driving operation. The restriction mechanism 154 has specifically a function of restricting an operation of the push lever plunger 31 and a function of releasing the restriction. The restriction mechanism 154 is a time-out mechanism in which, when a predetermined time has elapsed from a time point at which the situation in which both of the push lever valve 30 is being turned off and the trigger valve 20 is being turned on is established, an operation of switching the push lever valve 30 from off to on is restricted.

Here, regarding an example in which the situation in which both of the push lever valve 30 is being turned off and the trigger valve 20 is being turned on is established, there are a first example and a second example. The first example is a case in which, in a state in which the push lever valve 30 and the trigger valve 20 are both turned off, the trigger valve 20 is switched from off to on. The second example is a case in which, in a state in which the push lever valve 30 is turned on and the trigger valve 20 is turned on, the push lever valve 30 is switched from on to off. Hereinafter, specific examples of the restriction mechanism 154 that can be provided in the drive-in machine 100 will be sequentially described.

Specific Example 1

The restriction mechanism 154 includes the outer tubular member 35 and a pin drive unit 70. The pin drive unit 70 has a first function and a second function. The first function is a function that allows the push lever valve 30 to be switched from off to on within a predetermined time from a time point at which the situation in which both of the push lever valve 30 is being turned off and the trigger valve 20 is being turned on is satisfied. The second function is a function that restricts switching of the push lever valve 30 from off to on when a predetermined time has elapsed from a time point at which the situation in which both of the push lever valve 30 is being turned off and the trigger valve 20 is being turned on is established.

The main housing 10 has a wall 155 forming the return chamber 10A, and the pin drive unit 70 is provided on the wall 155. The pin drive unit 70 is disposed between the cylinder 15 and the valve body 32 in the radial direction of the cylinder 15. The pin drive unit 70 has a pin 71. The pin 71 is an element that restricts upward movement of the push lever 13 in FIG. 2. The pin drive unit 70 operates the pin 71 using compressed air and restricts upward movement of the push lever 13 in FIG. 2 according to the state of the trigger 41. In addition, it is possible to easily release the restriction on the push lever 13 given by the pin 71.

The structure of the pin drive unit 70 is shown in FIG. 3A, FIG. 3B, FIG. 3C and FIG. 3D. The pin drive unit 70 has an outer cylindrical portion 72, an inner cylindrical portion 73, and an outer wall 75 in addition to the pin 71. The pin 71 is movable around an axis 114 in the right direction and the left direction in FIG. 3A, FIG. 3B, FIG. 3C, and FIG. 3D. In FIG. 2, FIG. 3, FIG. 4, FIG. 6, FIG. 8 and FIG. 10, the axis 114 intersects the axis 115, and, for example, is disposed perpendicular to the axis 115.

Movement of the pin 71 in the right direction in any of FIG. 3A, FIG. 3B, FIG. 3C, and FIG. 3D is movement of the pin 71 rearward in any of FIG. 2, FIG. 3, FIG. 4, FIG. 6, FIG.

Figure 10:
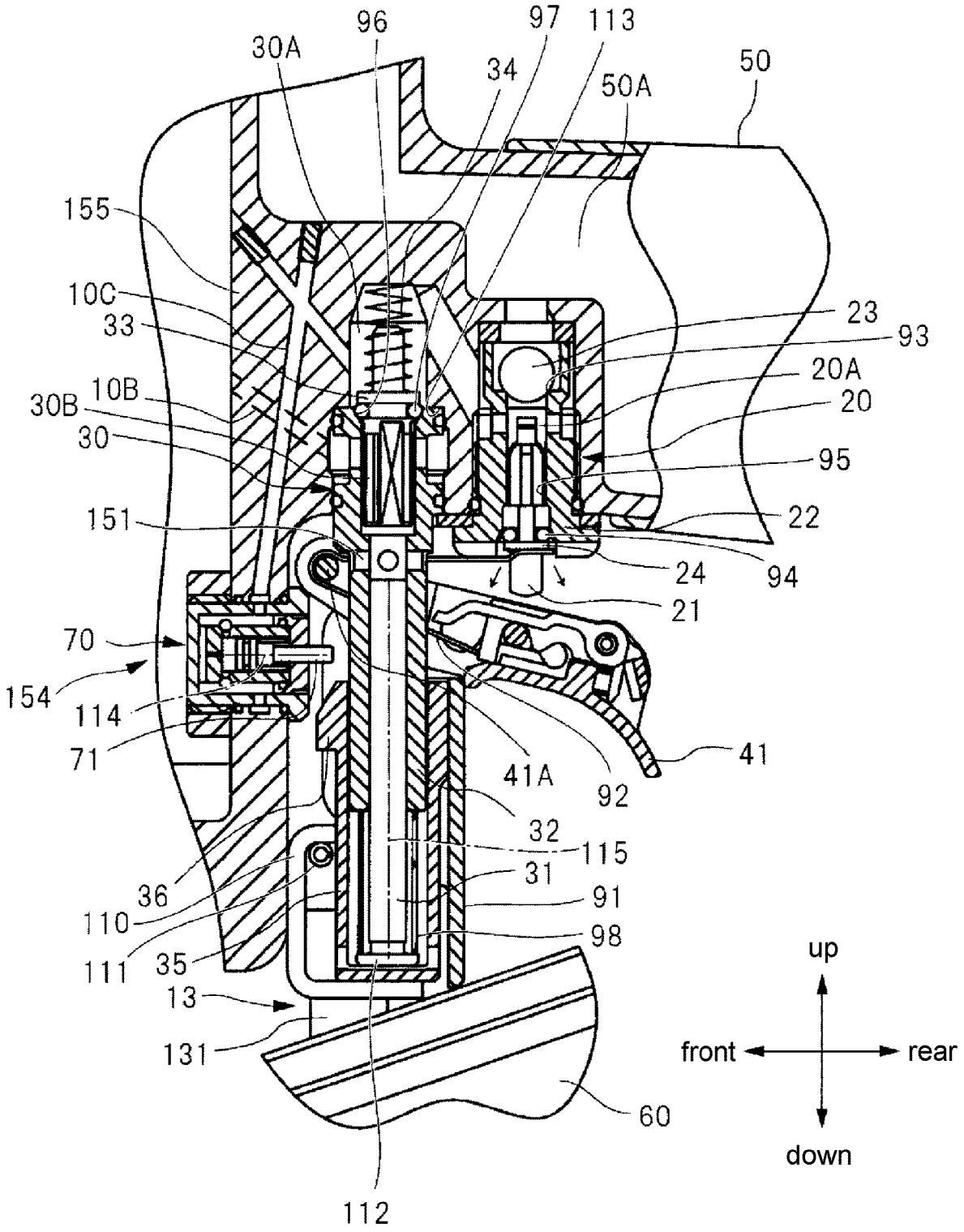

8, and FIG. 10. When the pin 71 moves rearward, the pin 71 approaches the valve body 32 in the direction of the axis 114.

Movement of the pin 71 leftward in any of FIG. 3A, FIG. 3B, FIG. 3C, and FIG. 3D is movement of the pin 71 forward in any of FIG. 2, FIG. 3, FIG. 4, FIG. 6, FIG. 8, and FIG. 10. When the pin 71 moves forward, the pin 71 is separated from the valve body 32 in the direction of the axis 114.

For example, when the push lever 13 is separated from the material to be driven 81 as shown in FIG. 1, the outer tubular member 35 is stopped at the initial position as shown in FIG. 2. Here, regarding the pin 71, the pin 71 moves from the initial position shown in FIG. 3A in the right direction along the axis 114 shown in FIG. 3B. In addition, the pin 71 can be stopped at the restriction position shown in FIG. 3C and FIG. 5.

Figure 5:
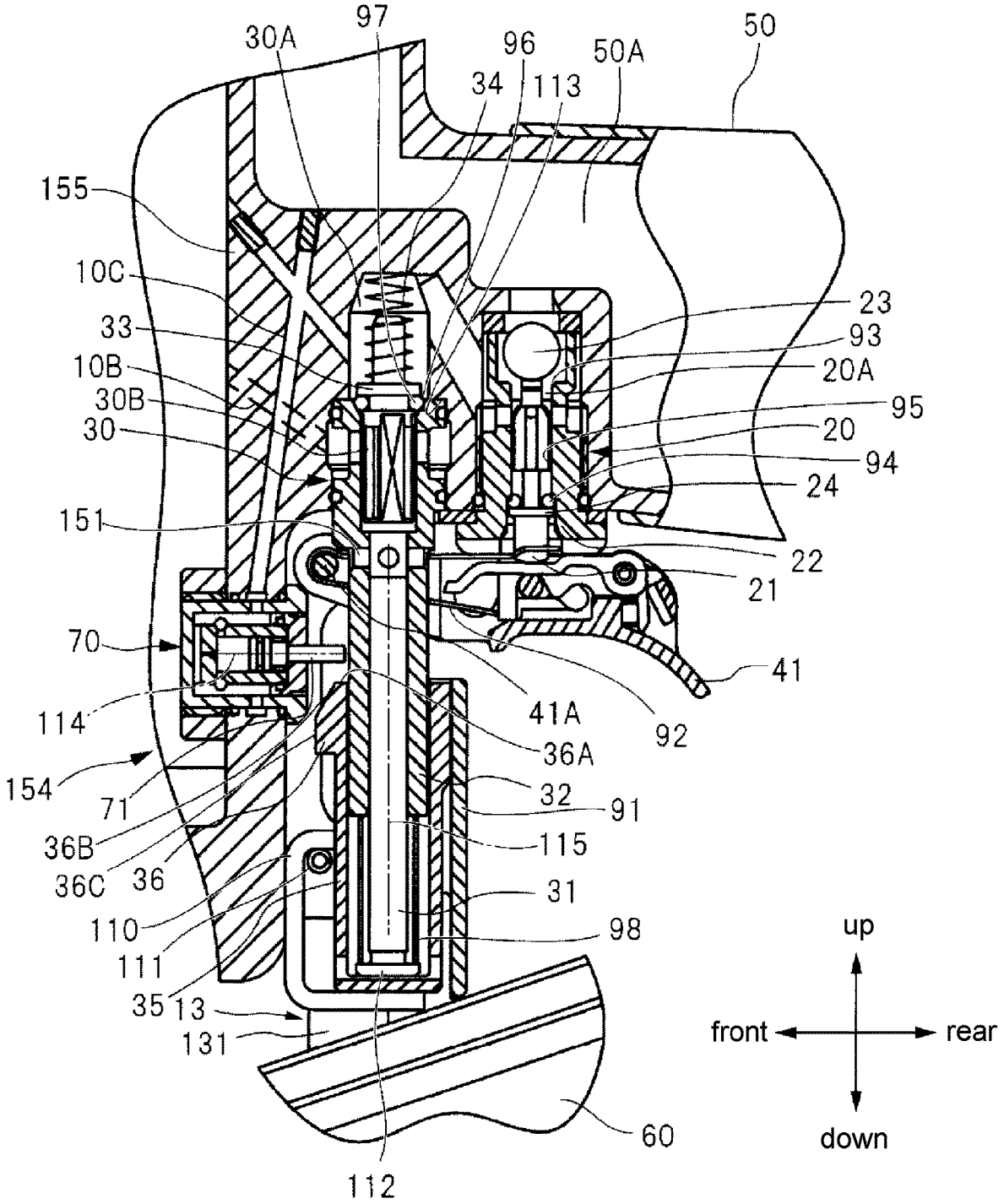

When the pin 71 is stopped at the restriction position, the push lever 13 is pressed against the material to be driven 81, and when the push lever 13 and the outer tubular member 35 move together upward along the axis 115 in FIG. 5, the lock pin locking portion 36 is locked into the pin 71. Therefore, moving the push lever plunger 31 upward along the axis 115 in FIG. 5 is restricted. Thus, as shown in FIG. 5, even if the trigger valve 20 is turned on, the push lever valve 30 remains in an off state, and the drive-in machine 100 does not start a driving operation.

Figure 3A:
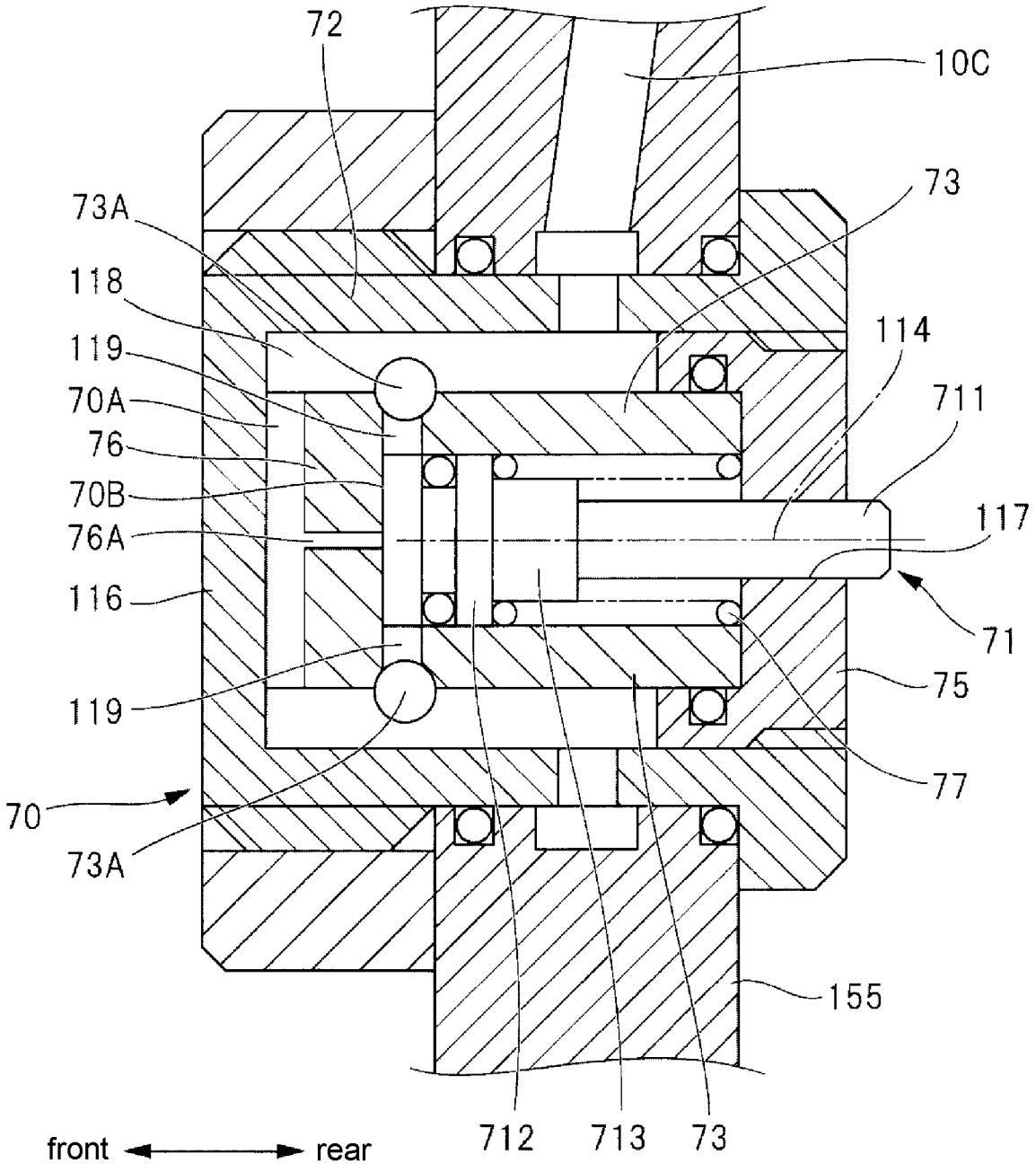
FIG. 3A shows main parts of Specific Example 1 of the restriction mechanism shown in FIG. 2 and is a cross-sectional view of a state in which a lock pin is at an initial position.
Figure 3B:
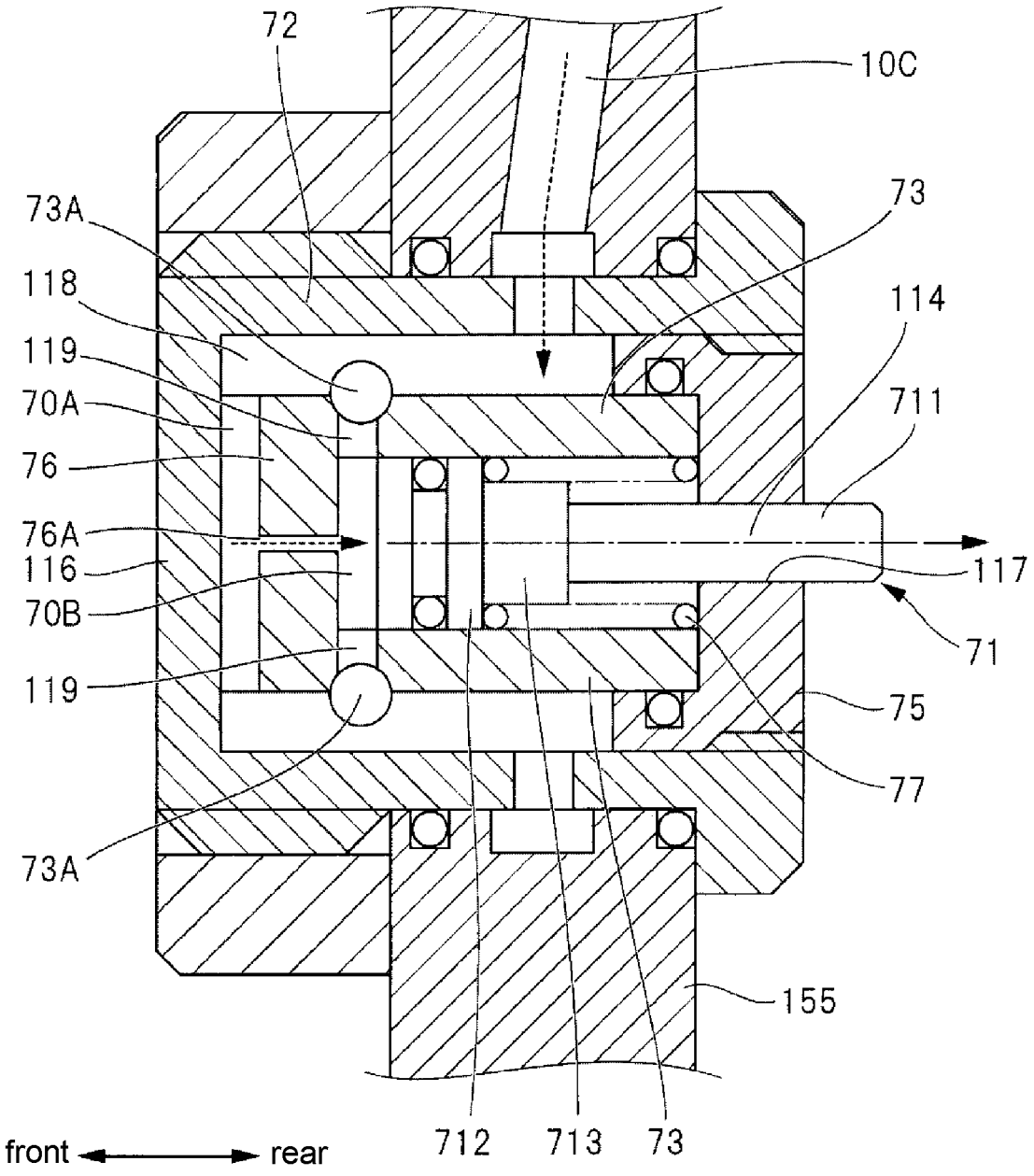
FIG. 3B shows main parts of Specific Example 1 of the restriction mechanism shown in FIG. 2, and is a cross-sectional view of a state in which the lock pin has moved from the initial position.
Figure 3C:
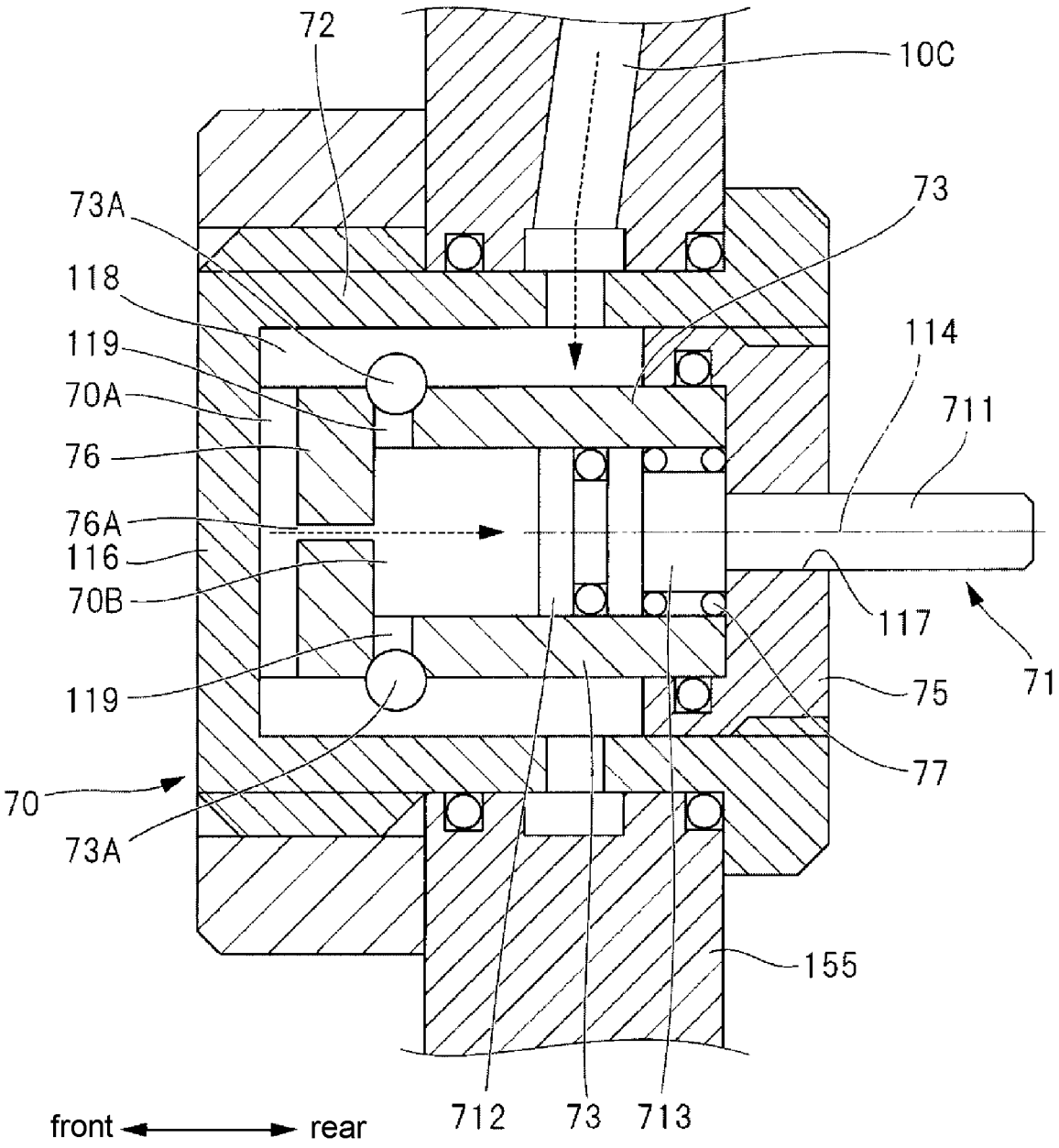
FIG. 3C shows main parts of Specific Example 1 of the restriction mechanism shown in FIG. 2 and is a cross-sectional view of a state in which the lock pin is at a restriction position.
Figure 3D:
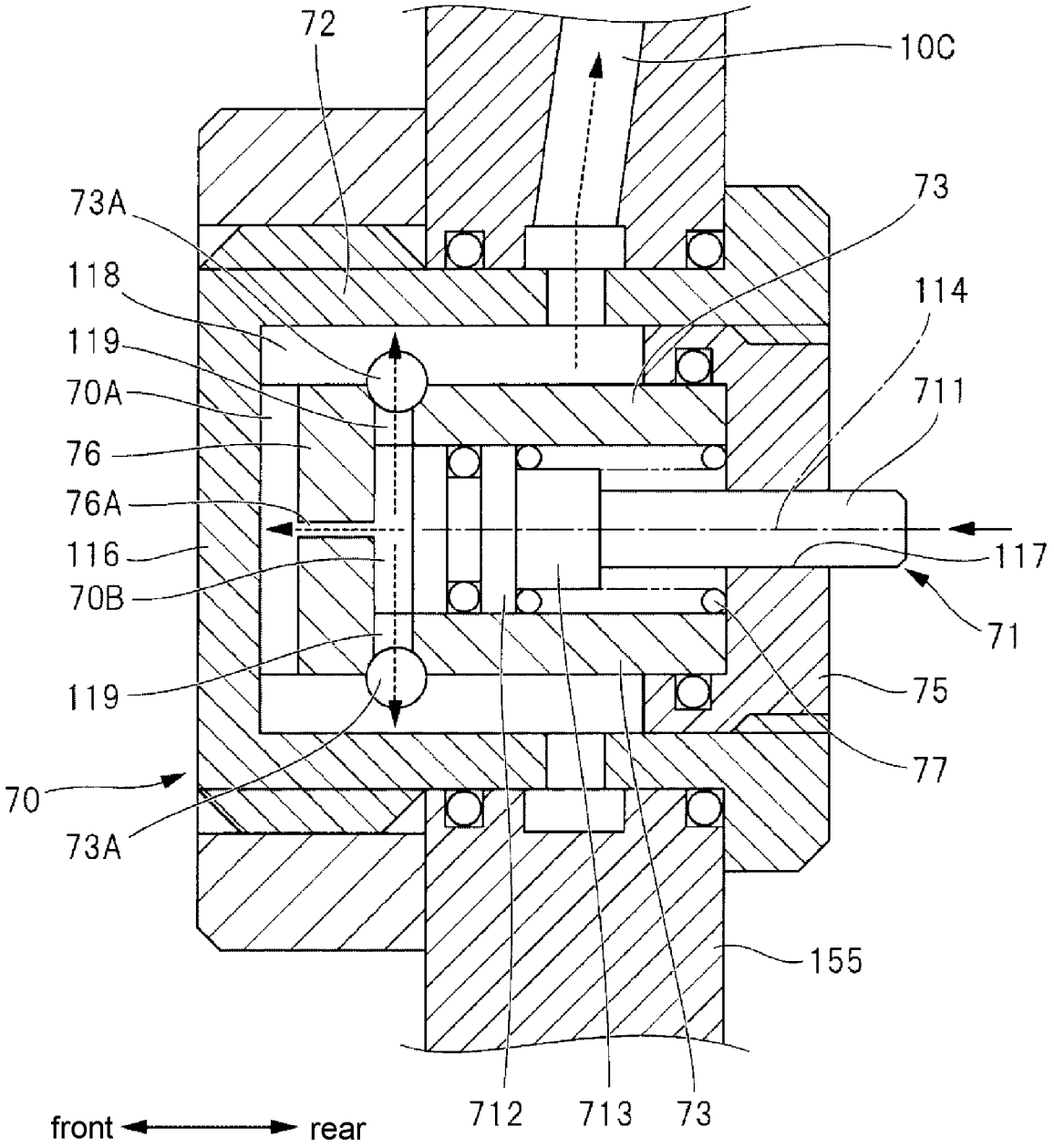
FIG. 3D shows main parts of Specific Example 1 of the restriction mechanism shown in FIG. 2 and is a cross-sectional view of a state in which the lock pin has moved from the restriction position to the initial position.

The structure of the pin drive unit 70 and the operation of the pin 71 will be described below. The pin drive unit 70 operates using compressed air in the pressure chamber 30A. As shown in FIG. 4, a control flow path 10C is provided in the main housing 10. As shown in FIG. 3A, the pin drive unit 70 has a first air chamber 70A, and the control flow path 10C connects the first air chamber 70A and the pressure chamber 30A. FIG. 3A shows a state in which the pin 71 is stopped at the initial position, FIG. 3B shows a state in which the pin 71 starts to move from the initial position in the right direction, FIG. 3C shows a state in which the pin 71 is stopped at the restriction position, and FIG. 3D shows a state in which the pin 71 moves from the restriction position to the initial position.

When the pin 71 is at the initial position in FIG. 3A, the push lever 13 can be switched from an off state to an on state. When the pin 71 is at the restriction position in FIG. 3C, it is not possible to switch the push lever 13 from an off state to an on state.

The outer cylindrical portion 72 constitutes the outer shell of the pin drive unit 70. The inner cylindrical portion 73 is provided in the outer cylindrical portion 72. The first air chamber 70A is formed between the outer cylindrical portion 72 and the inner cylindrical portion 73. The outer cylindrical portion 72, the inner cylindrical portion 73, and the pin 71 are disposed concentrically around the axis 114. A first end of the outer cylindrical portion 72 in the direction of the axis 114 is blocked by a wall 116. The outer wall 75 is fixed into a second end positioned on the side opposite to the wall 116 of the outer cylindrical portion 72 in the direction of the axis 114. The inner cylindrical portion 73 is disposed between the wall 116 and the outer wall 75 in the direction of the axis 114.

An end of the inner cylindrical portion 73 close to the wall 116 in the direction of the axis 114 is blocked by a wall 76. In addition, an end of the inner cylindrical portion 73 on the side opposite to the wall 76 in the direction of the axis 114 is blocked by the outer wall 75. Therefore, the inner cylindrical portion 73 is fixed in the direction of the axis 114 with respect to the outer cylindrical portion 72. The outer wall 75 has a shaft hole 117 centered on the axis 114.

The pin 71 has a tip 711, a piston portion 712 and a center portion 713. The center portion 713 is disposed between the tip 711 and the piston portion 712 in the direction of the axis 114. The piston portion 712 and the center portion 713 are disposed so that they are movable in the inner cylindrical portion 73 in the direction of the axis 114. The tip 711 is movably disposed in the shaft hole 117. In the inner cylindrical portion 73, a spring 77 is provided between the piston portion 712 and the outer wall 75. The spring 77 is, for example, a compression coil spring made of a metal, and the spring 77 biases the pin 71 against the wall 76.

In the inner cylindrical portion 73, a second air chamber 70B is formed between the piston portion 712 and the wall 76. The wall 76 has a passage 118 and a small hole 76A. The passage 118 and the small hole 76A are connected, the passage 118 is connected to the first air chamber 70A, and the small hole 76A is connected to the second air chamber 70B. A passage 119 that penetrates through the inner cylindrical portion 73 in the radial direction is provided. The passage 119 connects the first air chamber 70A and the second air chamber 70B.

A check valve 73A is attached to the outer circumferential surface of the inner cylindrical portion 73. The check valve 73A is, for example, a ring made of synthetic rubber. When the check valve 73A opens the passage 119, compressed air in the second air chamber 70B is allowed to be discharged to the first air chamber 70A via the passage 119. When the check valve 73A blocks the passage 119, compressed air in the first air chamber 70A is prevented from flowing into the second air chamber 70B via the passage 119.

The pin drive unit 70 can move and stop the pin 71 in the direction of the axis 114 according to an air pressure in the second air chamber 70B. A flow of compressed air between the pressure chamber 30A and the second air chamber 70B is generated via the first air chamber 70A. A flow of compressed air between the first air chamber 70A and the second air chamber 70B is generated via at least one of the small hole 76A and the passage 119. Here, a flow rate of air passing through the small hole 76A, that is, a flow rate per unit time, is set to be smaller than a flow rate of air passing through the passage 119.

The pin 71 is biased due to a biasing force of the spring 77 so that it is separated from the valve body 32 in the direction of the axis 114. In addition, when compressed air is introduced into the second air chamber 70B, the pin 71 moves toward the valve body 32 against an elastic force of the spring 77 by an air pressure in the second air chamber 70B in the direction of the axis 114. In addition, when an air pressure in the second air chamber 70B decreases, the pin 71 moves due to a biasing force of the spring 77, and comes in contact with the wall 76 and is stopped at the initial position as shown in FIG. 3A.

As shown in FIG. 2, when the trigger 41 and the push lever 13 are both turned off, that is, when the trigger valve 20 and the push lever valve 30 are both turned off, the pressure chamber 30A has an atmospheric pressure. Since the first air chamber 70A communicates with the pressure chamber 30A, the first air chamber 70A also has an atmospheric pressure, and no compressed air is introduced into the second air chamber 70B. Therefore, the pin 71 is pushed due to a biasing force of the spring 77 and is stopped at the initial position in FIG. 3A.

On the other hand, when the trigger valve 20 is switched from off to on, compressed air in the accumulation chamber 50A is introduced into the pressure chamber 30A. Some of the compressed air in the pressure chamber 30A is introduced into the first air chamber 70A. At this time, an air pressure in the second air chamber 70B is lower than a pressure at which the check valve 73A is opened, and the check valve 73A is closed. Therefore, compressed air in the first air chamber 70A gradually flows into the second air chamber 70B via the passage 118 and the small hole 76A, and a pressure in the second air chamber 70B gradually increases.

Therefore, as shown in FIG. 3B, the pin 71 moves along the axis 114 in the right direction. Then, as shown in FIG. 3C, the center portion 713 comes in contact with the outer wall 75, and the pin 71 is stopped at the restriction position. In addition, a pressure in the second air chamber 70B is the same as a pressure in the first air chamber 70A and the pressure chamber 30A. That is, when compressed air in the pressure chamber 30A is introduced into the second air chamber 70B via the first air chamber 70A, the pin 71 can be moved from the initial position to the restriction position. A moving speed of the pin 71 corresponds to a flow rate of air flowing through the small hole 76A.

On the other hand, an operation when the trigger valve 20 is switched from on to off and compressed air in the pressure chamber 30A is discharged to the outside of the main housing 10 will be described. When a pressure in the pressure chamber 30A decreases, a pressure in the first air chamber 70A also decreases, and compressed air in the second air chamber 70B flows into the first air chamber 70A via the small hole 76A and the passage 118 as shown in FIG. 3D. In addition, when an air pressure in the first air chamber 70A decreases, the check valve 73A is opened, and some of the compressed air in the second air chamber 70B is discharged to the first air chamber 70A via the passage 119.

In addition, the piston portion 712 is biased by the spring 77 in the left direction in FIG. 3D. Therefore, a flow rate of air discharged from the second air chamber 70B into the first air chamber 70A when the pin 71 is moved in the left direction as shown in FIG. 3D is higher than a flow rate of air introduced from the first air chamber 70A into the second air chamber 70B when the pin 71 is moved in the right direction in FIG. 3B. Therefore, a moving speed when the pin 71 moves in the left direction as shown in FIG. 3D can be set to be higher than a moving speed when the pin 71 moves in the right direction as shown in FIG. 3B.

Hereinafter, when the operator performs an operation of driving the nail 80 into the material to be driven 81 using the drive-in machine 100, an operation of the pin drive unit 70 corresponding to an operation of the trigger 41 and the push lever 13, and particularly, an operation of the pin 71, will be described.

FIG. 2 shows a state in which the trigger 41 and the push lever 13 are both turned off. When the trigger 41 and the push lever 13 are both turned off, the pin 71 is stopped at the initial position as shown in FIG. 3A. In a state in which the pin 71 is stopped at the initial position, when the push lever 13 is pressed against the material to be driven 81, and the push lever 13 moves upward in FIG. 1, the pin 71 is not engaged with the lock pin locking portion 36. That is, the push lever 13 is moved upward in the off state in FIG. 2, and the push lever 13 can be switched to an on state shown in FIG. 8.

As shown in FIG. 2, an operation of the pin drive unit 70 when the trigger 41 is switched from off to on in a state in which the trigger 41 and the push lever 13 are both turned off, as shown in FIG. 4, and the push lever 13 remains in an off state will be described.

First, compressed air is introduced into the pressure chamber 30A from when the trigger 41 is switched from off to on, and some of the compressed air in the pressure chamber 30A is introduced into the first air chamber 70A. Then, compressed air in the first air chamber 70A is gradually introduced into the second air chamber 70B. Therefore, the pin 71 moves from the initial position shown in FIG. 3A in the right direction as shown in FIG. 3B. In addition, since the push lever 13 is in an off state as shown in FIG. 2, the lock pin locking portion 36 is positioned below the pin 71.

When a predetermined time has elapsed from when the trigger 41 is switched from off to on, the pin drive unit 70 is in a state in FIG. 5 and FIG. 3C. The pin 71 is stopped at a position moved to the rightmost side in the direction of the axis 114, that is, at the restriction position. When the pin 71 is stopped at the restriction position, when the push lever 13 is pressed against the material to be driven 81, and the push lever 13 is intended to be moved upward in FIG. 5, the lock pin locking portion 36 is locked into the pin 71. Therefore, an amount by which the push lever plunger 31 moves upward in FIG. 5 is restricted, and the push lever valve 30 is turned off, that is, remains in a closed state. That is, the pin 71 restricts switching of the push lever valve 30 from off to on. Therefore, the striking portion 16 does not start a driving operation.

FIG. 4 and FIG. 5 shows an operation of the pin drive unit 70 when the trigger 41 is kept on while the push lever 13 is turned off. That is, the operation corresponds to passage of a waiting time from when the trigger 41 is switched from off to on in order to perform a continuous striking operation until the push lever 13 is switched from off to on and the drive-in machine 100 performs a first driving operation. That is, when the waiting time exceeds a predetermined time and the pin drive unit 70 is in a state in FIG. 5, even if the push lever 13 is switched from off to on, the lock pin locking portion 36 is locked into the pin 71, and switching of the push lever 13 from off to on is restricted.

On the other hand, a moving speed at which the pin 71 stopped at the initial position moves toward the restriction position is slow. Therefore, within a predetermined time from when the trigger 41 is turned on, the pin 71 is stopped at the initial position as in FIG. 2. Therefore, immediately after the trigger 41 is switched from off to on, the push lever 13 is switched from off to on, and the drive-in machine 100 can perform a driving operation.

Next, as shown in FIG. 3B and FIG. 4, during movement of the pin 71, an operation of the pin drive unit 70 when the push lever 13 is intended to be switched from off to on will be described.

Figure 6:
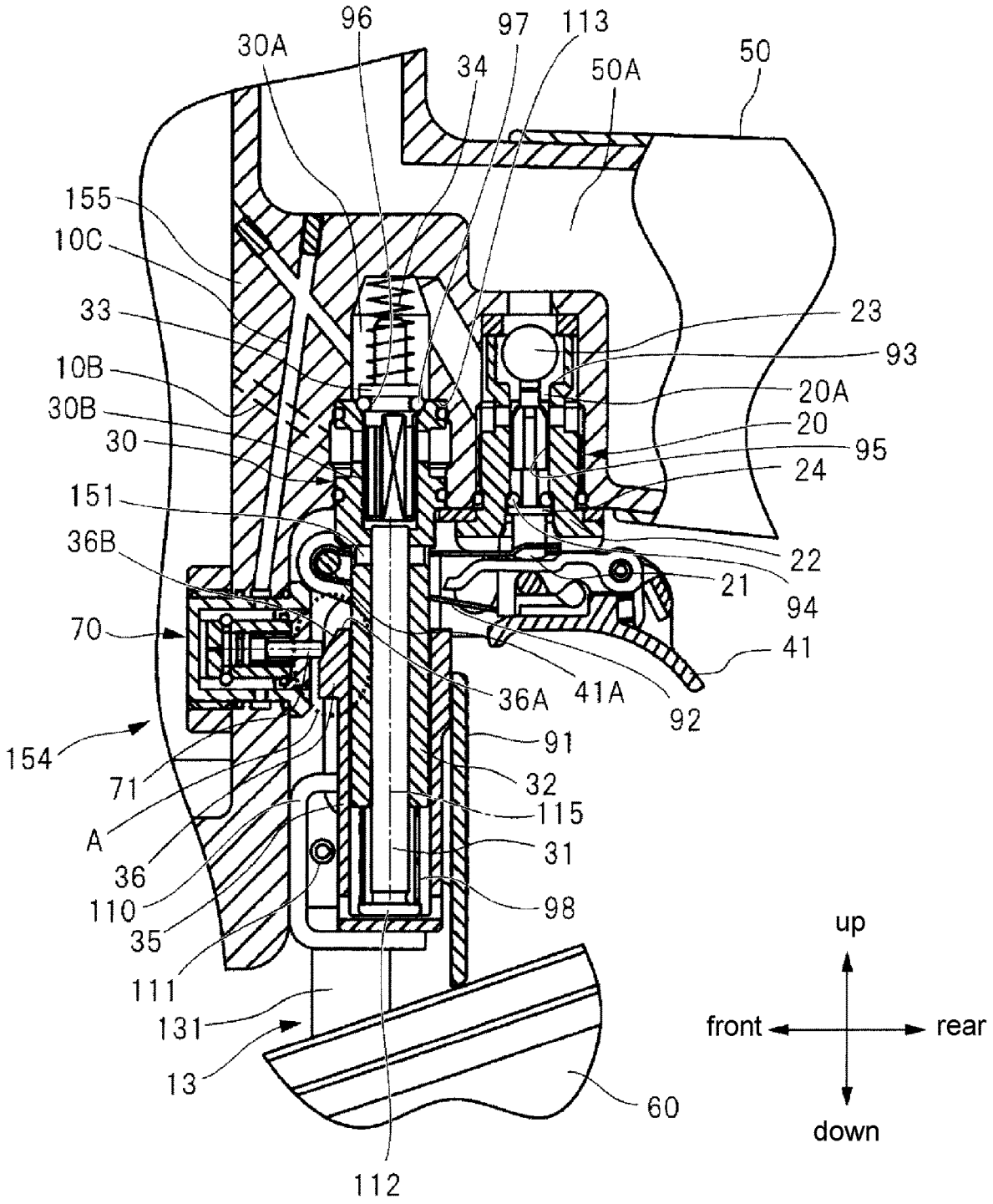
Figure 7:
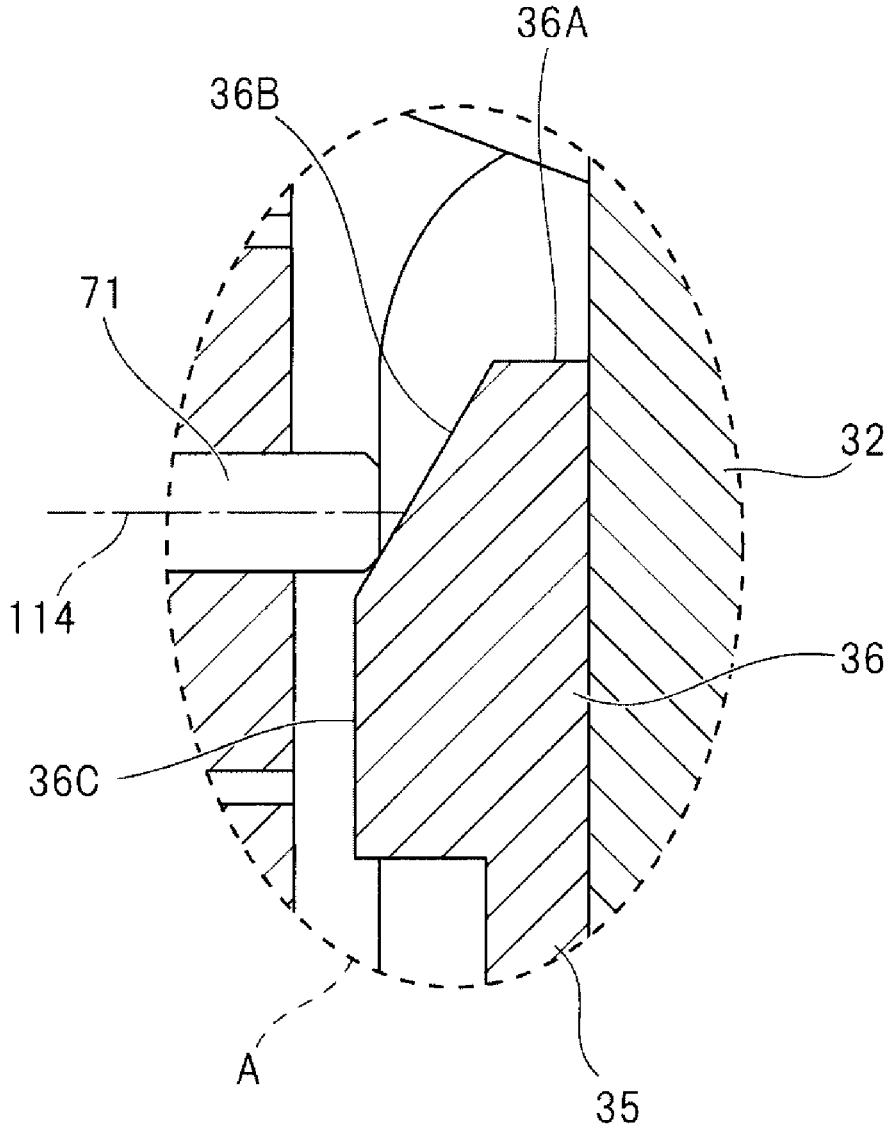
FIG. 7 is a cross-sectional view showing an enlarged area A in FIG. 6.

FIG. 6 shows a state of the pin drive unit 70 when the push lever 13 is intended to be switched from off to on while the pin 71 reaches the restriction position from the initial position. FIG. 7 shows an enlarged area A surrounded by a dashed line in FIG. 6. As in the pin drive unit 70 shown in FIG. 6 and FIG. 7, the tip 711 of the pin 71 comes in contact with the inclined surface 36B. Therefore, when the push lever 13 moves upward in FIG. 6, a component force is applied from the inclined surface 36B to the pin 71 in the direction of the axis 114. Therefore, the pin 71 can be moved along the axis 114 in the left direction as shown in FIG. 3D. In this case, in the pin drive unit 70, compressed air in the second air chamber 70B flows into the first air chamber 70A via the small hole 76A and the passage 119.

In this manner, when the pin 71 is in a state in FIG. 3B, without lowering a pressure in the first air chamber 70A, a force is applied from the outer tubular member 35 to the pin 71 in the left direction. Therefore, as in FIG. 3D, compressed air in the second air chamber 70B is discharged to the first air chamber 70A, and the pin 71 can be moved in the left direction.

That is, when compressed air in the first air chamber 70A is discharged to the outside of the main housing 10 via the pressure chamber 30A or when a force is applied to the pin 71 in FIG. 3C in the left direction, the pin 71 can be moved from the restriction position to the initial position. In particular, when the check valve 73A opens the passage 119, a moving speed at which the pin 71 shown in FIG. 3C moves in the left direction can be set to be higher than a moving speed at which the pin 71 shown in FIG. 3A moves in the right direction.

Therefore, when the pin drive unit 70 is in a state in FIG. 6, a force moving the push lever 13 upward in FIG. 6 is applied so that the push lever 13 can be moved further upward. FIG. 8 shows a state in which the push lever 13 shown in FIG. 6 is moved further upward. FIG. 9 shows a contact state between the pin 71 and the outer tubular member 35 when the push lever 13 shown in FIG. 6 is moved further upward. The pin 71 shown in FIG. 9 comes in contact with the vertical surface 36C below the inclined surface 36B, and can push the push lever 13 up so that the pin 71 slides on the vertical surface 36C, and the push lever 13 can be in an on state. In this case, the pin 71 moves to the initial position in FIG. 3A.

In the drive-in machine 100, after the pin 71 moves from the initial position to the restriction position when a predetermined time has elapsed from when only the trigger 41 is turned on in a state in which the trigger 41 and the push lever 13 are turned off, it is not possible to switch the push lever 13 from off to on.

In addition, when the push lever 13 is pressed against the material to be driven 81 within a predetermined time from when the trigger 41 is turned on, for example, before the pin 71 reaches the restriction position, as shown in FIG. 7, the pin 71 comes in contact with the lock pin locking portion 36. However, the pin 71 is moved in the left direction as in FIG. 3D, and the push lever 13 can be switched from off to on. That is, in the continuous striking operation, when a waiting time after the trigger 41 is turned on exceeds a predetermined time, the drive-in machine 100 cannot start a first driving operation. On the other hand, in the continuous striking operation, when the waiting time is within a predetermined time, the drive-in machine 100 can start a first driving operation.

In addition, the pin 71 shown in FIG. 8 is stopped at the initial position as in the pin 71 shown in FIG. 3A. In a state in which the pin 71 is stopped at the initial position as shown in FIG. 8, even if the push lever 13 is once switched from on to off, when the trigger 41 remains in an on state, the pin 71 gradually moves from the initial position in FIG. 3A to the restriction position in FIG. 3C due to compressed air in the pressure chamber 30A. The operation of the pin 71 is the same as an operation of the pin 71 when the trigger 41 is turned on in a state in which the trigger 41 and the push lever 13 are both turned off.

Therefore, as shown in FIG. 8, until the push lever 13 is switched from off to on again from when the push lever 13 in an on state is turned off once, the state of the pin 71 changes from a state in FIG. 3A to a state in FIG. 3C. That is, when a waiting time from when the push lever 13 is turned off once until the push lever 13 is turned on again is within a predetermined time, the push lever 13 can be switched from off to on again. On the other hand, when waiting time from when the push lever 13 is turned off once until the push lever 13 is turned on again exceeds a predetermined time, the pin 71 restricts switching of the push lever 13 from off to on.

In addition, FIG. 10 shows a state in which the trigger 41 is turned off in a state in FIG. 5 in which the push lever 13 cannot be switched from off to on. In this case, the pressure chamber 30A is opened to the atmosphere via the trigger valve chamber 20A at the same time when supply of compressed air to the pressure chamber 30A is stopped. Therefore, as shown in FIG. 3D, the first air chamber 70A is also opened to the atmosphere, and the pin 71 moves in the left direction and returns to the initial position in FIG. 3A. That is, since the push lever 13 and the trigger 41 are both turned off, a single striking operation can be performed by turning the push lever 13 on again, and a continuous striking operation can be performed again by turning the trigger 41 on.

In the above operation, a time required for moving the pin 71 from the initial position to the restriction position can be significantly longer than a time required for moving the pin 71 from the restriction position to the initial position. Therefore, it is possible to prevent the push lever 13 from being switched from off to on only when a waiting time in the continuous striking operation is long, and when the waiting time is short, the push lever 13 can be switched from off to on, and a continuous striking operation can be performed. In this case, a state in which the push lever 13 cannot be turned on can be released in a short time by turning the trigger 41 off, and thereafter, either a continuous striking operation or a single striking operation can be performed.

Specifically, after the trigger 41 is turned on in a state in which the trigger 41 and the push lever 13 are both turned off, when the drive-in machine 100 performs a first driving operation, an operation in which the push lever 13 is switched from off to on is allowed before a first time T1 has elapsed using a time at which the trigger 41 is turned on as a starting point. On the other hand, when the first time T1 exceeds, the pin 71 restricts switching of the push lever 13 from off to on.

The first time T1 is a time from when the pin 71 is at the initial position shown in FIG. 3A until the pin 71 moves to the restriction position shown in FIG. 3C.

Here, FIG. 8 shows states of the push lever 13 and the pin drive unit 70 when the push lever 13 is switched from off to on before the first time T1 has elapsed and the drive-in machine 100 performs a driving operation. When the push lever 13 and the pin drive unit 70 are in a state shown in FIG. 8, the drive-in machine 100 is intended to perform a next driving operation, and when the push lever 13 is turned off once, and the pin 71 moves to a position in a state in FIG. 3A, an operation when the drive-in machine 100 performs a driving operation thereafter is the same as that when the drive-in machine 100 performs a first driving operation.

That is, an operation in which the push lever 13 is turned from off to on is allowed before the first time T1 has elapsed using a time at which the push lever 13 is turned off as a starting point. On the other hand, after the first time T1 has elapsed, the pin 71 restricts an operation of turning the push lever 13 from off to on. Therefore, the first time T1 is preferably in a range of 1 second or longer and 30 seconds or shorter and particularly preferably in a range of 2 seconds or longer and 20 seconds or shorter. Further, the first time T1 is preferably 3 seconds or longer and 10 seconds or shorter.

However, a state of the pin 71 when the push lever 13 is turned off once in a state in FIG. 8 is not necessarily strictly the same at the position in FIG. 3A and the position in FIG. 2. For example, the position of the pin 71 in FIG. 3A can be to the right with respect to the position of the pin 71 in FIG. 2. In this case, when the drive-in machine 100 performs second and subsequent driving operations, a position at which the pin 71 starts to move to the right in FIG. 3A is closer to a restriction position than a position at which the pin 71 starts to move in the right direction in FIG. 2. Therefore, a time-out time when the drive-in machine 100 performs second and subsequent driving operations is shorter than a time-out time when the drive-in machine 100 performs a first driving operation.

On the other hand, after the pin 71 restricts switching of the push lever 13 from off to on, the trigger 41 is turned off, and after a second time T2 has elapsed from when the trigger 41 is turned on again, the pin 71 allows the push lever 13 to be switched from off to on.

In order to perform an operation using the drive-in machine 100 efficiently, the second time T2 is preferably short, and is preferably shorter than at least the time-out time, that is, the first time T1. When the second time T2 is too long, since a long time is required to release restriction with the pin 71, it is difficult to perform an operation using the drive-in machine 100 efficiently. Therefore, the second time T2 is preferably 1 second or shorter, and particularly in a range of 0.5 seconds or shorter.

The first time T1 and the second time T2 can be adjusted according to a moving speed at which the pin 71 moves in the right direction in FIG. 3A and FIG. 3B, a moving speed at which the pin 71 moves in the left direction in FIG. 3C and FIG. 3D, the shape of the lock pin locking portion 36, that is, angles of the lock pin locking surface 36A and the inclined surface 36B and the like. Among these, the moving speed of the pin 71 can be adjusted by a flow rate of air in the small hole 76A, a flow rate of air in the passage 119, and characteristics of the spring 77 in FIG. 3A, FIG. 3B, FIG. 3C and FIG. 3D. A flow rate of air in the small hole 76A can be adjusted by setting an opening area of the small hole 76A. A flow rate of air in the passage 119 can be adjusted by an opening area of the passage 119.

In the above configuration, the pin drive unit 70 can operate the pin 71 as described above during an operation of the trigger 41 and the push lever 13 using only compressed air used for a driving operation of the drive-in machine 100. Therefore, a sensor, an actuator, a motor and the like used only for operating the pin 71 are not necessary, and the drive-in machine 100 can be made inexpensive.

Here, in the above configuration, in order to drive the pin 71, compressed air supplied from the side of the trigger valve 20 to the pressure chamber 30A is used. However, regarding a configuration in which compressed air is supplied to a striking portion according to movement of the trigger and the push lever, a configuration other than the above configuration can be used. Compressed air for driving the restricting member can be appropriately set according to the passage of compressed air in such a case.

In addition, in the above configuration, when control is performed on second and subsequent driving operations in the continuous striking operation, the pin 71 is brought into the initial state due to movement of the lock pin locking portion 36. However, for example, the pin 71 may be brought into the initial state by removing compressed air in the first air chamber 70A after the drive-in machine 100 ends one driving operation. In such a case, it is not necessary to form the lock pin locking portion into a shape that can push back the lock pin, and the lock pin locking portion can have a shape with which movement of the push lever can be restricted more reliably. Alternatively, a configuration in which restriction on the movement in which the push lever 13 is turned on as described above is applied to only a first driving operation for the continuous striking operation, and is not applied to second and subsequent driving operations may be used.

Specific Example 2

Specific Example 2 of the restriction mechanism 154 that can be provided in the drive-in machine 100 will be described with reference to FIG. 11. The guide member 91 supports a plunger guide 120. The plunger guide 120 has a cylindrical shape, and the push lever plunger 31 is movable in a shaft hole 121 of the valve body 32 and the plunger guide 120 in the direction of the axis 115. In addition, the push lever plunger 31 is rotatable around the axis 115 with respect to the plunger guide 120. An elastic member 122 is disposed between the hook 110 and the plunger guide 120. The elastic member 122 is, for example, a compression spring made of a metal. The elastic member 122 biases the push lever 13 downward in FIG. 11.

Figure 11:
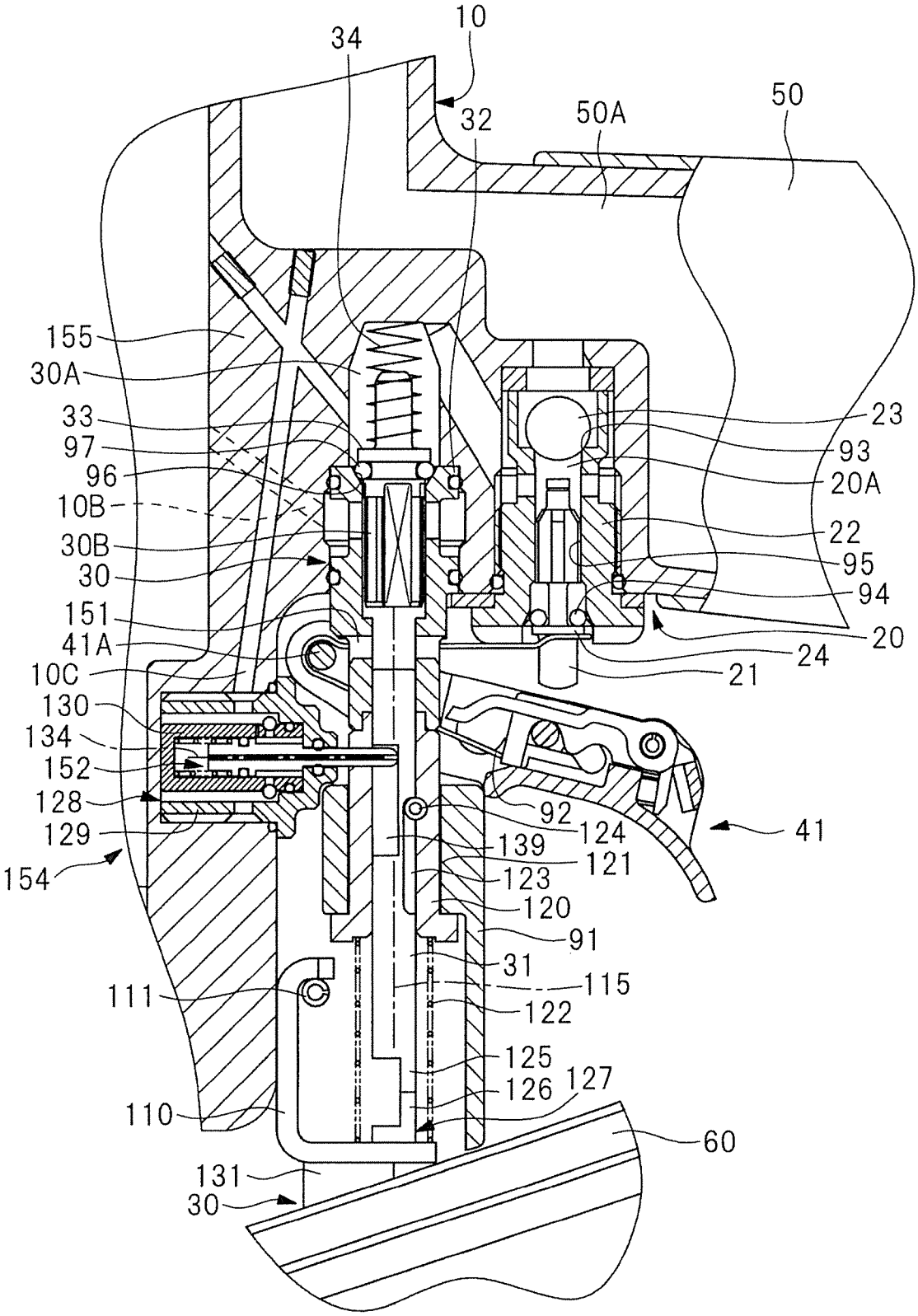
FIG. 11 shows Specific Example 2 of the trigger valve, the push lever valve, and the restriction mechanism used in the drive-in machine in FIG. 1 and is a cross-sectional view of a state in which the trigger valve and the push lever valve are both turned off.
Figure 12:
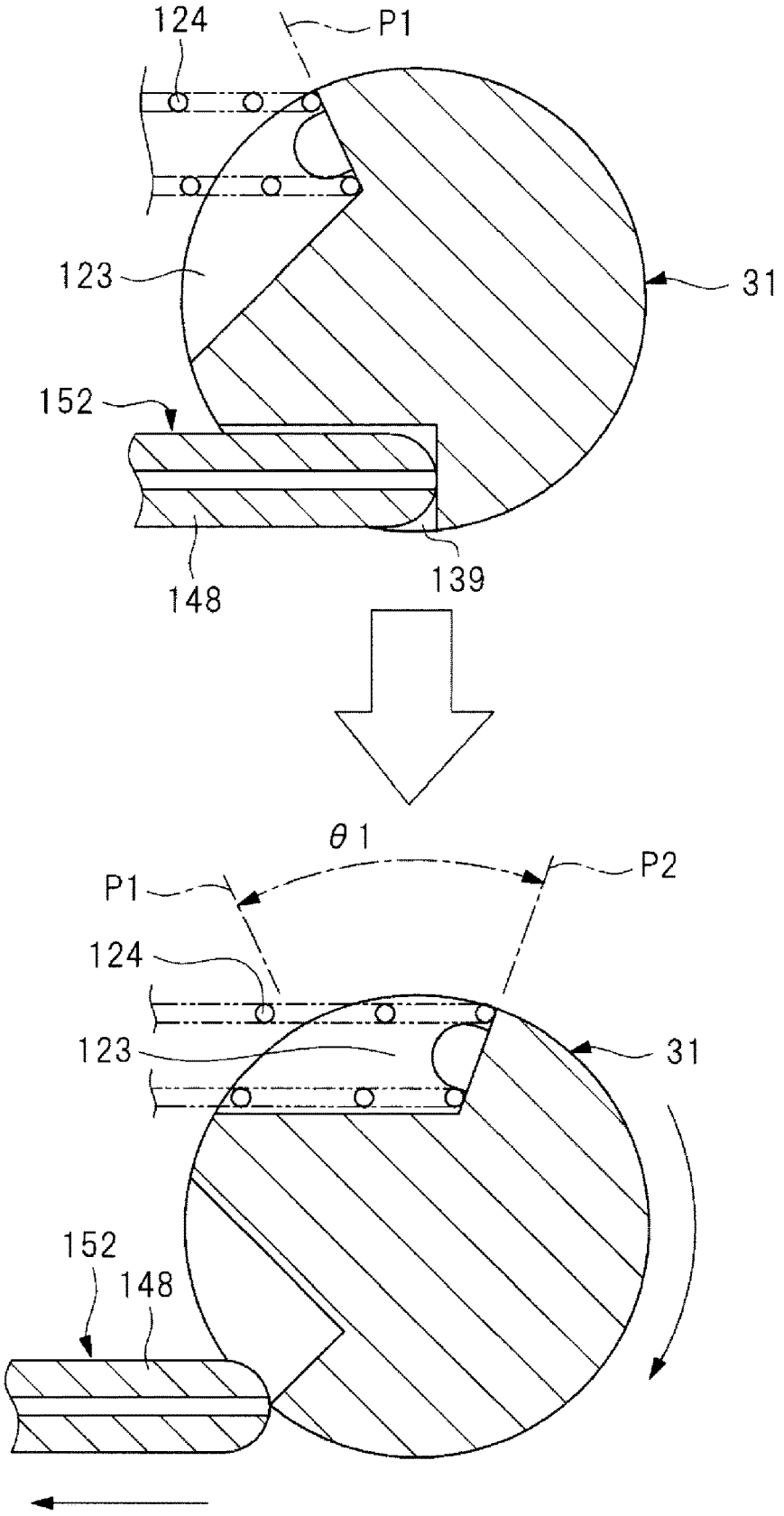
FIG. 12 is a cross-sectional plan view showing an operation of the restriction mechanism shown in FIG. 11.

As shown in FIG. 11 and FIG. 12, the push lever plunger 31 has a groove 123. The groove 123 is provided in a predetermined range in the direction of the axis 115 as shown in FIG. 11. A biasing member 124 is provided in the shaft hole 121, and the biasing member 124 is, for example, a compression spring made of a metal. A part of the biasing member 124 is disposed in the groove 123, and the biasing member 124 is pressed against the push lever plunger 31. The biasing member 124 applies a biasing force in the circumferential direction centered on the axis 115 to the push lever plunger 31. For example, FIG. 12 shows a structure in which the biasing member 124 applies a clockwise biasing force to the push lever plunger 31. A groove 139 is provided on the outer circumferential surface of the push lever plunger 31. The groove 139 is provided with a predetermined length in the direction of the axis 115.

Figure 13:
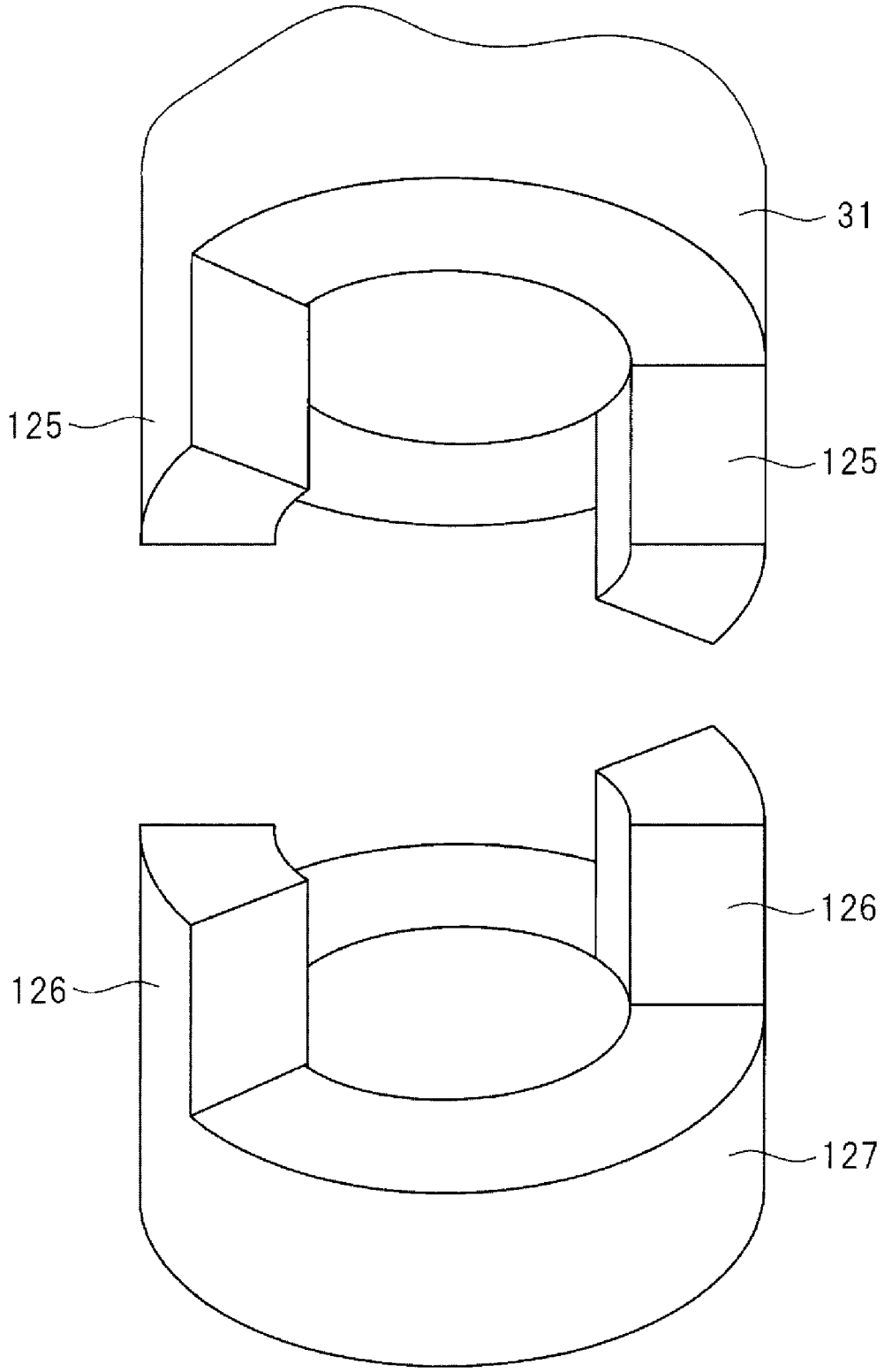
FIG. 13 is a perspective view of a contact protrusion provided on the push lever and the block shown in FIG. 11.

As shown in FIG. 11 and FIG. 13, in the longitudinal direction of the push lever 13, a contact protrusion 125 is provided at an end closest to the push lever arm portion 131. One contact protrusion 125 is provided in the circumferential direction centered on the axis 115, or a plurality of, for example, two, contact protrusions 125 are provided at intervals.

A block 127 is fixed to the hook 110, and the block 127 has a contact protrusion 126. One contact protrusion 126 is provided in the circumferential direction centered on the axis 115, or a plurality of, for example, two, contact protrusions 126 are provided at intervals. Two contact protrusions 125 and two contact protrusions 126 are disposed on the same circumference.

A pin drive unit 128 is provided on the wall 155 that forms the return chamber 10A of the main housing 10. The pin drive unit 128 has an outer tubular member 129, an inner cylindrical member 130 and a pin 152. The outer tubular member 129 and the inner cylindrical member 130 are provided around the axis 134. The axis 134 intersects the axis 115, and, for example, is disposed perpendicular to the axis 115. A passage 132 that penetrates through the outer tubular member 129 in the radial direction is provided. The outer tubular member 129 has a wall 149 that protrudes inward in the radial direction. The wall 149 is provided at a part closest to the plunger guide 120 in the direction of an axis 134. A shaft hole 133 that penetrates through the wall 149 in the direction of the axis 134 is provided. The shaft hole 133 is provided around the axis 134. The inner cylindrical member 130 is provided in the outer tubular member 129 and is provided so that it does not move in the direction of the axis 134. A passage 135 is provided between the outer tubular member 129 and the inner cylindrical member 130, and the passage 132 connects the passage 135 and the control flow path 10C.

The inner cylindrical member 130 has a cylindrical portion 136 and a wall 137 that blocks one end of the cylindrical portion 136 in the longitudinal direction. A shaft hole 138 that penetrates from the inside to the outside of the plunger guide 120 is provided.

The pin 152 has a large-diameter portion 147, a small-diameter portion 148, and a land portion 140. The outer diameter of the large-diameter portion 147 is larger than the outer diameter of the small-diameter portion 148. A step 153 is provided at a boundary between the large-diameter portion 147 and the small-diameter portion 148. The step 153 is perpendicular to the axis 134 and has an annular flat surface. The large-diameter portion 147 is disposed in the cylindrical portion 136, and the small-diameter portion 148 is disposed across the shaft holes 133 and 138. The pin 152 is movable in the direction of the axis 134.

The land portion 140 protrudes from the outer circumferential surface of the large-diameter portion 147 in the radial direction and is provided in an annular shape. A sealing member 141 is attached to the outer circumferential surface of the land portion 140. In the inner cylindrical member 130, an air chamber 142 is provided between the land portion 140 and the outer tubular member 129. The sealing member 141 seals the air chamber 142. A sealing member 150 is attached to the inner surface of the shaft hole 133 in the wall 149, and the sealing member 150 seals the air chamber 142. A passage 143 that penetrates through the cylindrical portion 136 in the radial direction is provided, and the passage 143 connects the passage 135 and the air chamber 142. An opening area of the passage 143 is narrower than an opening area of the passage 132.

A passage 144 that penetrates through the cylindrical portion 136 in the radial direction is provided, and a check valve 145 that opens and closes the passage 144 is provided. The check valve 145 allows air in the air chamber 142 to flow through the passage 135 via the passage 144. The check valve 145 prevents air in the passage 135 from flowing into the air chamber 142 via the passage 144. An opening area of the passage 144 is wider than the opening area of the passage 143.

Figure 14:
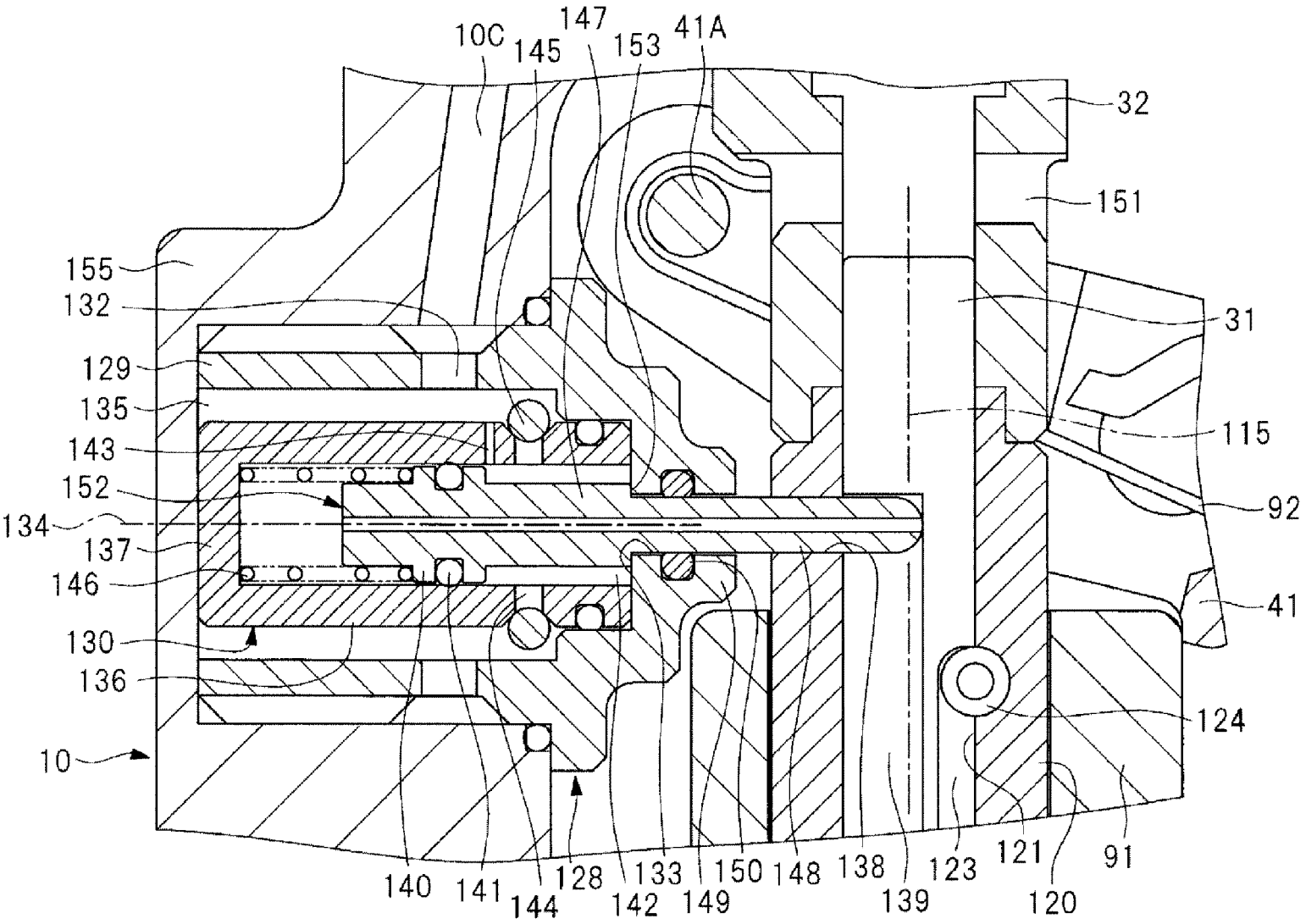
FIG. 14 is an enlarged cross-sectional view showing main parts in FIG. 11.

In the inner cylindrical member 130, an elastic member 146 is provided between the wall 137 and the land portion 140. The elastic member 146 biases the pin 152 along the axis 134 in FIG. 14 in the right direction, that is, toward the plunger guide 120. Specific Example 2 of the restriction mechanism 154 is constituted by the pin drive unit 128, the push lever plunger 31, the biasing member 124, and the block 127.

Next, actions of Specific Example 2 of the restriction mechanism 154 will be described. In a state in which compressed air is supplied to the accumulation chamber 50A, as shown in FIG. 11, when no operating force is applied to the trigger 41, the trigger valve 20 is turned off, that is, in a closed state. In addition, when the push lever 13 is separated from the material to be driven 81, the push lever valve 30 is turned off, that is, in a closed state. The push lever 13 is pushed due to a biasing force of the elastic member 122, the hook 110 is engaged with the stopper 111, and the push lever 13 is stopped at the initial position. An action in which the trigger valve 20 is closed is the same as in FIG. 2.

As shown in FIG. 11, when the trigger valve 20 is closed, no compressed air in the accumulation chamber 50A is sent to the pressure chamber 30A. Therefore, compressed air does not flow into the air chamber 142 shown in FIG. 14, and the air chamber 142 has a low pressure. A pin 152 is biased by the elastic member in the left direction in FIG. 14, the step 153 is pressed against the wall 149, and the pin 152 is stopped at the initial position.

In addition, the push lever plunger 31 is biased by the biasing member 124 as shown in the upper part in FIG. 12. When the pin 152 is stopped at the initial position, as shown in the upper part in FIG. 12, the small-diameter portion 148 of the pin 152 is positioned in the groove 139, and the pin 152 is pressed against the push lever plunger 31. Therefore, the push lever plunger 31 is stopped at a first position P1 in the circumferential direction. As an example, the first position P1 will be described with reference to a part in which the biasing member 124 is in contact with the push lever plunger 31.

Figure 15:
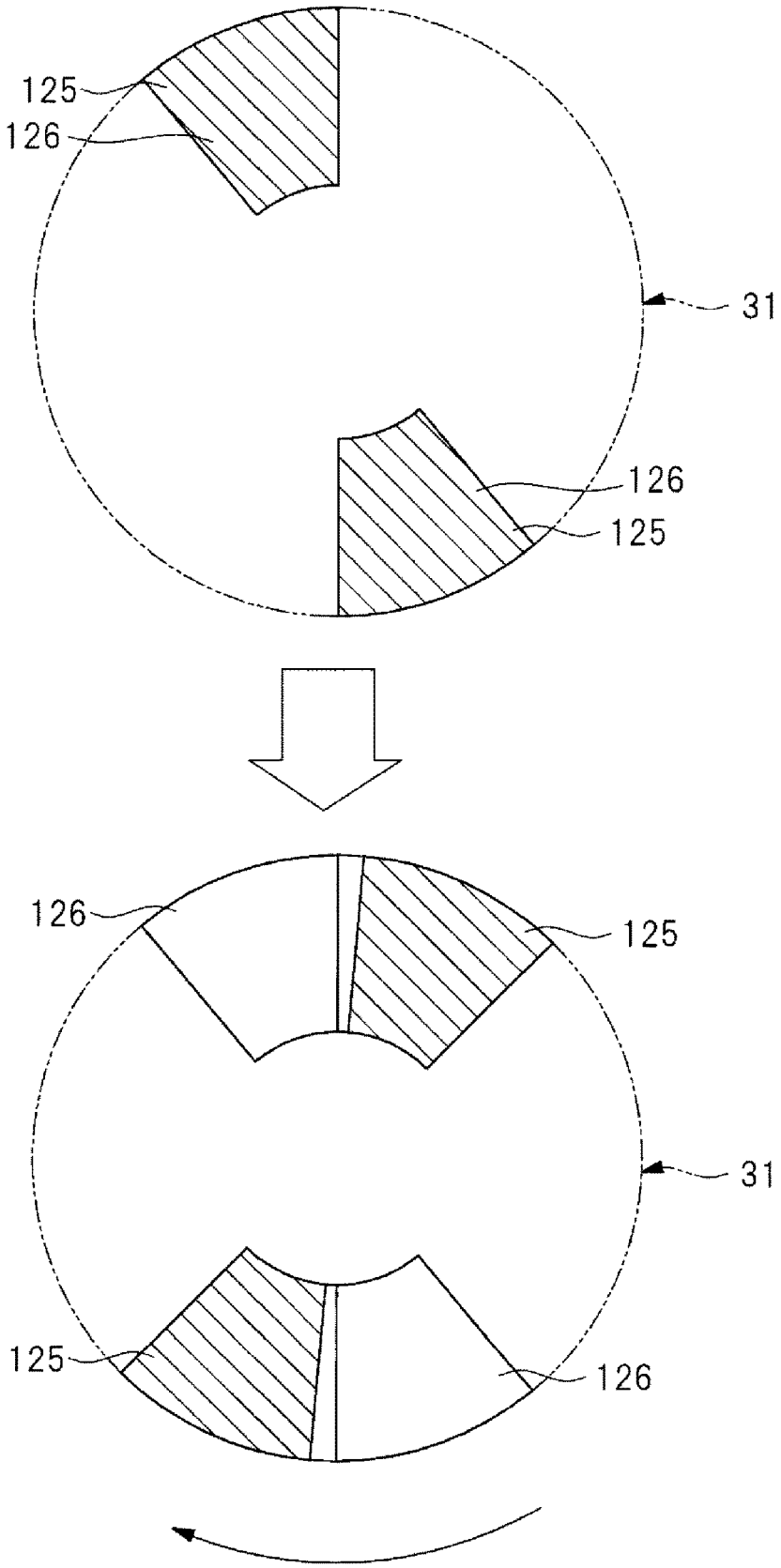
FIG. 15 is a cross-sectional plan view showing a relative position of the contact protrusion provided on the push lever and the block shown in FIG. 11.
Figure 16:
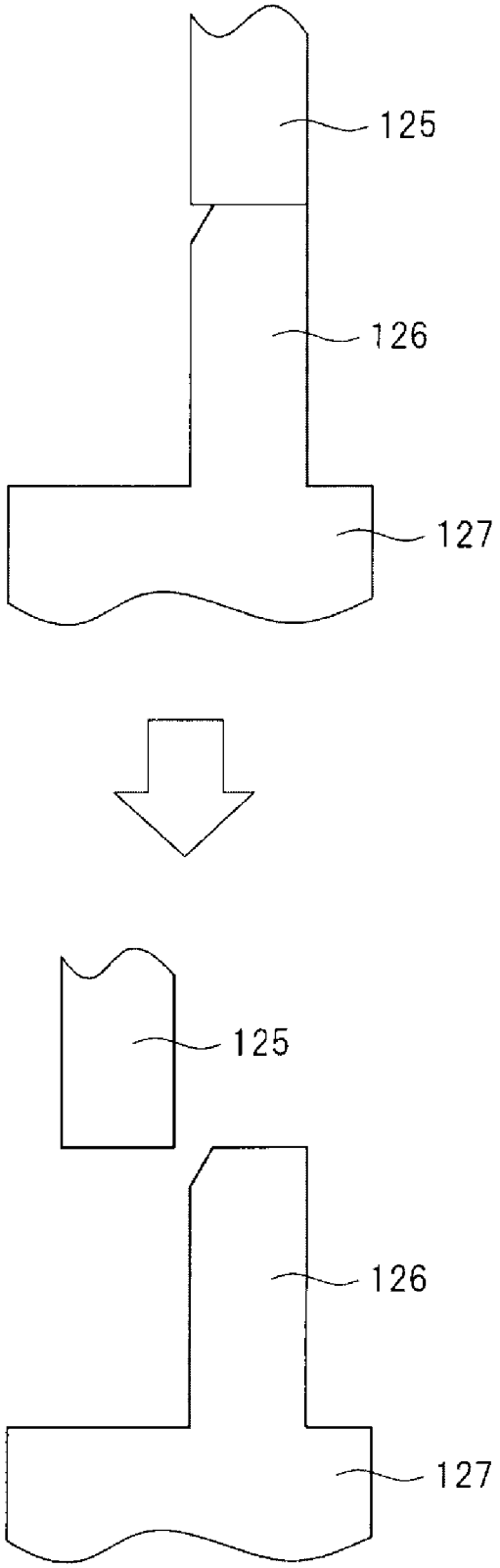
FIG. 16 is a side view showing a relative position of the contact protrusion provided on the push lever and the block shown in FIG. 11.

When the push lever plunger 31 is stopped at the first position P1, as shown in the upper part in FIG. 15, the contact protrusion 125 and the contact protrusion 126 are provided at the same position in the circumferential direction of the push lever plunger 31. In addition, as shown in the upper part in FIG. 16, the contact protrusion 125 and the contact protrusion 126 come in contact with each other.

As shown in FIG. 11, when the operator applies an operating force to the trigger 41 in a state in which the trigger 41 is turned off and the push lever 13 is turned off, the trigger valve 20 is switched from off to on. When the trigger valve 20 is switched from off to on, compressed air in the accumulation chamber 50A is sent to the trigger valve chamber 20A, the pressure chamber 30A, the control flow path 10C, and the passages 132 and 135.

Air sent to the passage 135 gradually flows into the air chamber 142 via the passage 143 and a pressure in the air chamber 142 increases. Due to a pressure in the air chamber 142, a biasing force in the direction opposite to a biasing force of the elastic member 146 is applied to the pin 152. That is, the pin 152 receives a force in the left direction in FIG. 14 due to a pressure in the air chamber 142, that is, a force in the direction away from the push lever plunger 31.

Within a predetermined time from when the trigger valve 20 is switched from off to on, an amount by which the pin 152 moves against a force of the elastic member 146 is smaller than a predetermined value. Therefore, the push lever plunger 31 is stopped at the first position P1 shown in the upper part in FIG. 12 or an angle at which the push lever plunger 31 operates in the circumferential direction from the first position P1 is smaller than a predetermined angle θ1 shown in the lower part in FIG. 12. Therefore, a position of the contact protrusion 125 and a position of the contact protrusion 126 in the circumferential direction of the push lever plunger 31 overlap at least partially as shown in the upper part in FIG. 15.

Actions of the restriction mechanism 154 when the push lever 13 is pressed against the material to be driven 81 within a predetermined time from when the operator switches the trigger valve 20 from off to on will be described. A movement force of the push lever 13 is transmitted to the push lever plunger 31 via the contact protrusion 126 and the contact protrusion 125.

Figure 17:
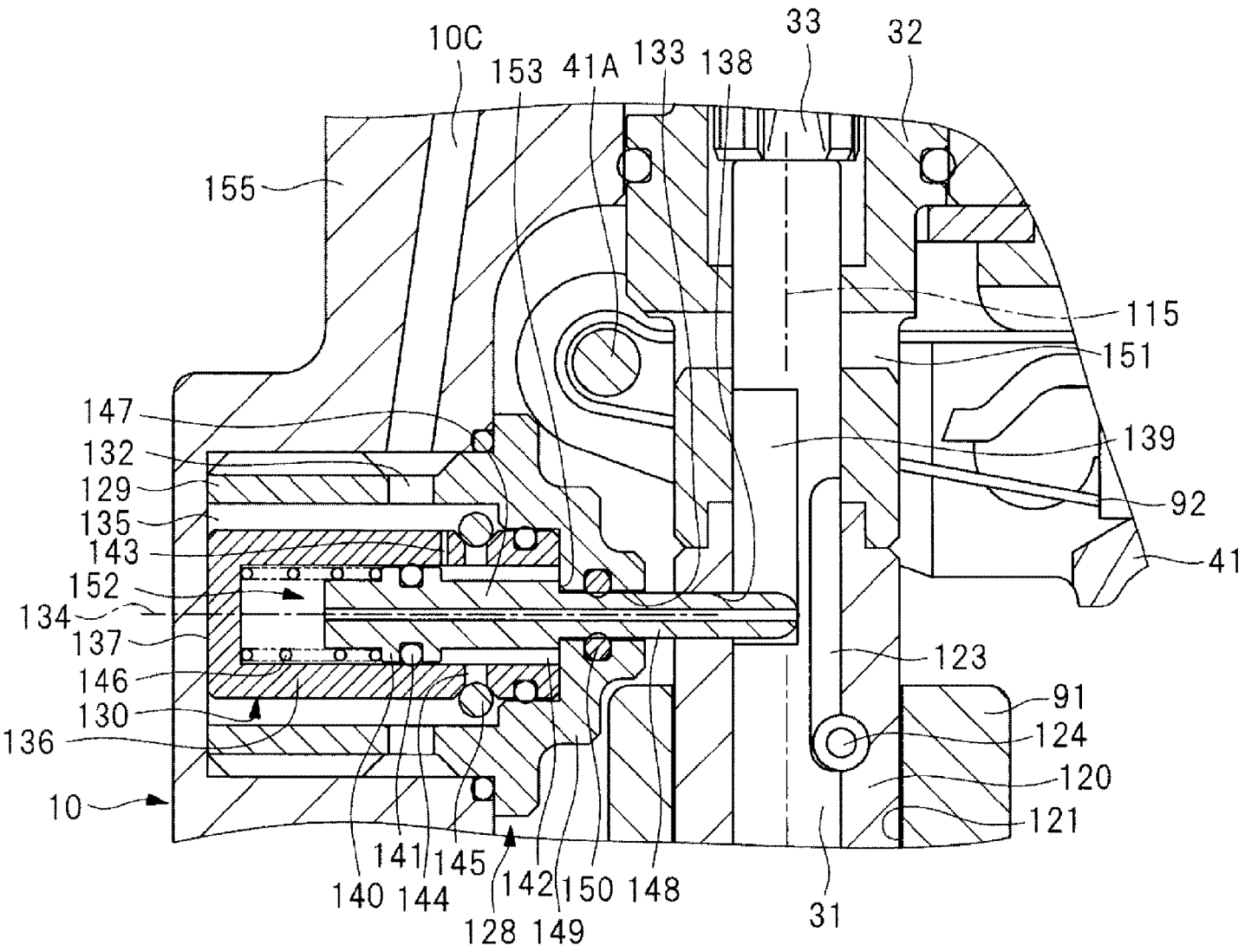
FIG. 17 shows Specific Example 2 of the restriction mechanism used in the drive-in machine in FIG. 1 and is a cross-sectional view of main parts in which the push lever is in an on state.
Figure 18:
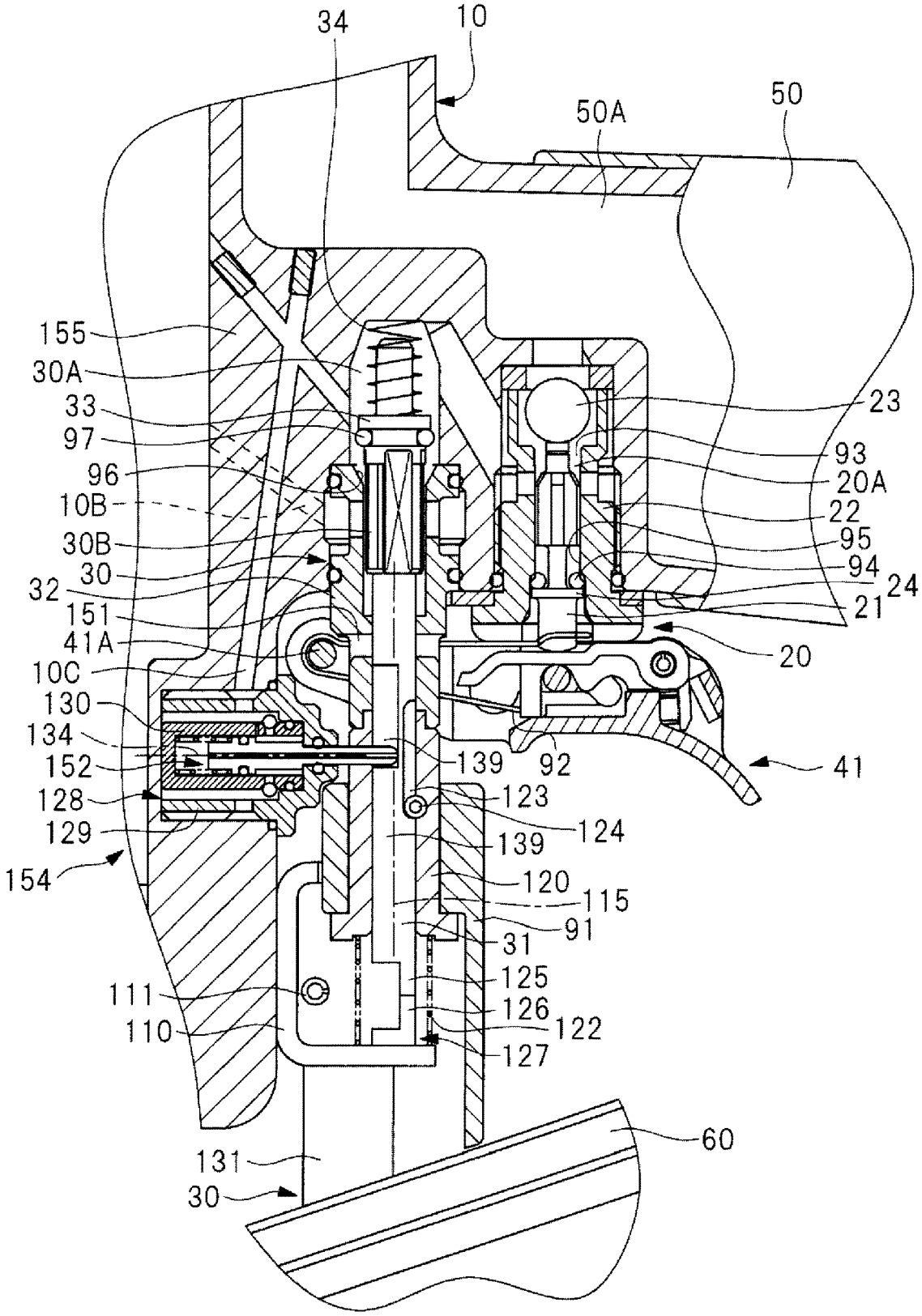

Then, the push lever plunger 31 shown in FIG. 11 moves upward along the axis 115. The small-diameter portion 148 of the pin 152 slides in the groove 139. Then, the push lever plunger 31 blocks the exhaust passage 151 and the push lever valve chamber 30B, and the push lever plunger 31 is then pressed against the valve member 33. Then, due to a movement force of the push lever plunger 31, the valve member 33 moves upward along the axis 115 as shown in FIG. 17, and the push lever valve 30 is turned on as shown in FIG. 18, that is, the push lever valve 30 is opened. Therefore, compressed air is sent to the drive flow path 10B via the pressure chamber 30A and the push lever valve chamber 30B. Therefore, in the drive-in machine 100 shown in FIG. 1, the striking portion 16 performs a driving operation.

In addition, when compressed air flows into the push lever valve chamber 30B from the pressure chamber 30A, compressed air in the passage 135 flows into the pressure chamber 30A via the passage 132 and the control flow path 10C, and a pressure in the passage 135 decreases. When a pressure in the passage 135 decreases, the check valve 145 is opened, and compressed air in the air chamber 142 is discharged to the passage 135 via the passage 144. Therefore, a pressure in the air chamber 142 decreases, the pin 152 moves due to a biasing force of the elastic member 146, and the pin 152 is stopped at the initial position.

After the striking portion 16 performs a driving operation, when the operator keeps the trigger 41 in an on state and separates the push lever 13 from the material to be driven 81, the push lever 13 moves downward in FIG. 18 due to a biasing force of the elastic member 122 and the push lever plunger 31 opens the exhaust passage 151. Therefore, compressed air in the drive flow path 10B is discharged to the outside of the main housing 10 via the push lever valve chamber 30B and the exhaust passage 151. In addition, when the hook 110 is engaged with the stopper 111, the push lever 13 is stopped at the initial position.

On the other hand, when the push lever plunger 31 moves downward in FIG. 18, the valve member 33 moves downward due to a biasing force of the spring 34, and as shown in FIG. 11, the sealing member 97 comes in contact with the valve body 32, and the valve member 33 is stopped. That is, the push lever valve 30 is turned off, that is, in a closed state.

Figure 19:
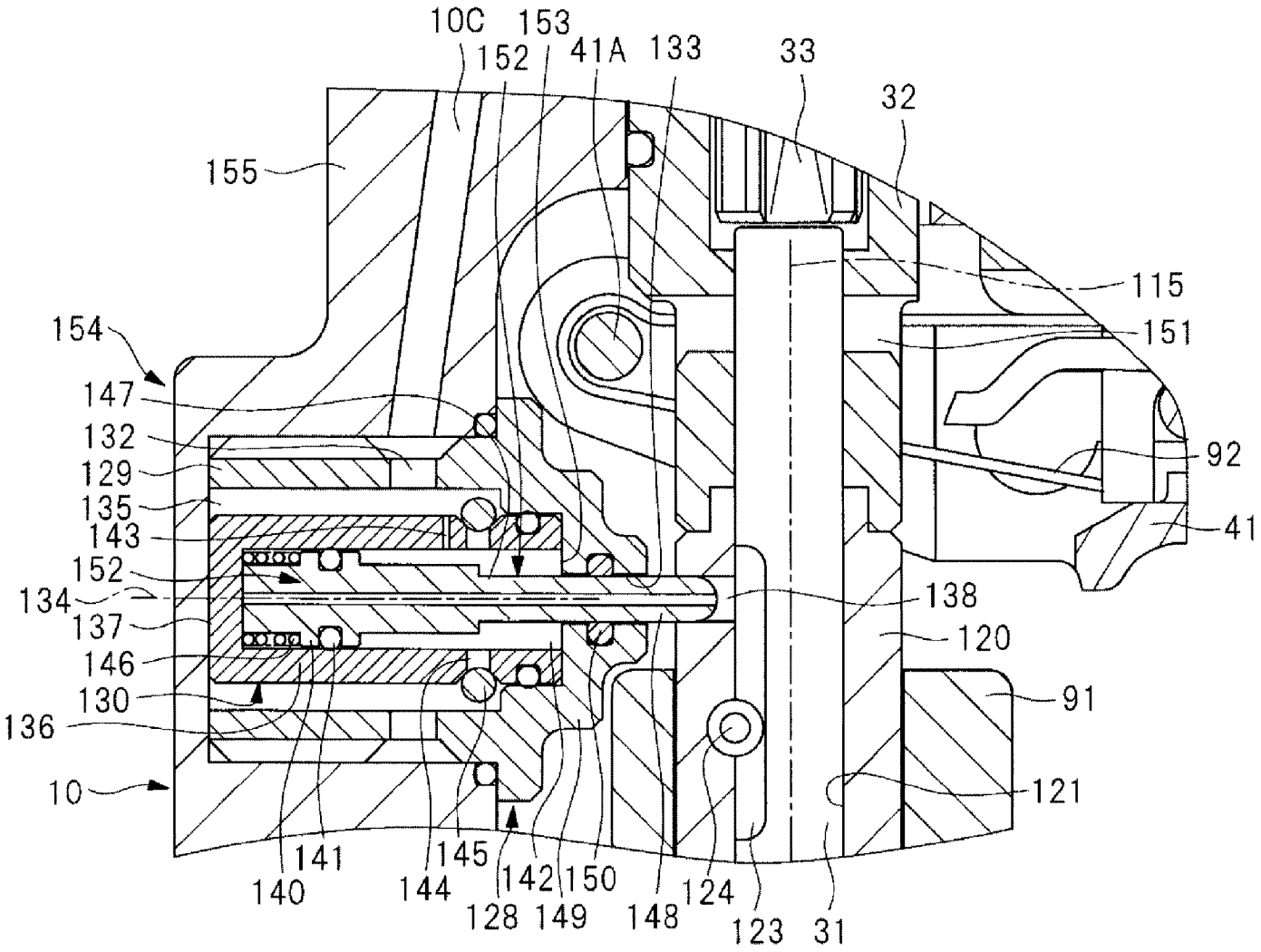
FIG. 19 shows Specific Example 2 of the restriction mechanism used in the drive-in machine in FIG. 1 and is a cross-sectional view of main parts in which the push lever is in an off state.

Next, a case in which a predetermined time has elapsed from when the operator switches the trigger 41 from off to on will be described. In this case, a pressure in the air chamber 142 further increases, and an amount by which the pin 152 moves to the left side from the initial position in FIG. 12 exceeds a predetermined value. Then, the pin 152 comes in contact with the wall 137 and is stopped as shown in FIG. 19.

While an amount by which the pin 152 moves is less than a predetermined amount, the push lever plunger 31 is biased clockwise from the biasing member 124 as shown in FIG. 12. Therefore, an angle at which the push lever plunger 31 moves in the circumferential direction increases. Then, when an amount by which the pin 152 moves exceeds a predetermined value, the push lever plunger 31 is stopped at a second position P2 shown in the lower part in FIG. 12. In this manner, the push lever plunger 31 moves from the first position P1 in the circumferential direction by a predetermined angle θ1 and is stopped at the second position P2. The predetermined angle θ1 is, for example, 45 degrees.

While the push lever plunger 31 moves from the first position P1 to the second position P2 as shown in FIG. 12, relative positions of the contact protrusion 125 and the contact protrusion 126 shown in FIG. 15 change in the circumferential direction of the push lever plunger 31. Then, when the push lever plunger 31 is stopped at the second position P2 shown in the lower part in FIG. 12, the contact protrusion 125 and the contact protrusion 126 do not overlap in the circumferential direction of the push lever plunger 31 as shown in the lower part in FIG. 15 and the lower part in FIG. 16.

Therefore, after a predetermined time has elapsed from when the operator switches the trigger 41 from off to on, even if the push lever 13 is pressed against the material to be driven 81 and the push lever 13 moves upward in FIG. 11 against a force of the elastic member 122, the contact protrusion 126 does not come in contact with the push lever plunger 31 and the contact protrusion 125 does not come in contact with the block 127. Therefore, a movement force of the push lever 13 is not transmitted to the push lever plunger 31.

Figure 20:
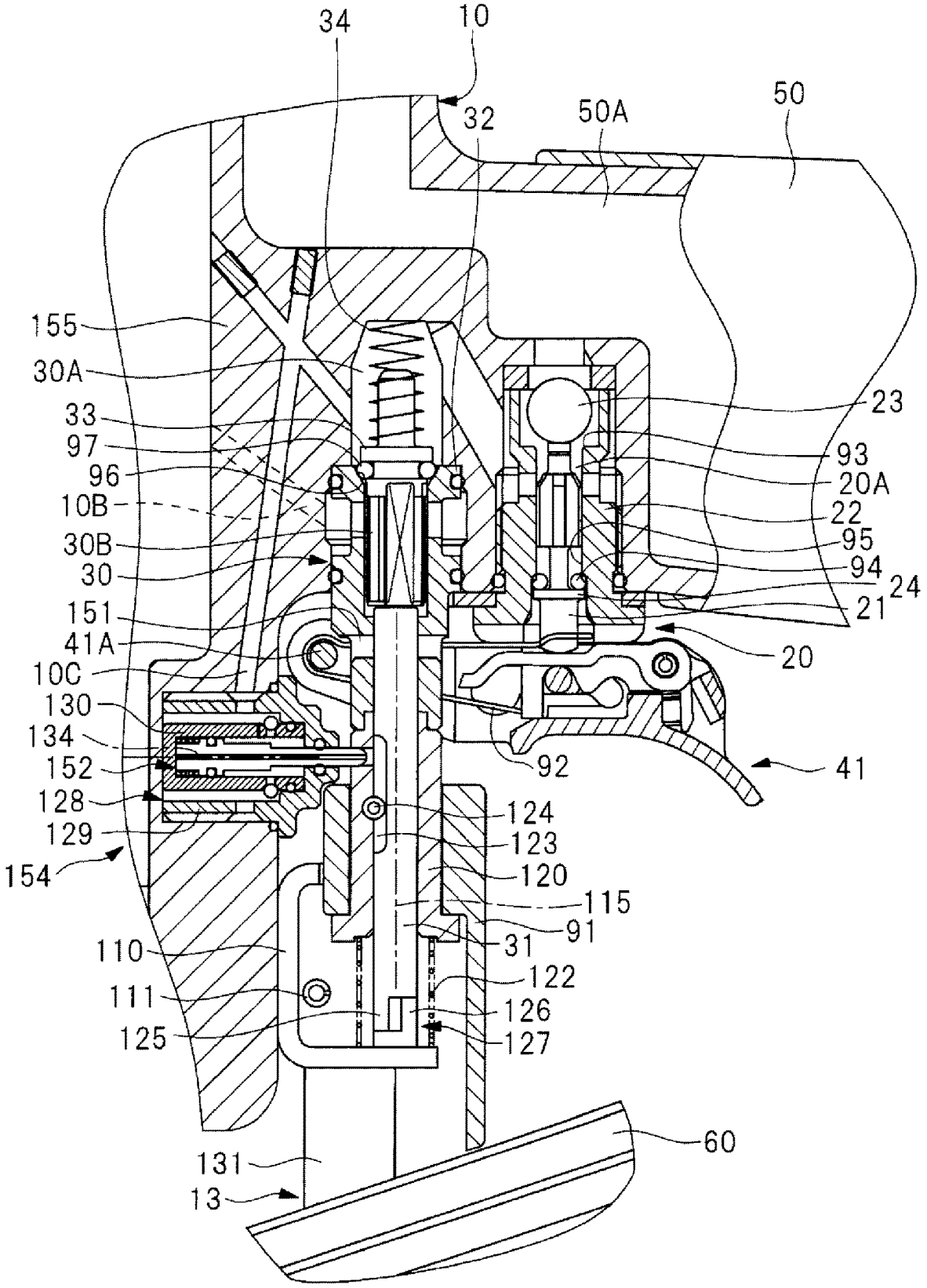
FIG. 20 shows Specific Example 2 of the trigger valve, the push lever valve, and the restriction mechanism used in the drive-in machine in FIG. 1 and is a cross-sectional view of a state in which the trigger valve is turned on and the push lever valve is turned off.

Then, when movement of the push lever plunger 31 continues, the contact protrusion 126 comes in contact with the push lever plunger 31 and the contact protrusion 125 comes in contact with the block 127, a movement force of the push lever 13 is transmitted to the push lever plunger 31. Then, the push lever plunger 31 moves upward along the axis 115. Then, when a compression limit of the elastic member 122 reaches, the push lever plunger 31 is stopped as shown in FIG. 19 and FIG. 20. During a time from when moving the push lever plunger 31 upward along the axis 115 starts until it is stopped, a movement force of the push lever plunger 31 is not transmitted to the valve member 33. Therefore, the push lever valve 30 is turned off, that is, remains in a closed state. Therefore, no compressed air in the pressure chamber 30A is sent to the drive flow path 10B, and the striking portion 16 does not perform a driving operation.

Then, when the push lever 13 is separated from the material to be driven 81, the push lever 13 moves downward in FIG. 17 due to a biasing force of the elastic member 122 and the push lever plunger 31 opens the exhaust passage 151. In addition, the push lever 13 is stopped when the hook 110 is engaged with the stopper 111.

In this manner, in a state in which the trigger valve 20 is turned off and the push lever valve 30 is turned off, when the push lever 13 is pressed against the material to be driven 81 within a predetermined time from when the trigger valve 20 is switched from off to on, the restriction mechanism 154 allows the push lever valve 30 to switch from off to on, and the striking portion 16 performs a driving operation.

On the other hand, in a state in which the trigger valve 20 is turned off and the push lever valve 30 is turned off, when the push lever 13 is pressed against the material to be driven 81 after a predetermined time has elapsed from when the trigger valve 20 is switched from off to on, the restriction mechanism 154 restricts switching of the push lever valve 30 from off to on, and the striking portion 16 does not perform a driving operation.

In addition, operations and actions in which the restriction mechanism 154 releases restriction on the push lever valve 30 will be described. When the restriction mechanism 154 restricts switching of the push lever valve 30 from off to on, if the operator releases an operating force on the trigger 41, the trigger valve 20 is switched from on to off. Then, compressed air in the pressure chamber 30A is discharged to the outside of the main housing 10 via the trigger valve chamber 20A and the shaft hole 95, and a pressure in the pressure chamber 30A decreases.

The check valve 145 is opened as a pressure in the pressure chamber 30A decreases, and compressed air in the air chamber 142 flows into the pressure chamber 30A via the passage 144, the passage 135, the passage 132, and the control flow path 10C, and a pressure in the air chamber 142 decreases. Therefore, the pin 152 moves toward the push lever plunger 31 in FIG. 19 due to a biasing force of the elastic member 146. Then, a counterclockwise rotational force is applied from the pin 152 to the push lever plunger 31 in the lower part in FIG. 12.

Therefore, the push lever plunger 31 moves counterclockwise in the lower part in FIG. 12 against a biasing force of the biasing member 124 and returns to the first position P1 shown in the upper part in FIG. 12 and is stopped. As a result, in the circumferential direction of the push lever plunger 31, relative positions of the contact protrusion 125 and the contact protrusion 126 are in a state shown in the upper part in FIG. 15. Therefore, the restriction mechanism 154 releases restriction on the push lever valve 30. That is, when the push lever 13 is pressed against the material to be driven 81, a movement force of the push lever 13 is transmitted to the valve member 33 via the push lever plunger 31, and the push lever valve 30 can be switched from off to on.

In Specific Example 2 of the restriction mechanism 154, a predetermined time and an operation speed when the pin 152 is separated from the wall 137 due to a biasing force of the elastic member 146 are determined according to the opening area of the passage 143 and a spring constant of the elastic member 146. Specifically, as the opening area of the passage 143 becomes wider, a predetermined time becomes shorter and an operation speed of the pin 152 becomes faster. In addition, as the spring constant of the elastic member 146 becomes larger, a predetermined time becomes shorter, and the operation speed of the pin 152 becomes faster.

Specific Example 3

Figure 21:
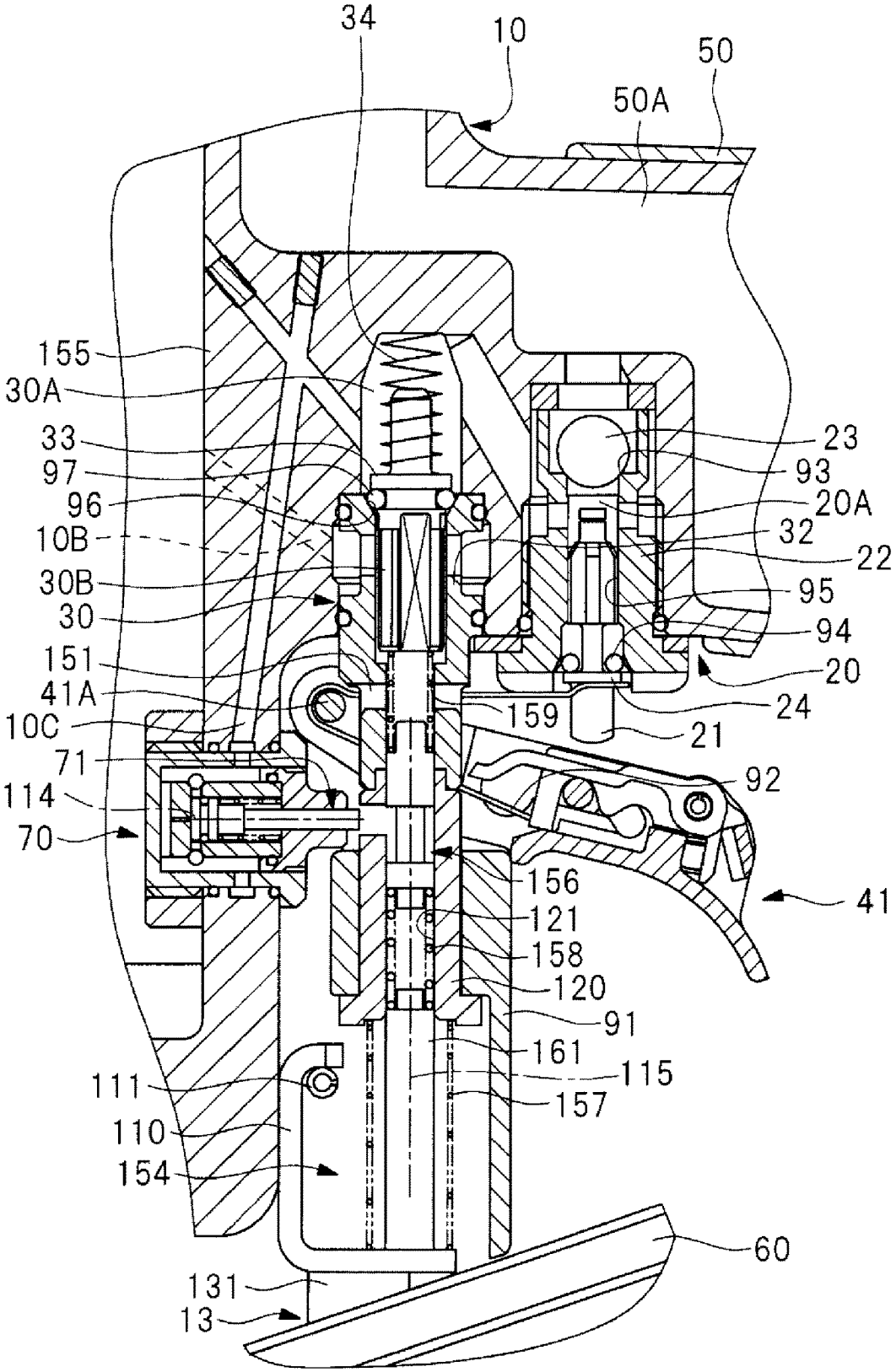
FIG. 21 shows Specific Example 3 of the trigger valve, the push lever valve, and the restriction mechanism used in the drive-in machine in FIG. 1 and is a cross-sectional view of a state in which the trigger valve and the push lever valve are both turned off.
Figure 22:
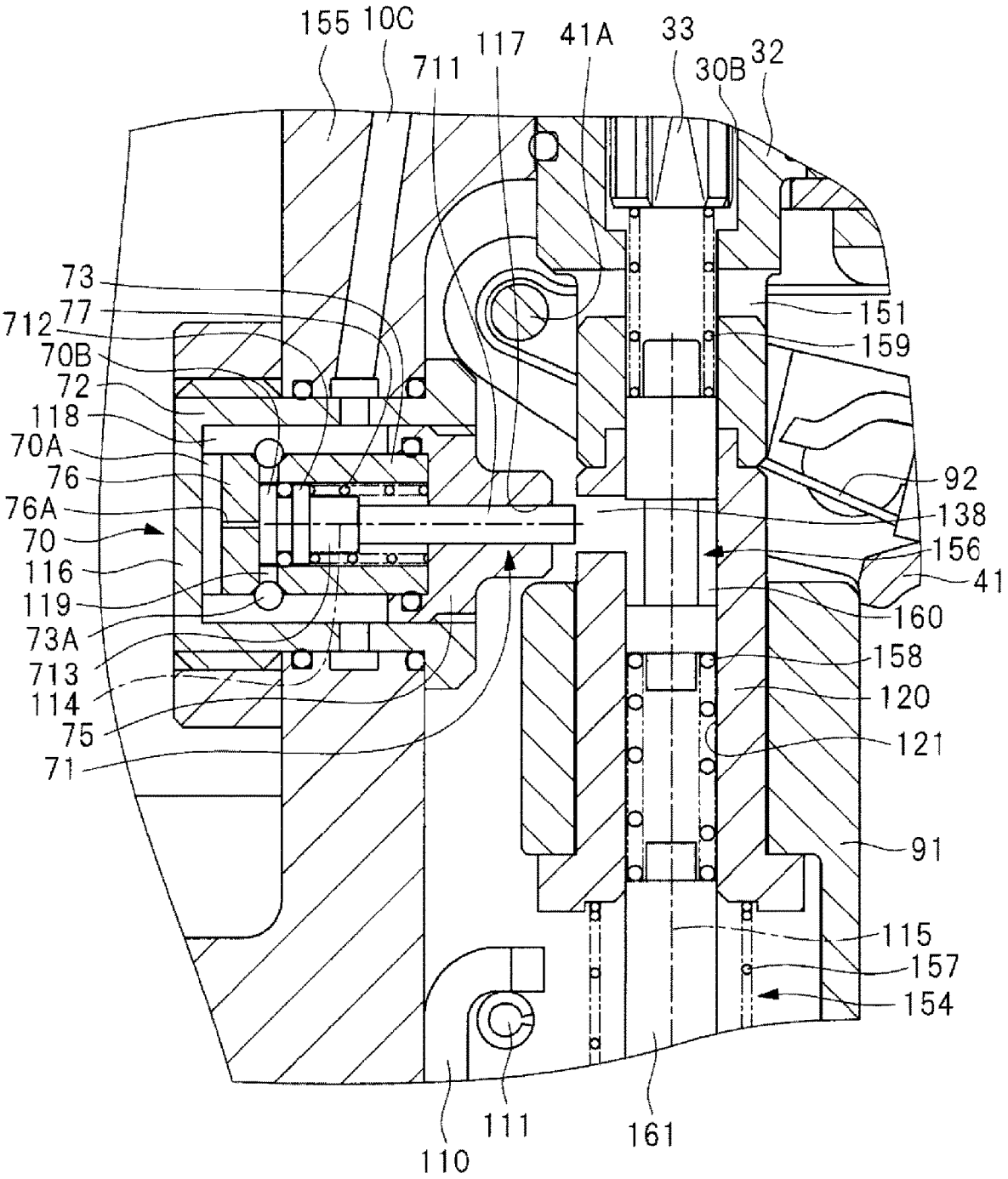
FIG. 22 is an enlarged cross-sectional view showing main parts in FIG. 21.

Specific Example 3 of the restriction mechanism 154 that can be provided in the drive-in machine 100 in FIG. 1 is shown in FIG. 21 and FIG. 22. The restriction mechanism 154 has the pin drive unit 70, a first plunger 161, a second plunger 156, and elastic members 157, 158, and 159. The configuration of the pin drive unit 70 is the same as the configuration of the pin drive unit 70 shown in FIG. 3A, FIG. 3B, FIG. 3C, and FIG. 3D.

The first plunger 161 is fixed to the push lever 13. The second plunger 156 is disposed between the first plunger 161 and the valve member 33 in the direction of the axis 115. The first plunger 161 and the second plunger 156 are both disposed concentrically around the axis 115. A part of the first plunger 161 is disposed in the shaft hole 121, and the first plunger 161 is movable in the shaft hole 121 in the direction of the axis 115. The second plunger 156 is disposed in the shaft hole 121 and the valve body 32, and the second plunger 156 is movable in the direction of the axis 115.

The elastic member 157 is disposed between the push lever 13 and the plunger guide 120. The elastic member 157 is, for example, a compression spring made of a metal, and the elastic member 157 biases the push lever 13 downward in FIG. 21. The elastic member 158 is disposed between the first plunger 161 and the second plunger 156. The elastic member 158 is, for example, a compression spring made of a metal, and both ends of the elastic member 158 in the direction of the axis 115 come in contact with the first plunger 161 and the second plunger 156. The elastic member 159 is, for example, a compression spring made of a metal, and both ends of the elastic member 159 in the direction of the axis 115 come in contact with the second plunger 156 and the valve member 33.

The second plunger 156 has an annular engagement groove 160. When the shaft hole 138 that penetrates through the plunger guide 120 in the radial direction is provided, and the pin 71 moves in the direction of the axis 114, the tip 711 can enter and exit the shaft hole 121 of the plunger guide 120 via the shaft hole 138.

Actions of Specific Example 3 of the restriction mechanism 154 will be described. As shown in FIG. 21, a case in which the operator does not apply an operating force to the trigger 41 and the push lever 13 is separated from the material to be driven 81 shown in FIG. 1 will be described. When the operator does not apply an operating force to the trigger 41, the trigger valve 20 is turned off, that is, in a closed state. When the trigger valve 20 is turned off, no compressed air is sent to the second air chamber 70B of the pin drive unit 70 shown in FIG. 22. The pin 71 is pressed against the wall 76 due to a biasing force of the spring 77 and stopped at the initial position. When the pin 71 is stopped at the initial position, the tip 711 is positioned outside the engagement groove 160 as shown in FIG. 22.

In addition, when the push lever 13 is separated from the material to be driven 81, the push lever 13 is stopped at the initial position. Therefore, no movement force is transmitted from the push lever 13 to the first plunger 161 and the second plunger 156, and the second plunger 156 is stopped at the initial position. When the second plunger 156 is stopped at the initial position, a biasing force applied from the second plunger 156 to the valve member 33 has a minimum value. Therefore, the valve member 33 biased by the spring 34 is stopped when the sealing member 97 is pressed against the valve body 32. Therefore, the push lever valve 30 is turned off, that is, in a closed state.

In addition, the second plunger 156 connects the push lever valve chamber 30B and the exhaust passage 151. Therefore, compressed air in the drive flow path 10B is discharged to the outside of the main housing 10 via the push lever valve chamber 30B and the exhaust passage 151.

In a state in which the trigger valve 20 is turned off and the push lever valve 30 is turned off, when the operator applies an operating force to the trigger 41, the trigger valve 20 is switched from off to on. When the trigger valve 20 is switched from off to on, compressed air in the accumulation chamber 50A flows into the second air chamber 70B via the trigger valve chamber 20A, the pressure chamber 30A, the control flow path 10C, the passage 118, the first air chamber 70A, and the small hole 76A. Then, a pressure in the second air chamber 70B gradually increases.

From when the trigger valve 20 is switched from off to on, compressed air in the accumulation chamber 50A flows into the second air chamber 70B via the trigger valve chamber 20A, the pressure chamber 30A, the control flow path 10C, the passage 118, and the small hole 76A, and a pressure in the second air chamber 70B increases. Therefore, the pin 71 moves in the direction of the axis 114 toward the second plunger 156 against a biasing force of the spring 77.

Within a predetermined time from when the trigger valve 20 is switched from off to on, an amount by which the pin 71 moves from the initial position toward the second plunger 156 is smaller than a predetermined value, and the tip 711 does not enter the engagement groove 160.

Within a predetermined time from when the trigger valve 20 is switched from off to on, when the push lever 13 is pressed against the material to be driven 81 shown in FIG. 1, the first plunger 161 moves upward along the axis 115 in FIG. 21 against a biasing force of the elastic member 157. Then, a movement force of the first plunger 161 is transmitted to the second plunger 156 via the elastic member 158, and the second plunger 156 moves upward along the axis 115 in FIG. 23 and FIG. 24. Therefore, the second plunger 156 blocks the exhaust passage 151 and the push lever valve chamber 30B. In addition, a movement force of the second plunger 156 is transmitted to the valve member 33 via the elastic member 159. As a result, the valve member 33 moves upward as shown in FIG. 23, and the push lever valve 30 is turned on, that is, in an open state.

In this manner, when the trigger valve 20 is turned on and the push lever valve 30 is turned on, compressed air in the accumulation chamber 50A is sent to the drive flow path 10B via the trigger valve chamber 20A and the push lever valve chamber 30B. Therefore, the striking portion 16 performs a driving operation.

As the push lever valve 30 is switched from off to on, compressed air in the passage 118 flows into the pressure chamber 30A from the control flow path 10C, and a pressure in the passage 118 decreases. When a pressure in the passage 118 decreases, the check valve 73A is opened, and compressed air in the second air chamber 70B is discharged to the passage 118, and a pressure in the second air chamber 70B decreases. Then, the pin 71 moves away from the second plunger 156 due to a biasing force of the spring 77 and returns to the initial position and is stopped. In addition, the check valve 73A is closed.

Figure 23:
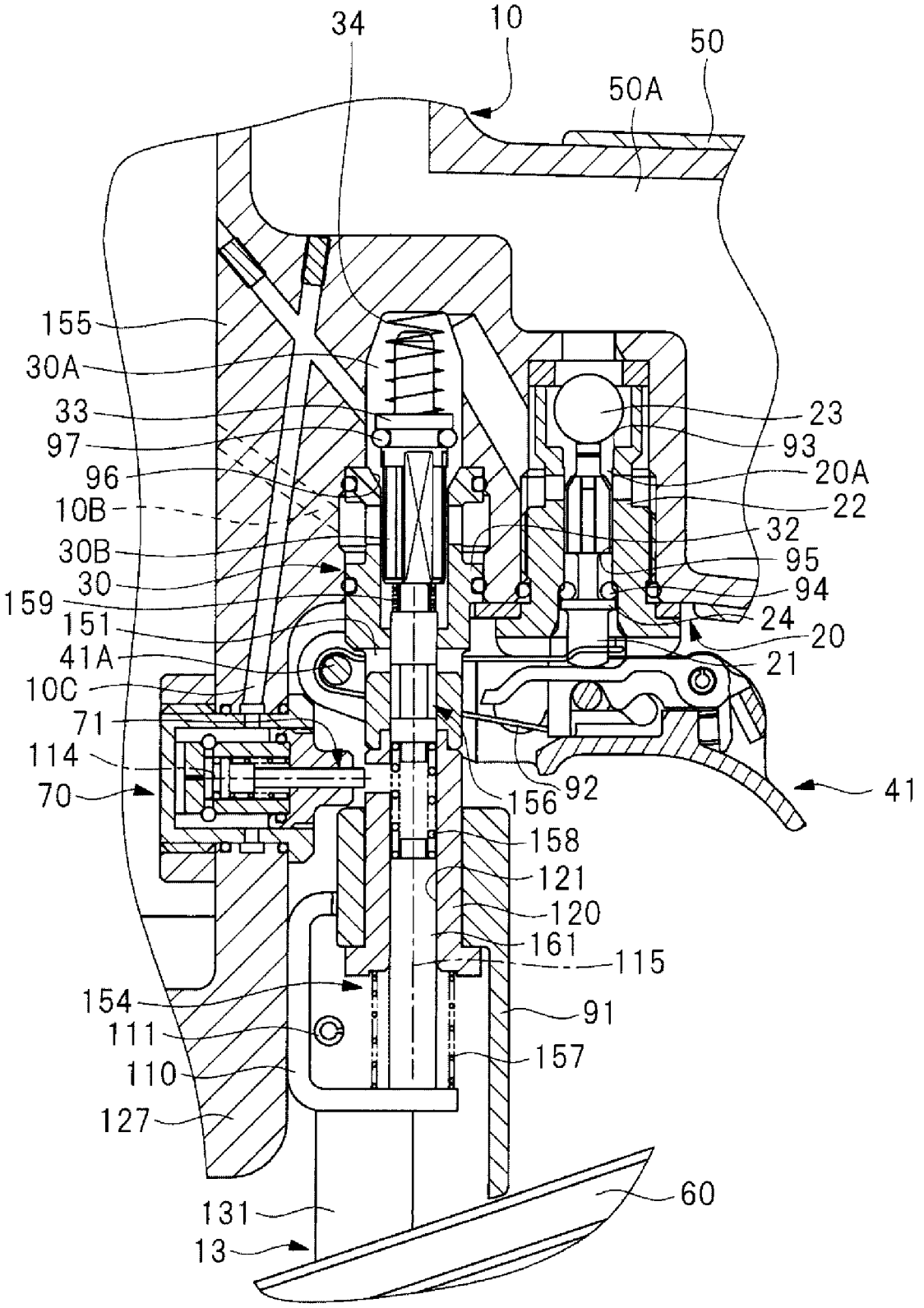
Figure 24:
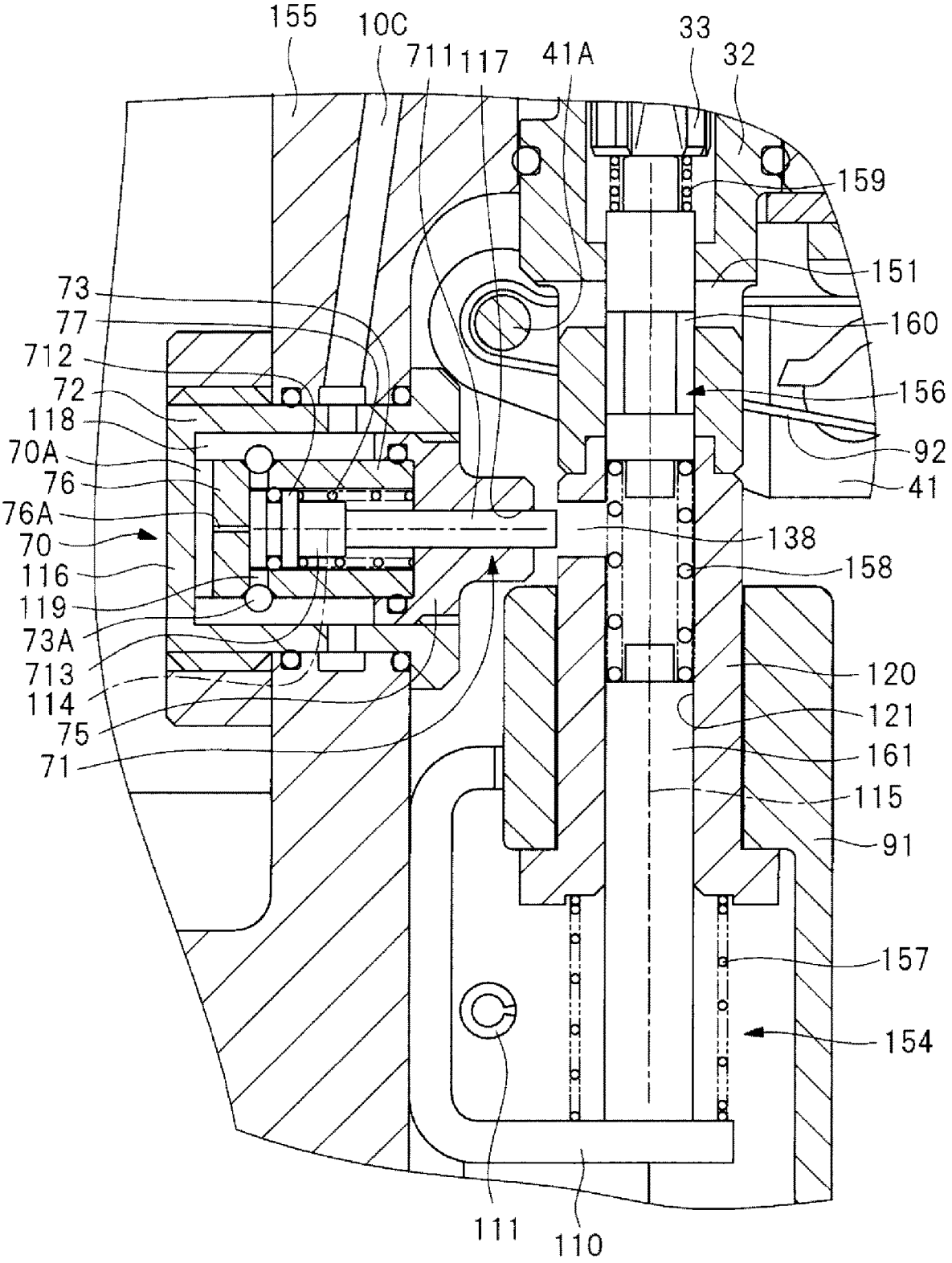
FIG. 24 is an enlarged cross-sectional view showing main parts in FIG. 23.

After the striking portion 16 performs a driving operation, when the operator moves the push lever 13 away from the material to be driven 81 shown in FIG. 1, the push lever 13 moves downward in FIG. 23 due to a biasing force of the elastic member 157, and when the hook 110 is engaged with the stopper 111, the push lever 13 is stopped at the initial position.

In addition, the second plunger 156 moves downward in FIG. 23 due to a biasing force of the elastic member 159, and connects the push lever valve chamber 30B and the exhaust passage 151, and is then stopped at the initial position shown in FIG. 22. In addition, the valve member 33 moves downward in FIG. 23 due to a biasing force of the spring 34, and as shown in FIG. 21, the push lever valve 30 is turned off, that is, in a closed state.

Figure 26:
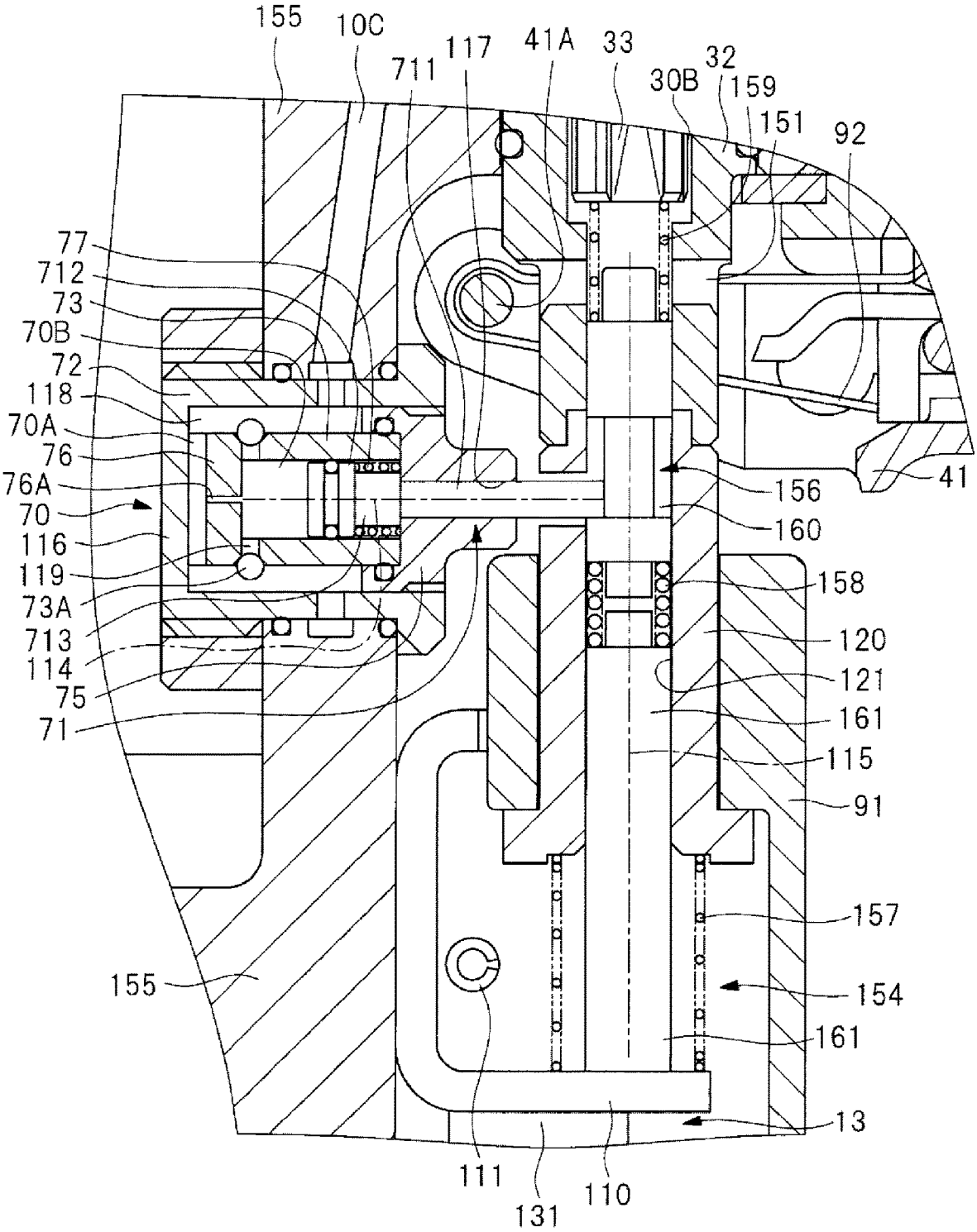
FIG. 26 is an enlarged cross-sectional view showing main parts in FIG. 25.

On the other hand, when a predetermined time has elapsed from when the trigger valve 20 is switched from off to on, the tip 711 of the pin 71 enters the shaft hole 121 of the plunger guide 120 via the shaft hole 138, and is stopped at the restriction position as shown in FIG. 26. That is, the tip 711 enters the engagement groove 160.

After a predetermined time has elapsed from when the trigger valve 20 is switched from off to on, the operator presses the push lever 13 against the material to be driven 81 shown in FIG. 1, and when the second plunger 156 shown in FIG. 26 moves upward in the direction of the axis 115, the pin 71 is engaged with the second plunger 156, and the second plunger 156 is prevented from moving upward in FIG. 26. Then, a biasing force transmitted from the second plunger 156 to the valve member 33 via the elastic member 159 is less than a predetermined value. Therefore, the valve member 33 does not move upward in FIG. 25, and the push lever valve 30 is turned off, that is, remains in a closed state. Therefore, the striking portion 16 does not perform a driving operation.

In this manner, in a state in which the trigger valve 20 is turned off and the push lever valve 30 is turned off, when the push lever 13 is pressed against the material to be driven 81 within a predetermined time from when the trigger valve 20 is switched from off to on, the restriction mechanism 154 allows the push lever valve 30 to be switched from off to on, and the striking portion 16 performs a driving operation.

On the other hand, in a state in which the trigger valve 20 is turned off and the push lever valve 30 is turned off, after a predetermined time has elapsed from when the trigger valve 20 is switched from off to on, when the push lever 13 is pressed against the material to be driven 81, the restriction mechanism 154 restricts switching of the push lever valve 30 from off to on, and the striking portion 16 does not perform a driving operation.

Figure 25:
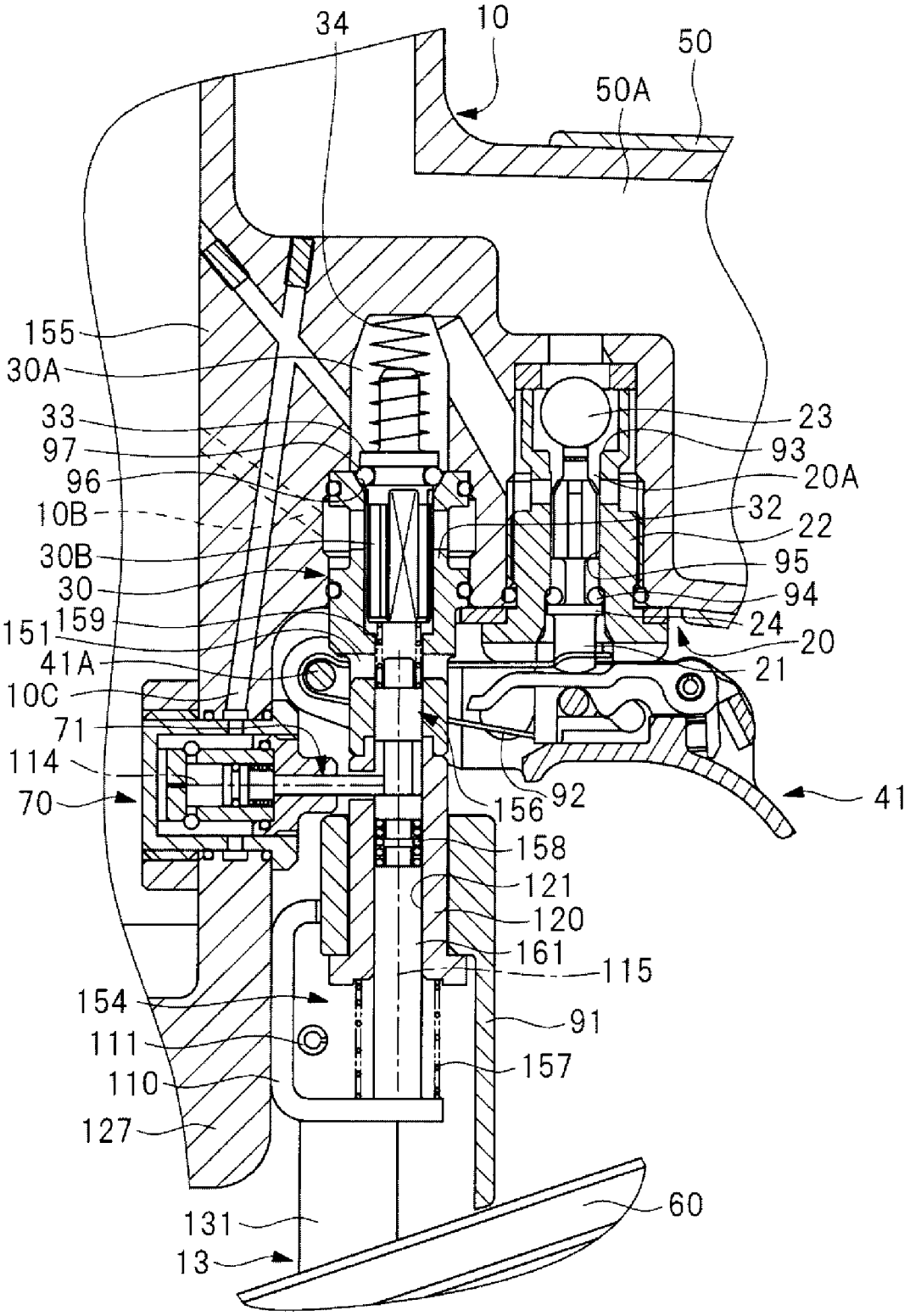
FIG. 25 shows Specific Example 3 of the trigger valve, the push lever valve, and the restriction mechanism used in the drive-in machine in FIG. 1 and is a cross-sectional view of a state in which the trigger valve is turned on and an operation of the push lever valve is restricted.

In addition, as shown in FIG. 25, operations and actions in which the restriction mechanism 154 releases restriction on the push lever valve 30 will be described. If the operator releases an operating force on the trigger 41 when the restriction mechanism 154 restricts switching of the push lever valve 30 from off to on, the trigger valve 20 is switched from on to off. Then, compressed air in the pressure chamber 30A is discharged to the outside of the main housing 10 via the trigger valve chamber 20A and the shaft hole 95, and a pressure in the pressure chamber 30A decreases.

The check valve 73A is opened as a pressure in the pressure chamber 30A decreases, and compressed air in the second air chamber 70B flows into the pressure chamber 30A via the passage 119, the passage 118, and the control flow path 10C, and a pressure in the second air chamber 70B decreases. Therefore, the pin 71 moves away from the push lever plunger 31 in FIG. 25 and FIG. 26 due to a biasing force of the spring 77. Then, the tip 711 exits the shaft hole 138 as shown in FIG. 22. Therefore, the restriction mechanism 154 releases restriction on the push lever valve 30. That is, when the push lever 13 is pressed against the material to be driven 81 shown in FIG. 1, a movement force of the push lever 13 is transmitted to the valve member 33 via the first plunger 161 and the second plunger 156, and the push lever valve 30 can be switched from off to on.

Embodiment 2

Next, Embodiment 2 of the drive-in machine will be described with reference to FIG. 27, FIG. 28 and FIG. 29. A drive-in machine 200 shown in FIG. 27 has a main housing 201, a handle 202, a nose 203, a cylinder 204, a striking portion 205, a trigger valve 206, a push lever 207, a trigger 208 and a magazine 209. The main housing 201 is connected to the handle 202, and an accumulation chamber 210 is formed in the main housing 201 and the handle 202. An air hose is attached to or detached from the handle 202, and compressed air is supplied from the air hose into the accumulation chamber 210.

The main housing 201 has a cylindrical shape, and the nose 203 has a cylindrical portion 239 and a flange 240. The flange 240 is provided at an end of the cylindrical portion 239 in the longitudinal direction. The nose 203 is fixed to the flange 240 at a first end 219 of the main housing 201 in the longitudinal direction. An outer cylindrical portion 211 and an inner cylindrical portion 212 are provided on the inner surface of a second end 220 of the main housing 201 in the longitudinal direction. The outer cylindrical portion 211 and the inner cylindrical portion 212 are provided around an axis 213. The longitudinal direction of the main housing 201 is a direction parallel to the axis 213. The axis 213 is the center of the cylinder 204.

The outer cylindrical portion 211 is disposed outside the inner cylindrical portion 212. A movable member 214 is disposed between the outer cylindrical portion 211 and the inner cylindrical portion 212. The movable member 214 is an annular component around the axis 213. A sealing member 215 is provided between the movable member 214 and the outer cylindrical portion 211, and a sealing member 216 is provided between the movable member 214 and the inner cylindrical portion 212. The movable member 214 is disposed between the cylinder 204 and the second end 220 in the direction of the axis 213. The movable member 214 is movable in parallel with the axis 213. A head valve 225 is attached to the movable member 214. The head valve 225 has an annular shape, and is, for example, made of synthetic rubber. The head valve 225 is movable together with the movable member 214 in parallel with the axis 213 of the cylinder 204. The head valve 225 can come in contact with and be separated from an end of the cylinder 204 in the direction of the axis 213.

A head valve chamber 217 is provided between the outer cylindrical portion 211, and the inner cylindrical portion 212 and the movable member 214. A biasing member 224 is disposed in the head valve chamber 217. The biasing member 224 biases the movable member 214 toward the cylinder 204 in the direction along the axis 213. The biasing member 224 is, for example, a compression spring made of a metal. An air passage 218 connected to the head valve chamber 217 is provided in the main housing 201.

A cover 221 is attached to the second end 220, and the cover 221 holds a bumper 222. The bumper 222 is disposed inside the inner cylindrical portion 212 and inside the movable member 214 in the radial direction around the axis 213. The bumper 222 is, for example, a cushion member made of synthetic rubber. An exhaust passage 223 is provided between the bumper 222 and the inner cylindrical portion 212, and between the cover 221 and the second end 220.

The striking portion 205 includes a piston 226, a driver blade 227, and a piston upper chamber 229. The piston 226 is movable in the cylinder 204 in the direction of the axis 213, and the driver blade 227 is fixed to the piston 226. A sealing member 228 is attached to the outer circumferential surface of the piston 226. In the cylinder 204, the piston upper chamber 229 is formed between the piston 226 and the bumper 222. A port 230 is formed between the bumper 222 and the movable member 214. When the movable member 214 moves in the direction of the axis 213, the movable member 214 comes in contact with or is separated from the bumper 222, and the port 230 is opened and closed. When the port 230 is opened, the piston upper chamber 229 and the exhaust passage 223 are connected, and when the port 230 is closed, the piston upper chamber 229 and the exhaust passage 223 are disconnected from each other.

A port 231 is formed between the head valve 225 and an end of the cylinder 204. When the head valve 225 moves in the direction of the axis 213, the head valve 225 comes in contact with and is separated from the cylinder 204, and the port 231 is opened and closed. When the port 231 is opened, the accumulation chamber 210 and the piston upper chamber 229 are connected. When the port 231 is closed, the accumulation chamber 210 and the piston upper chamber 229 are disconnected from each other.

In the cylinder 204, a bumper 232 is provided at an end closest to the nose 203. The bumper 232 is, for example, a cushion member made of synthetic rubber. The bumper 232 has a shaft hole 233. A wall 235 is provided at a part connecting the inner surface of the main housing 201 and the handle 202. The wall 235 holds a holder 236. The holder 236 has an annular shape, and the holder 236 supports the cylinder 204 so that it is movable in the direction of the axis 213. The holder 236 positions the cylinder 204 in the radial direction.

In the cylinder 204, a piston lower chamber 234 is provided between the piston 226 and the bumper 232. A partition wall 241 is provided outside the outer circumferential surface of the cylinder 204. The partition wall 241 is provided over the entire circumference of the cylinder 204. The partition wall 241 is provided between the holder 236 and the bumper 232 in the direction of the axis 213. A sealing member 242 is attached to the outer circumferential surface of the partition wall 241. The sealing member 242 comes in contact with the inner surface of the main housing 201 and the inner surface of the wall 235 for sealing.

A return chamber 237 is provided in the main housing 201. The return chamber 237 is provided between the main housing 201 and the wall 235, and the cylinder 204, and between the partition wall 241 and the first end 219.

A passage 238 that penetrates through the cylinder 204 in the radial direction is provided. The passage 238 connects the piston lower chamber 234 and the return chamber 237. A check valve 243 is provided at the return chamber 237. The check valve 243 allows compressed air in the piston lower chamber 234 to flow into the return chamber 237, and prevents compressed air in the return chamber 237 from flowing into the piston lower chamber 234. In addition, a passage 244 that penetrates through the cylinder 204 in the radial direction is provided. The passage 244 connects the piston lower chamber 234 and the return chamber 237.

A reset chamber 245 is provided between the cylinder 204, and the main housing 201 and the wall 235. The reset chamber 245 is provided between the holder 236 and the partition wall 241 in the direction of the axis 213. A passage 246 that penetrates through the cylinder 204 in the radial direction is provided. The passage 246 connects the piston lower chamber 234 and the reset chamber 245. A check valve 247 is provided at the reset chamber 245. The check valve 247 allows compressed air in the piston lower chamber 234 to flow into the reset chamber 245, and prevents compressed air in the reset chamber 245 from flowing into the piston lower chamber 234.

The cylindrical portion 239 is disposed in the direction of the axis 213, and the cylindrical portion 239 has an injection path 248. The injection path 248 and the shaft hole 233 are disposed concentrically around the axis 213. The driver blade 227 is movable in the shaft hole 233 and the injection path 248 in the direction of the axis 213. The push lever 207 is attached to the cylindrical portion 239 in the direction of the axis 213 in a movable manner.

The nail 80 is housed in the magazine 209. A plurality of nails 80 are connected to each other. The plurality of spirally wound nails 80 are housed in the magazine 209. The magazine 209 has a feed mechanism, and the feed mechanism sends the nail 80 to the injection path 248 one at a time.

Specific Example 4

Figure 30:
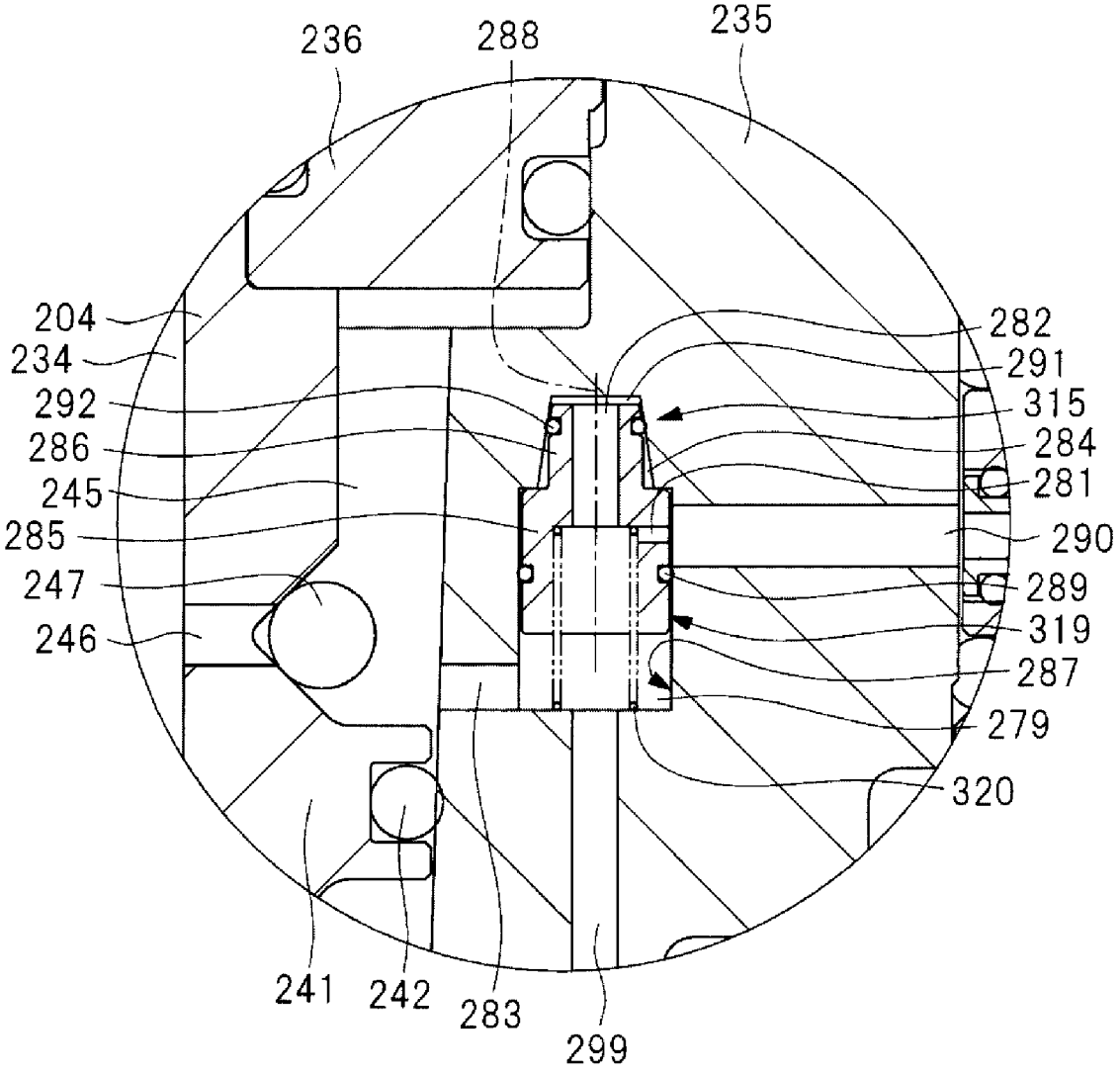
FIG. 30 is an enlarged cross-sectional view of a time-out valve included in Specific Example 4 of the restriction mechanism.
Figure 31:
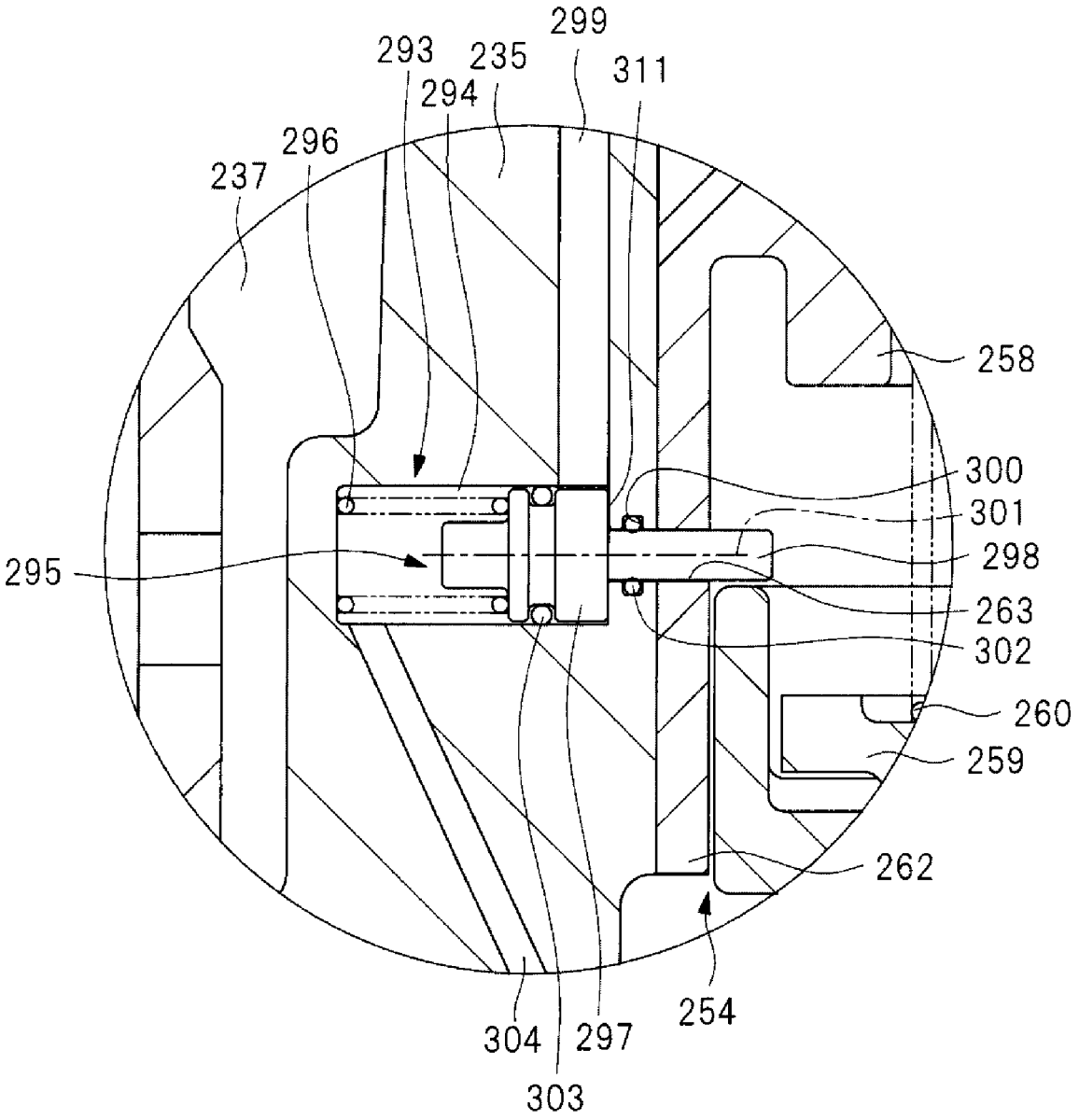
FIG. 31 is an enlarged cross-sectional view of a lock valve included in Specific Example 4 of the restriction mechanism.

Specific Example 4 of the restriction mechanism that restricts an operation of the striking portion 205 will be described with reference to FIG. 29, FIG. 30, and FIG. 31. A restriction mechanism 316 shown in FIG. 29 includes a time-out valve 315, a lock valve 293, and a holder 254. An arm 318 connected to the push lever 207 is provided, and a pin 253 is attached to the arm 318. The pin 253 is movable in the direction of the axis 213 together with the push lever 207. As shown in FIG. 29, the holder 254 is attached to the pin 253. The holder 254 has a cylindrical portion 255, and the holder 254 holds a plunger 256. The pin 253, the holder 254, and the plunger 256 are movable in the direction of an axis 257. The axis 257 is parallel to the axis 213. The nose 203 has a support portion 305.

A cylinder 258 is attached to the plunger 256. The cylinder 258 is movable in the direction of the axis 257 with respect to the plunger 256. The plunger 256 has a disk portion 259, and an elastic member 260 is provided between the disk portion 259 and the cylinder 258. The elastic member 260 is, for example, a compression spring made of a metal. The elastic member 260 generates a biasing force for separating the disk portion 259 and the cylinder 258 in the direction of the axis 257. A stopper 261 is provided on the wall 235, and the cylinder 258 biased by the elastic member 260 is fixed to the wall 235 by the stopper 261. The cylinder 258 has a cylindrical portion 262, and a shaft hole 263 that penetrates through the cylindrical portion 262 in the radial direction is provided. The plunger 256, the holder 254, and the pin 253 biased by the elastic member 260 in the direction of the axis 257 are stopped when the holder 254 comes in contact with the support portion 305.

The trigger 208 is supported so that it is rotatable around a support shaft 249 with respect to the main housing 201. A trigger arm 250 is attached so that it is rotatable around a support shaft 251 with respect to the trigger 208. A biasing member 252 that biases the trigger arm 250 is provided. The biasing member 252 is, for example, a compression spring made of a metal. In FIG. 29, the biasing member 252 biases the trigger arm 250 in a clockwise direction around the support shaft 251.

The configuration of the trigger valve 206 will be described. The trigger valve 206 has a trigger valve guide 264, a plunger guide 265, a valve member 266, and plungers 267 and 268. A recess 269 is provided in the wall 235, and the trigger valve guide 264 is provided in the recess 269. The trigger valve guide 264 has a cylindrical shape around an axis 270. The trigger valve guide 264 does not move in the direction of the axis 270 with respect to the wall 235. In addition, a gap between the trigger valve guide 264 and the inner surface of the wall 235 is sealed with a sealing member 271.

The plunger guide 265 is provided in an interior 272 of the trigger valve guide 264. The plunger guide 265 does not move in the direction of the axis 270 with respect to the trigger valve guide 264. In addition, the plunger guide 265 has a cylindrical shape and has a shaft hole 273. A passage 274 parallel to the axis 270 is provided on the outer circumferential surface of the plunger guide 265. The passage 274 connects the interior 272 and the outside of the main housing 201.

The plunger 267 is disposed inside the shaft hole 273 and outside the main housing 201 and is movable in the direction of the axis 270. An end of the plunger 267 comes in contact with the trigger arm 250. A sealing member 312 is attached to the outer circumferential surface of the plunger 267. The valve member 266 is disposed in the trigger valve guide 264. The valve member 266 is movable in the direction of the axis 270 with respect to the trigger valve guide 264. A passage 275 is formed between the valve member 266 and the trigger valve guide 264. A passage 276 that penetrates through the trigger valve guide 264 in the radial direction is provided, and the passage 276 connects the passage 275 and the air passage 218.

Sealing member 277 is attached to the outer circumferential surface of the valve member 266. When the sealing member 277 is pressed against the inner surface of the trigger valve guide 264, the sealing member 277 blocks the accumulation chamber 210 and the passage 275. When the sealing member 277 is separated from the inner surface of the trigger valve guide 264, the accumulation chamber 210 and the passage 275 are connected.

When a sealing member 314 is pressed against the inner surface of the trigger valve guide 264, the sealing member 314 blocks the passage 276 and the passage 274. When the sealing member 277 is separated from the inner surface of the trigger valve guide 264, the passage 276 and the passage 274 are connected.

The plunger guide 265 has a recess 310, and a part of the plunger 268 in the longitudinal direction is disposed in the recess 310. The plungers 267 and 268 are disposed in series coaxially on the axis 270. In addition, a part of the valve member 266 is disposed in the recess 310. A sealing member 280 is attached to the outer circumferential surface of the valve member 266. The sealing member 280 blocks the inside of the recess 310 and the interior 272. A spring 307 is provided between the plunger 268 and the valve member 266. The spring 307 is, for example, a compression spring made of a metal. The plunger 268 is pressed against a step 306 due to a biasing force of the spring 307. The valve member 266 is biased in a direction away from the step 306 in the direction of the axis 270 due to a biasing force of the spring 307. A sealing member 308 is attached to the outer circumferential surface of the plunger 268. When the sealing member 308 is separated from the valve member 266, the accumulation chamber 210 is connected to a space 309 via the recess 310. When the sealing member 308 comes in contact with the valve member 266, the accumulation chamber 210 and the recess 310 are disconnected from each other.

The recess 310 and the shaft hole 273 are connected, and the space 309 is formed between the plunger 268 and the plunger 267. The step 306 is provided at a part connecting the recess 310 and the shaft hole 273. The step 306 is an end surface perpendicular to the axis 270. In the shaft hole 273, the space 309 is provided between the plunger 267 and the plunger 268. The space 309 is connected to the recess 310.

The time-out valve 315 is provided on the wall 235. As shown in FIG. 30, the time-out valve 315 has a valve member 319, a time-out valve chamber 279, and a spring 320. The time-out valve chamber 279 is connected to the reset chamber 245 via a passage 283. The valve member 319 has a large-diameter portion 285 and a small-diameter portion 286. The valve member 319 has timer passages 281 and 282. The timer passage 281 penetrates through the small-diameter portion 286 in the radial direction, and the timer passage 281 is connected to the time-out valve chamber 279. An opening area of the timer passage 281 is narrower than an opening area of the timer passage 282. A passage 290 is provided in the wall 235, and the timer passage 281 is connected to the passage 290. As shown in FIG. 29, the passage 290 is connected to the space 309.

A housing portion 287 is formed on the wall 235, and the valve member 319 is movable in the housing portion 287 in the direction of an axis 288. The time-out valve chamber 279 is disposed on one end side of the valve member 319 in the direction of the axis 288 in the housing portion 287.

A sealing member 289 is attached to the outer circumferential surface of the large-diameter portion 285. The sealing member 289 seals a gap between the passage 290 and the time-out valve chamber 279. A space 284 is formed between the inner surface of the housing portion 287 and the outer circumferential surface of the small-diameter portion 286. The space 284 is connected to the passage 290 irrespective of the position of the valve member 319 in the direction of the axis 288. A space 291 is formed between the inner surface of the housing portion 287 and the end surface of the small-diameter portion 286. The space 291 is connected to the timer passage 281. A sealing member 292 is attached to the outer circumferential surface of the small-diameter portion 286. When the valve member 319 moves in the direction of the axis 288, the sealing member 292 comes in contact with or is separated from the inner surface of the housing portion 287. When the sealing member 292 comes in contact with the inner surface of the housing portion 287, the timer passage 281 and the space 291 are disconnected from each other. When the sealing member 292 is separated from the inner surface of the housing portion 287, the timer passage 281 and the space 291 are connected. The spring 320 is, for example, a compression spring made of a metal. The spring 320 biases the valve member 319 in a direction in which the space 291 becomes narrower in the direction of the axis 288.

Figure 29:
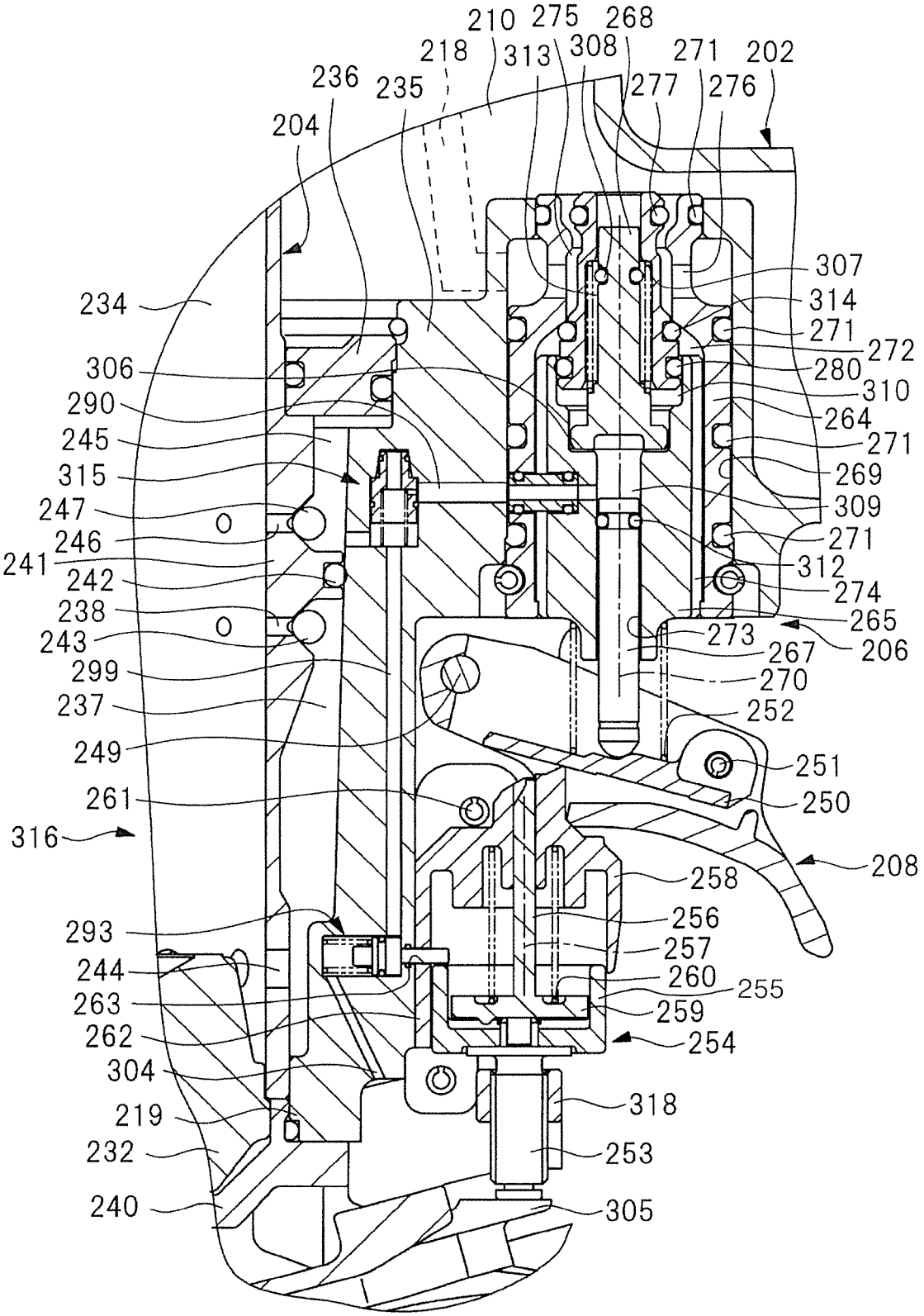
FIG. 29 is a partial cross-sectional view showing Specific Example 4 of a restriction mechanism provided in the drive-in machine shown in FIG. 27.

As shown in FIG. 29, the lock valve 293 is provided on a wall 235. As shown in FIG. 31, the lock valve 293 has a housing chamber 294, a lock pin 295, and a spring 296. The lock pin 295 is movable in the direction of an axis 301. The lock pin 295 has a large-diameter portion 297 and a small-diameter portion 298. The outer diameter of the large-diameter portion 297 is larger than the outer diameter of the small-diameter portion 298. A lock chamber 311 is formed between the large-diameter portion 297 and the inner surface of the housing chamber 294. A passage 299 is provided in the wall 235, and the passage 299 connects the lock chamber 311 and the time-out valve chamber 279.

A shaft hole 300 is provided at the wall 235, and the small-diameter portion 298 is disposed in the shaft hole 300 and the shaft hole 263. The small-diameter portion 298 is movable in the shaft hole 300 and the shaft hole 263 in the direction of the axis 301. A sealing member 302 is provided between the shaft hole 300 and the small-diameter portion 298. A sealing member 303 is provided on the outer circumferential surface of the large-diameter portion 297. The sealing members 302 and 303 seal the lock chamber 311. The spring 296 is, for example, a compression spring made of a metal. The spring 296 biases the lock pin 295 toward the holder 254 in the direction of the axis 301. A passage 304 is provided on the wall 235. The passage 304 connects a space in which the spring 296 is disposed in the housing chamber 294 and the outside of the main housing 201.

The initial state of the drive-in machine 200 shown in FIG. 27 will be described. The initial state of the drive-in machine 200 is a state in which the operator does not apply an operating force to the trigger 208, and the push lever 207 is separated from the material to be driven 81. The state in which the operator does not apply an operating force to the trigger 208 can be ascertained from the fact that the trigger 208 is turned off. The state in which the push lever 207 is separated from the material to be driven 81 can be ascertained from the fact that the push lever 207 is turned off.

In the initial state of the drive-in machine 200, no compressed air is supplied to the accumulation chamber 210. When the drive-in machine 200 is in the initial state, the lock pin 295 is biased by the spring 296, the small-diameter portion 298 is positioned in the shaft hole 263, and the tip of the small-diameter portion 298 is positioned in the cylindrical portion 262. Therefore, when the push lever 207 is pressed against the material to be driven 81, the holder 254 comes in contact with the small-diameter portion 298 of the lock pin 295, and thus movement of the push lever 207 toward the flange 240 in the direction of the axis 213 is restricted. The state in which the push lever 207 is pressed against the material to be driven 81 can be ascertained from the fact that the push lever 207 is turned off.

In addition, when the holder 254 pushed with a biasing force of the elastic member 260 comes in contact with the support portion 305, movement of the push lever 207 in a direction away from the flange 240 in the direction of the axis 213 is restricted. In addition, since the small-diameter portion 298 is positioned in the shaft hole 263, the cylinder 258 is prevented from moving in the direction of the axis 257.

In the time-out valve 315, the valve member 319 is pushed due to a biasing force of a spring 320, the large-diameter portion 285 is pressed against the wall 235, and the valve member 319 is stopped. In addition, the sealing member 292 comes in contact with the inner surface of the wall 235. Therefore, the space 291, the passage 290 and the space 284 are disconnected from each other. In addition, as shown in FIG. 32, the trigger arm 250 and the trigger 208 which receive a biasing force of the biasing member 252 are both stopped at the initial position at which they come in contact with the cylinder 258.

In addition, as shown in FIG. 29, the sealing member 277 is separated from the trigger valve guide 264. Therefore, the accumulation chamber 210 and the passage 27 are connected. In addition, the sealing member 314 is pressed against the trigger valve guide 264. The sealing member 314 blocks the passage 275 and the passage 274.

Figure 27:
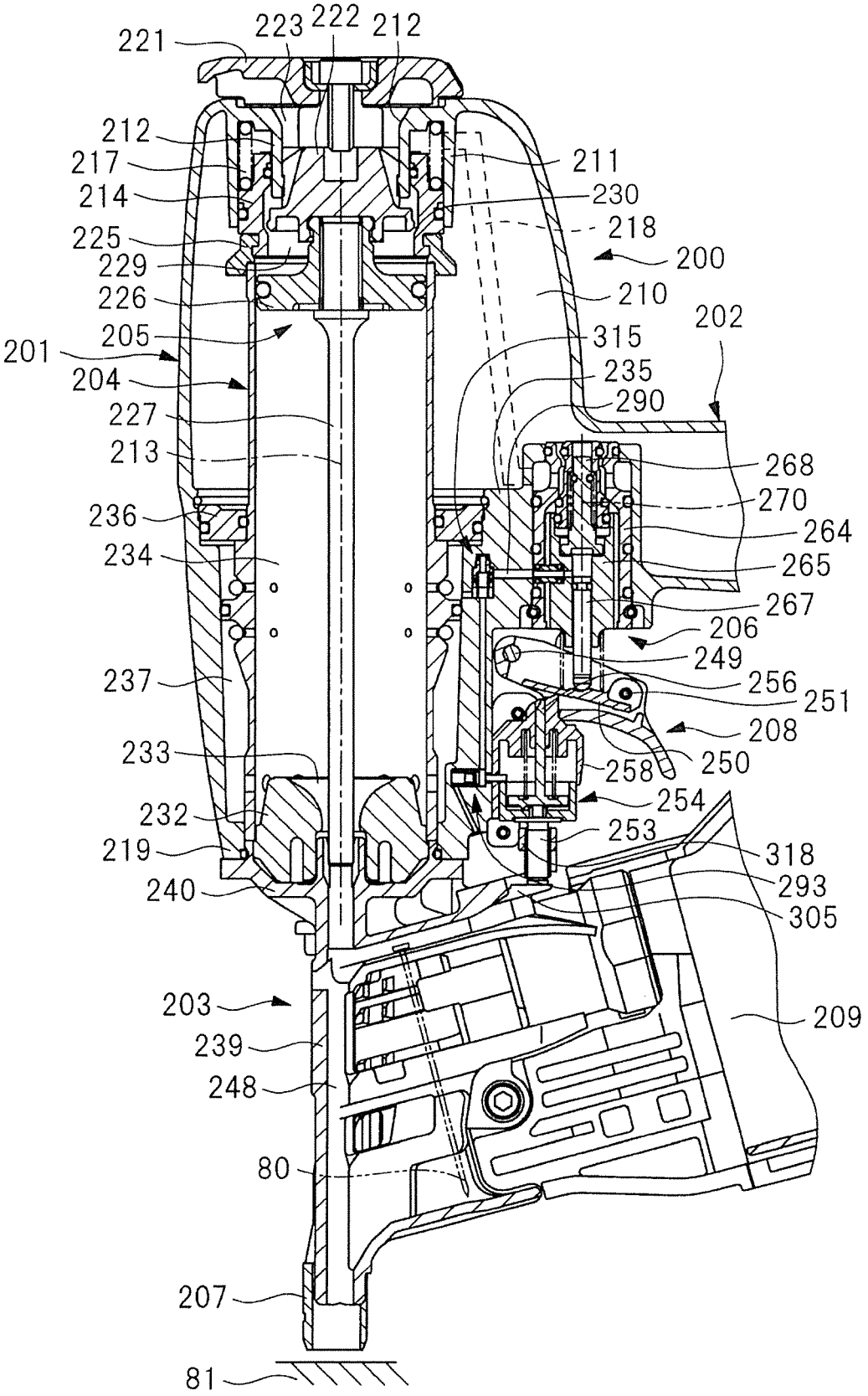
FIG. 27 is a cross-sectional view showing the entire drive-in machine which is Embodiment 2 in the present invention.
Figure 28:
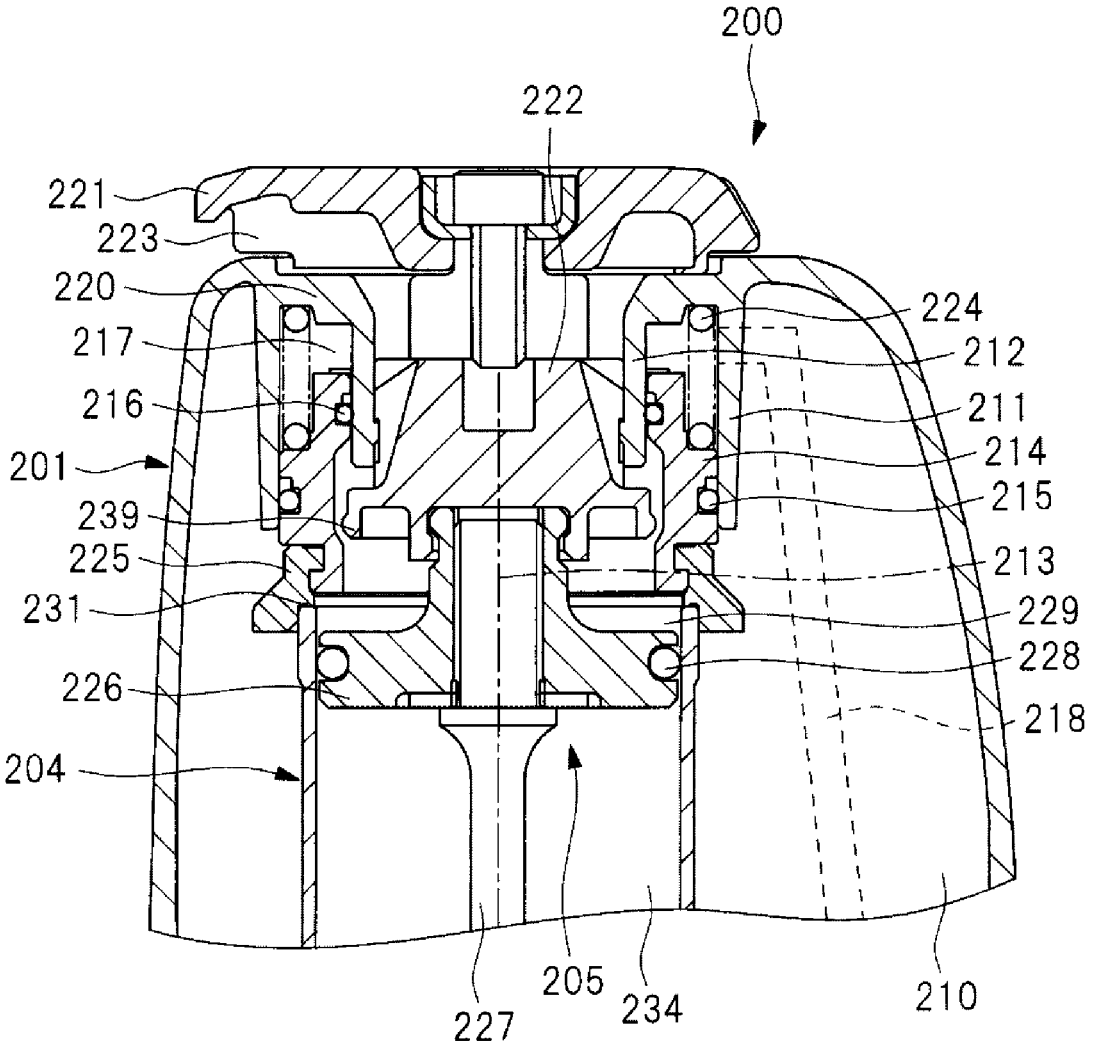
FIG. 28 is an enlarged cross-sectional view of a striking portion shown in FIG. 27.

In addition, as shown in FIG. 28, a biasing force of the biasing member 224 is transmitted to the cylinder 204 via the movable member 214 and the head valve 225. As shown in FIG. 27, an end of the cylinder 204 in the direction of the axis 213 is pressed against the flange 240, and the cylinder 204 is stopped. In addition, as shown in FIG. 28, the port 231 is closed. In addition, the movable member 214 is separated from the bumper 222, and the port 230 is opened. In addition, the piston 226 comes in contact with the bumper 222, and the striking portion 205 is stopped at the top dead center.

Figure 32:
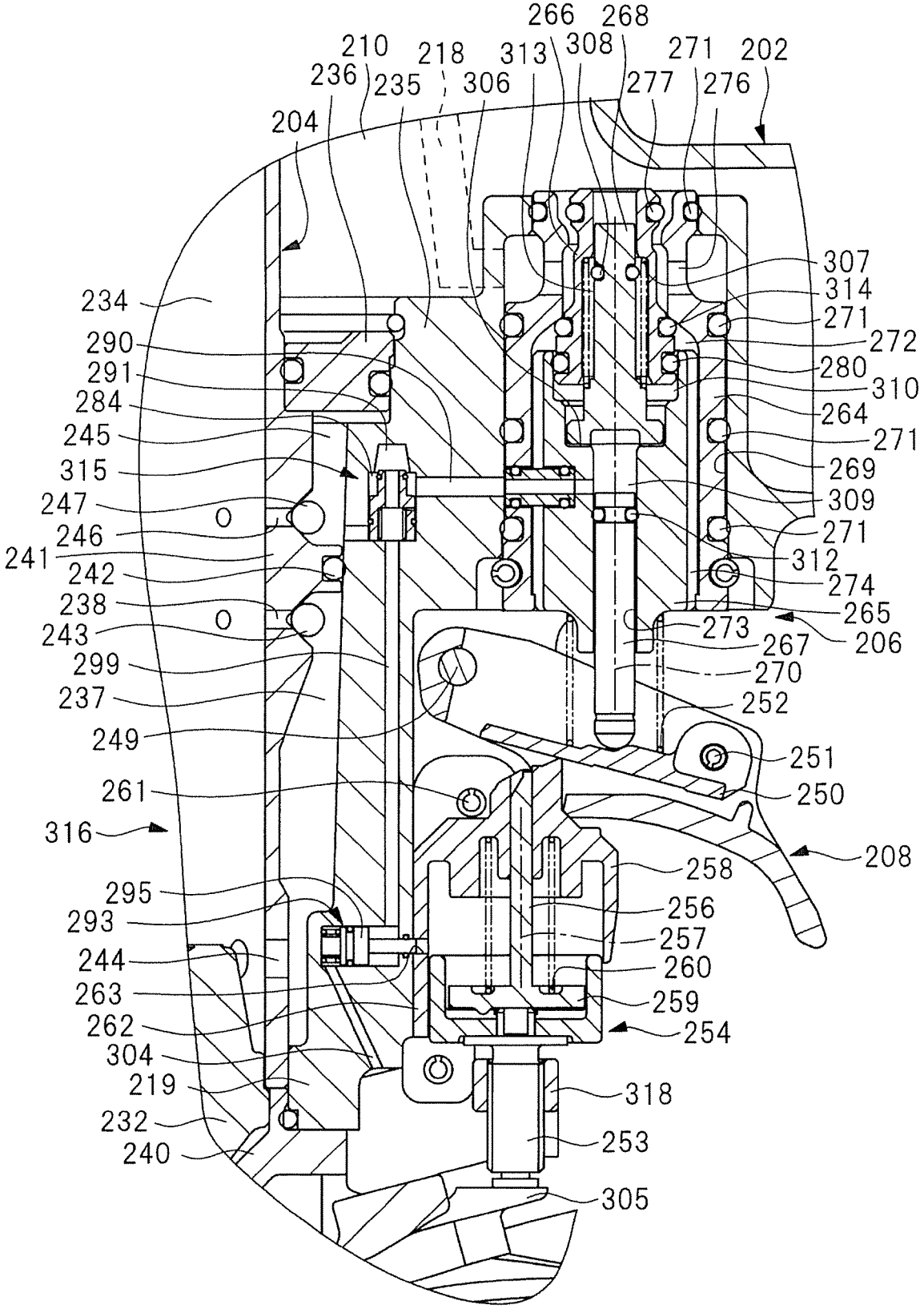
FIG. 32 is a partial cross-sectional view of a state in which compressed air is introduced in the drive-in machine shown in FIG. 27.

When the drive-in machine 200 is in the initial state, if compressed air is supplied to the accumulation chamber 210 shown in FIG. 32, compressed air in the accumulation chamber 210 flows into the space 309 via a space 313 between the valve member 266 and the plunger 268, and the recess 310. Then, the plunger 267 is pressed against the trigger arm 250 using a pressure of compressed air, and the space 309 and the passage 290 are connected.

In addition, when an operating force is applied to the trigger arm 250, an element to which the operating force is transmitted is divided into two plungers 267 and 268. Therefore, in a state in which compressed air is supplied to the accumulation chamber 210, the trigger arm 250 is pushed downward in FIG. 32 due to a pressure of compressed air sent from the accumulation chamber 210 to the space 309, and the trigger 208 comes in contact with a cylinder 258 and is stopped at the initial position. Therefore, there is no need to provide a biasing member that biases the trigger 208 toward the cylinder 258 in order to hold the trigger 208 at the initial position.

The state in which the space 309 and the passage 290 are connected can be ascertained from the fact that the trigger valve 206 is turned on. Compressed air in the space 309 flows through the timer passage 281 via the passage 290. When a pressure in the timer passage 281 is applied to an end surface of the large-diameter portion 285, the valve member 319 moves toward the passage 299 against a biasing force of the spring 320. Then, the space 284 is connected to the timer passage 282 via the space 291. Therefore, compressed air is supplied to the lock chamber 311 via the spaces 284 and 291, the timer passage 282, the time-out valve chamber 279, and the passage 299.

Then, the large-diameter portion 297 receives a pressure of compressed air, and the lock pin 295 moves in a direction away from the holder 254 against a biasing force of the spring 296. Therefore, the small-diameter portion 298 moves outside the cylindrical portion 262. Therefore, the push lever 207 can move toward the flange 240 in FIG. 27.

Some of the compressed air flowing into the time-out valve chamber 279 flows into the reset chamber 245 via the passage 283. The check valve 247 is closed due to a pressure in the reset chamber 245.

Figure 33:
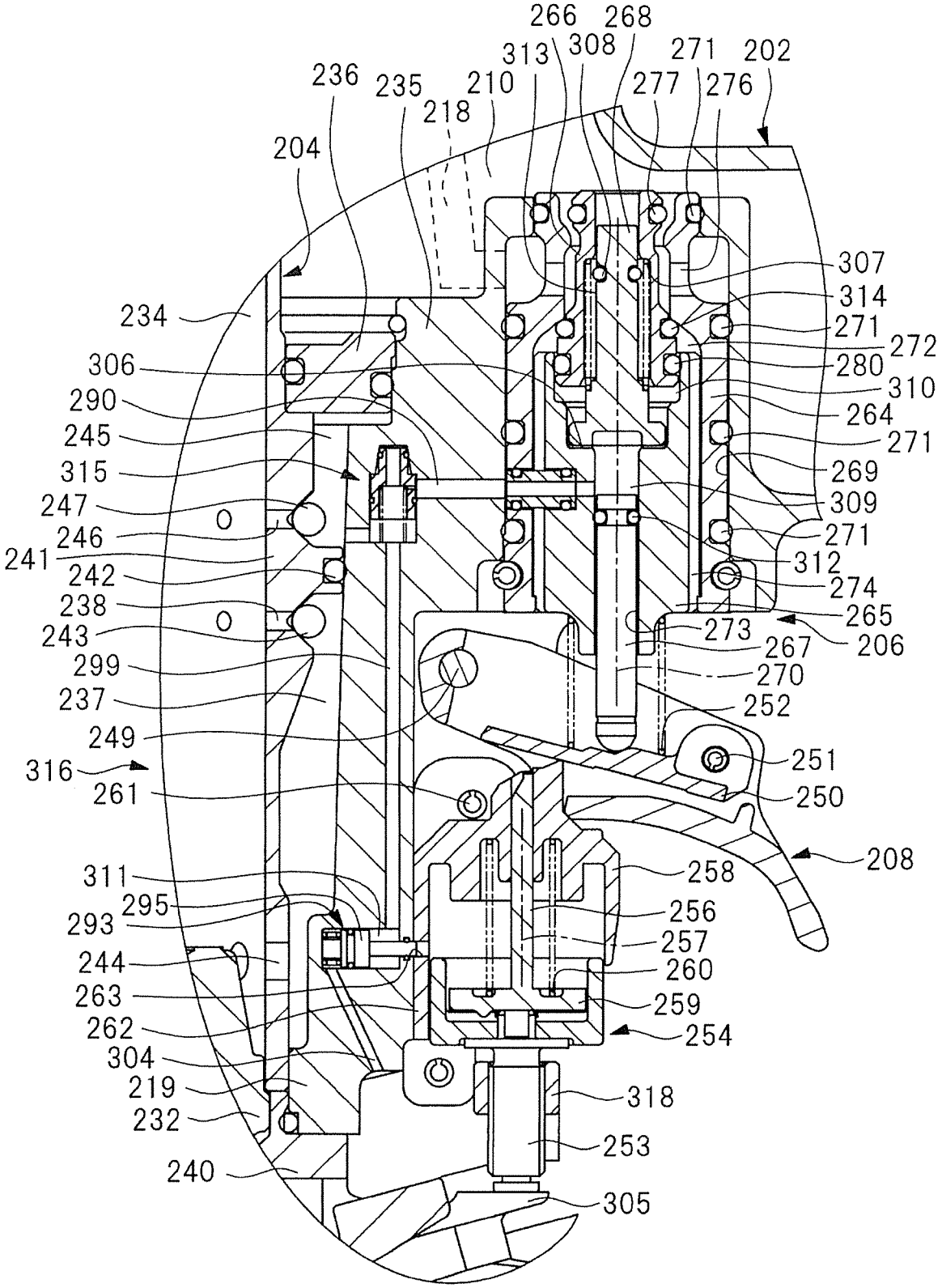
FIG. 33 is a partial cross-sectional view of a state in which compressed air is introduced in the drive-in machine shown in FIG. 27 and the lock valve operates.

Then, when a pressure in the passage 290 and a pressure in the passage 299 are the same, the valve member 319 moves in a direction away from the passage 299 due to a biasing force of the spring 320, and as shown in FIG. 33, when an end surface of the large-diameter portion 285 comes in contact with the wall 235, the valve member 319 is stopped. Therefore, the sealing member 292 blocks the space 284 and the space 291.

Figure 34:
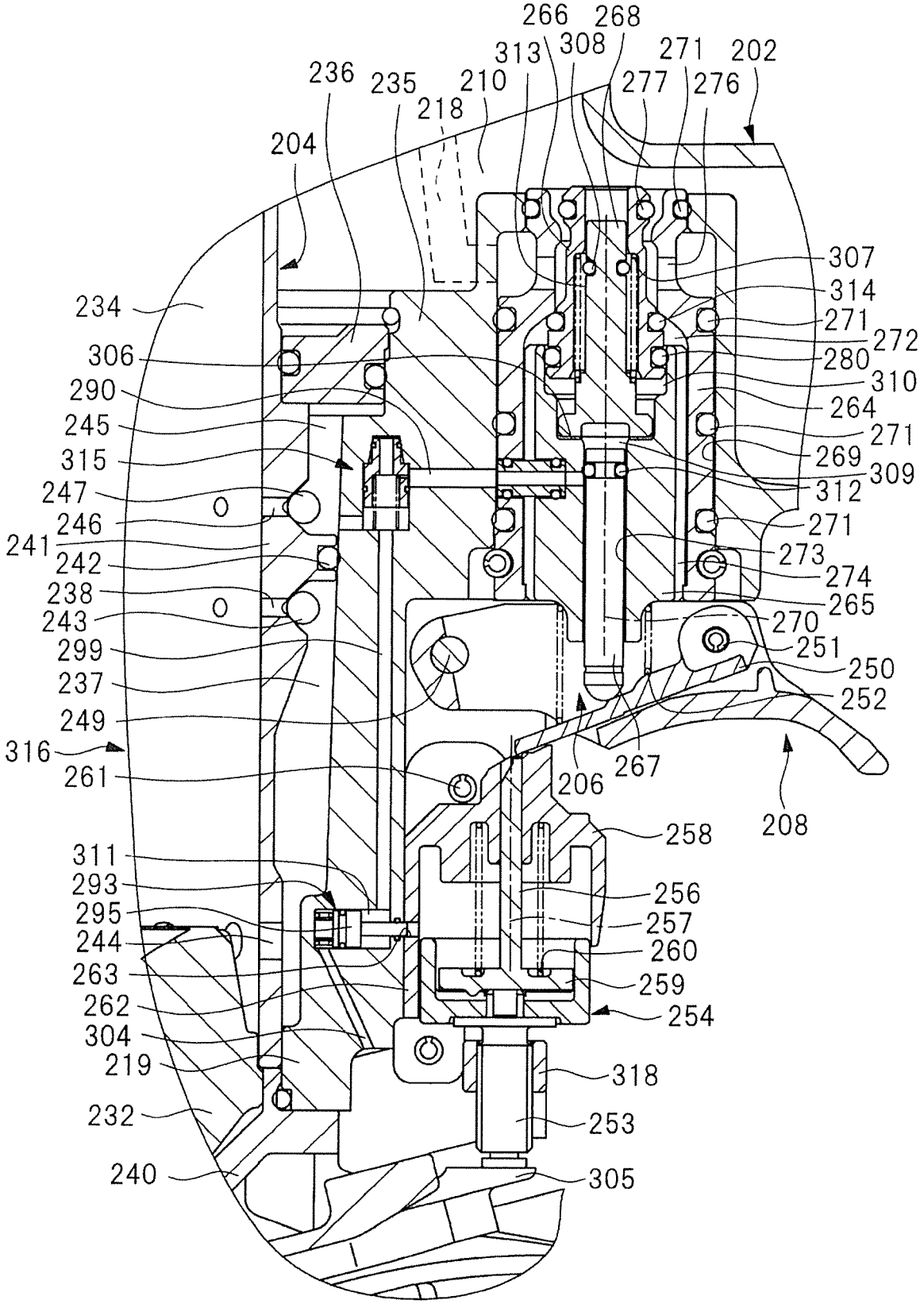
FIG. 34 is a partial cross-sectional view of a state in which the trigger is turned on in the drive-in machine shown in FIG. 27.

In a state in which compressed air is supplied to the accumulation chamber 210 and the push lever 207 is separated from the material to be driven 81, when the operator applies an operating force to the trigger 208, as shown in FIG. 34, the trigger 208 moves counterclockwise around the support shaft 249, the trigger 208 is separated from the cylinder 258, and the trigger 208 comes in contact with the plunger guide 265 and is stopped. The trigger arm 250 remains in contact with the cylinder 258. The state in which the operator applies an operating force to the trigger 208 can be ascertained from the fact that the trigger 208 is turned on.

The plunger 267 moves toward the plunger 268 due to a rotational force of the trigger 208, and the sealing member 312 blocks the space 309 and the passage 290. Therefore, the passage 290 is connected to the outside of the main housing 201 via a gap between the plunger 267 and the plunger guide 265. Therefore, compressed air in the lock chamber 311 is gradually discharged to the outside of the main housing 201 via the passage 299, the time-out valve chamber 279, the timer passage 281, and the passage 290. In this manner, when a pressure in the lock chamber 311 decreases, the lock pin 295 starts to move toward the holder 254 due to a biasing force of the spring 296. A time point at which a pressure in the lock chamber 311 decreases and the lock pin 295 starts to move due to a biasing force of the spring 296 is set as a reference time point.

The small-diameter portion 298 of the lock pin 295 does not reach the inside of the cylindrical portion 262 within a predetermined time from the reference time point. Within a predetermined time from the reference time point, when the push lever 207 is pressed against the material to be driven 81, and the push lever 207 moves toward the flange 240 in the direction of the axis 213, an operating force of the push lever 207 is transmitted to the plunger 256 via the pin 253 and the holder 254.

Figure 35:
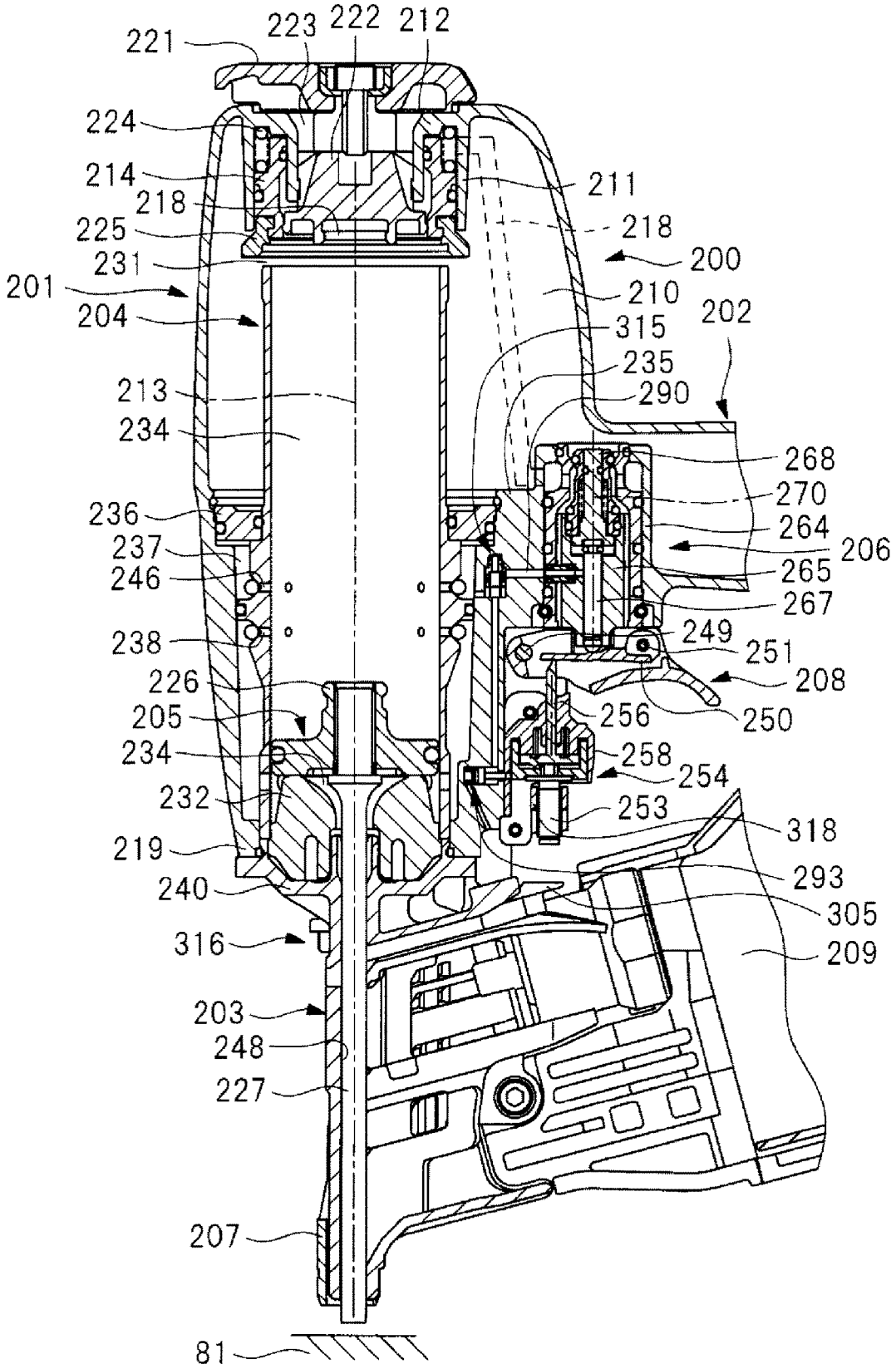
FIG. 35 is an overall cross-sectional view of a state in which a striking portion performs a striking operation in the drive-in machine shown in FIG. 27.
Figure 36:
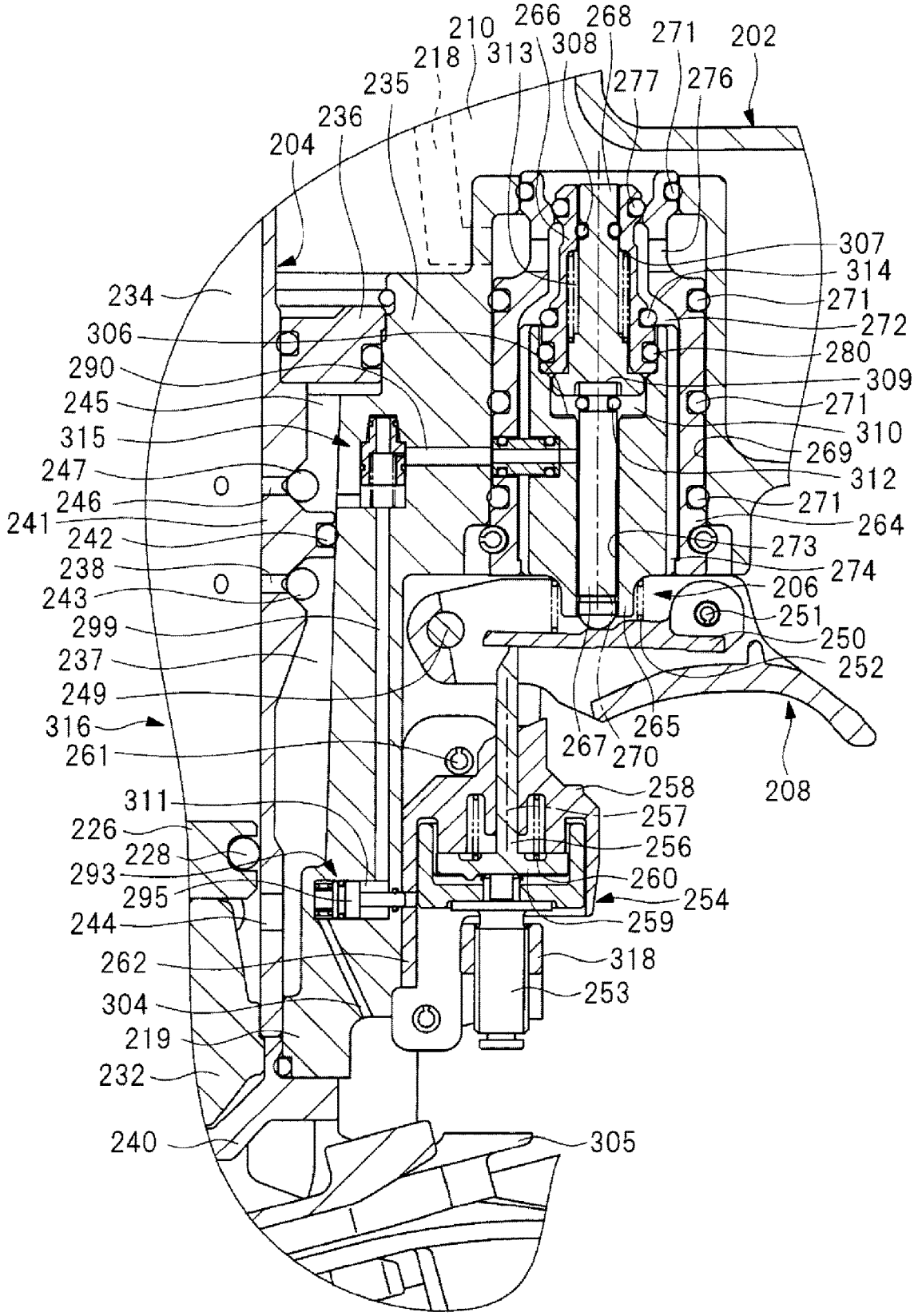
FIG. 36 is a partial cross-sectional view of a state in which, in the drive-in machine shown in FIG. 27, the push lever is turned on within a predetermined time from a time point at which the situation in which the trigger is being turned on and the push lever is being turned off is established.

Then, as shown in FIG. 35 and FIG. 36, the plunger 256 moves toward the plunger guide 265 in the direction of the axis 257 against a biasing force of the elastic member 260. The trigger arm 250 moves clockwise around due to an operating force of the plunger 256 against a biasing force of the biasing member 252 around the support shaft 251.

As shown in FIG. 36, the plunger 267 is pressed against the plunger 268 due to an operating force of the trigger arm 250 and the plunger 268 moves away from the step 306. Then, when the sealing member 308 is pressed against the valve member 266, the sealing member 308 blocks the accumulation chamber 210 and the space 313. Then, a pressure in the accumulation chamber 210 increases, and the valve member 266 receives the pressure in the accumulation chamber 210 and moves toward the step 306. Then, the sealing member 277 is pressed against the trigger valve guide 264, and disconnects the accumulation chamber 210 to or from the passage 275. In addition, the sealing member 314 is separated from the trigger valve guide 264, and the passage 275 and the passage 274 are connected. In this manner, the head valve chamber 217 is connected to the outside of the main housing 201 via the air passage 218, the passage 276, the passage 275, and the passage 274.

The head valve 225 receives a pressure in the accumulation chamber 210, and the head valve 225 and the movable member 214 move toward the cover 221 in the direction of the axis 213 as shown in FIG. 35. Then, the movable member 214 and the bumper 222 come in contact with each other, and the port 230 is blocked, and the port 231 is opened. Therefore, compressed air in the accumulation chamber 210 flows into the piston upper chamber 229, and a pressure in the piston upper chamber 229 increases. Then, the striking portion 205 starts a driving operation. That is, the striking portion 205 descends toward the bumper 232 in the direction of the axis 213, and the driver blade 227 drives the nail 80 in the injection path 248 into the material to be driven 81.

While the striking portion 205 is descending, if the sealing member 228 is provided between the passage 238 and the bumper 222 in the direction of the axis 213, a pressure in the piston lower chamber 234 increases, the check valve 243 is opened, and some of air in the piston lower chamber 234 flows into the return chamber 237.

In addition, when the sealing member 228 moves between the passage 246 and the bumper 232 in the direction of the axis 213, the check valve 247 is opened, and some of the compressed air in the piston upper chamber 229 flows into the reset chamber 245. Compressed air flowing into the reset chamber 245 flows into the lock chamber 311 via the passage 283 and the passage 299. Therefore, a pressure in the lock chamber 311 increases, and the lock pin 295 moves away from the holder 254 against a biasing force of the spring 296. That is, the lock pin 295 returns to a position before movement starts at the reference time point.

After the driver blade 227 drives the nail 80 into the material to be driven 81, the piston 226 collides with the bumper 232, the striking portion 205 reaches the bottom dead center, and the bumper 232 absorbs impact.

In addition, in a state in which the trigger 208 is turned on and the push lever 207 is turned on, the trigger 208 remains in an on state, and when the push lever 207 is switched from on to off, the push lever 207 moves in the direction of the axis 213 due to a biasing force of the elastic member 260, and the holder 254 and the plunger 256 move away from the plunger guide 265 due to a biasing force of the elastic member 260 in the direction of the axis 257. As shown in FIG. 34, when the holder 254 comes in contact with the support portion 305 and is stopped, the push lever 207 is stopped at the initial position, and the plunger 256 is also stopped.

When the plunger 256 moves away from the plunger guide 265 in the direction of the axis 257, the trigger arm 250 moves counterclockwise due to a biasing force of the biasing member 252, and the trigger arm 250 comes in contact with the cylinder 258 as shown in FIG. 34, and the trigger arm 250 is stopped. In addition, the sealing member 277 is separated from the trigger valve guide 264, the passage 275 and the accumulation chamber 210 are connected, and compressed air in the accumulation chamber 210 flows into the head valve chamber 217. Therefore, as shown in FIG. 27 and FIG. 28, the head valve 225 descends due to a biasing force of the biasing member 224, and the port 230 is opened. Therefore, compressed air in the piston upper chamber 229 is discharged to the outside of the main housing 201 via the exhaust passage 223.

In addition, compressed air in the return chamber 237 flows into the piston lower chamber 234 via the passage 244.

Therefore, the striking portion 205 moves upward from the bottom dead center, the piston 226 comes in contact with the bumper 222 and the head valve 225, and the striking portion 205 is stopped at the top dead center.

When the operator performs a continuous striking operation, an operating force is applied to the trigger 208, and the trigger valve 206 remained in an on state, and an operation of pressing the push lever 207 against the material to be driven 81 and an operation of releasing the push lever 207 from the material to be driven 81 are repeated. Therefore, the striking portion 205 is operated, and the plurality of nails 80 are sequentially driven into the material to be driven 81. Here, when an operation of pressing the push lever 207 against the material to be driven 81 within a predetermined time from the reference time point is performed, the striking portion 205 can perform a first driving operation. In addition, the striking portion 205 can perform second and subsequent driving operations.

Figure 37:
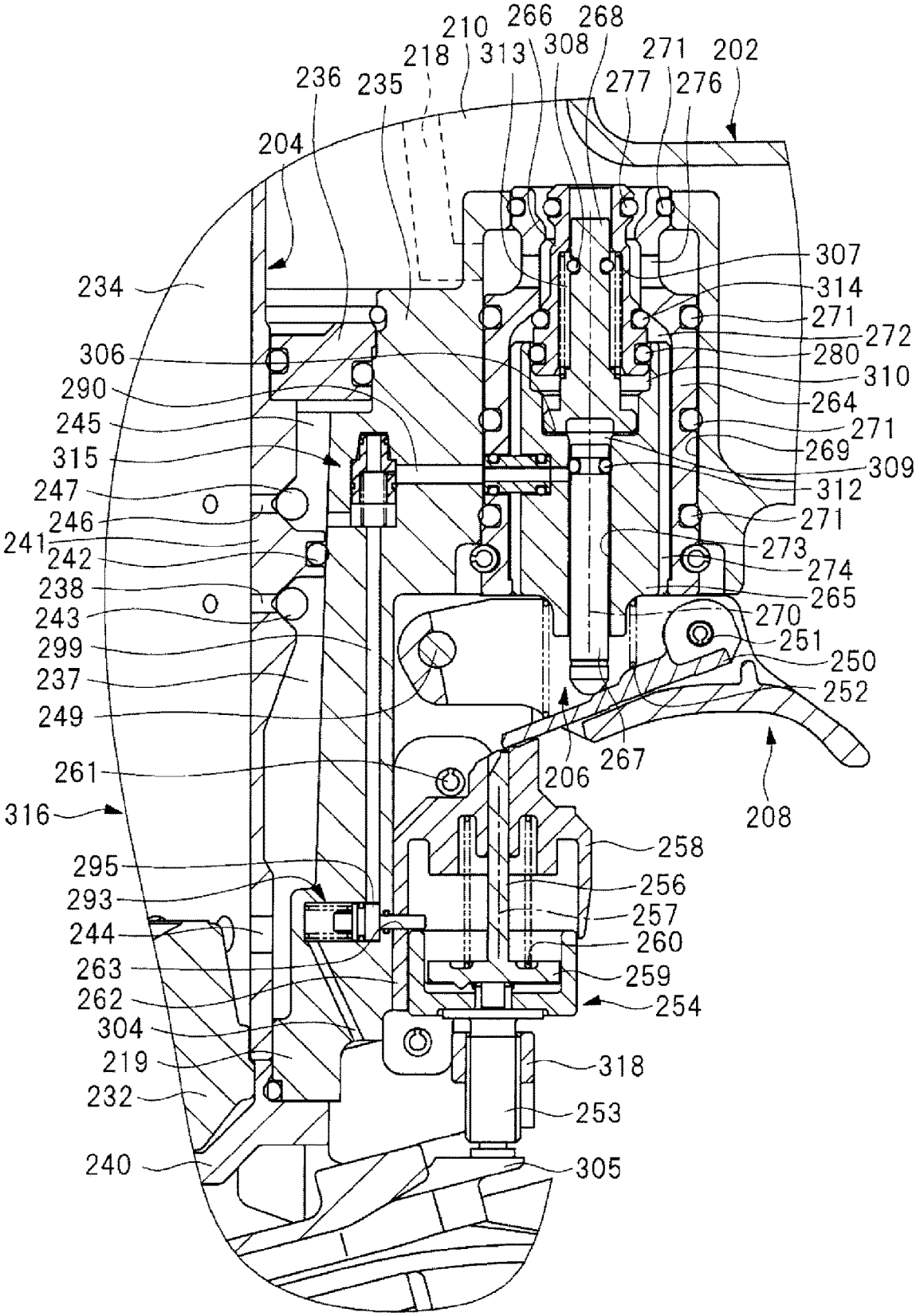
FIG. 37 is a partial cross-sectional view of a state in which, in the drive-in machine shown in FIG. 27, a predetermined time has elapsed from a time point at which the situation in which the trigger is being turned on and the push lever is being turned off is established.

Next, an operation of the drive-in machine 200 when a predetermined time has elapsed from the reference time point and operation examples of the operator will be described with reference to FIG. 37. The operation examples include a first operation example and a second operation example. In the first operation example, a time point at which the trigger valve 206 is switched from off to on in a state in which the push lever 207 is turned off and the trigger valve 206 is turned off is set as a reference time point. In the second operation example, a time point at which the push lever 207 is switched from on to off in a state in which the push lever 207 is turned on and the trigger valve 206 is turned on is set as a reference time point. In any of the operation examples, at the reference time point, the trigger valve 206 is turned on and the push lever 207 is turned off.

Within a predetermined time from the reference time point, compressed air in a lock chamber 311 is discharged to the outside of the main housing 201 via the passages 299 and 290, and a gap between the plunger 267 and the plunger guide 265. Therefore, the lock pin 295 moves toward the holder 254 due to a biasing force of the spring 296. Then, when a predetermined time has elapsed from the reference time point, the small-diameter portion 298 enters the cylindrical portion 262 as shown in FIG. 37 and FIG. 31.

Therefore, when the push lever 207 is pressed against the material to be driven 81 from after a predetermined time has elapsed from the reference time point, the holder 254 comes in contact with the lock pin 295. Therefore, a movement force of the push lever 207 is not transmitted to the plunger 268, and compressed air in the head valve chamber 217 is not discharged to the outside of the main housing 201 from the air passage 218. Therefore, the striking portion 205 does not perform a driving operation. The head valve chamber 217 has a function of preventing a driving operation of the striking portion 205.

Here, before or after a predetermined time has elapsed from the reference time point, when the trigger 208 is turned off and the push lever 207 is turned off, the trigger valve 206 is turned off, and the time-out valve 315 and the lock valve 293 are brought into a state shown in FIG. 33. That is, in the time-out valve 315, as shown in FIG. 30, the large-diameter portion 285 is pressed against the wall 235 and stopped, and the sealing member 292 blocks the space 284 and the space 291. That is, a pressure in the passage 290 and a pressure in the passage 299 are the same. In addition, compressed air is supplied to the lock chamber 311 of the lock valve 293, the lock pin 295 moves away from the holder 254 due to an air pressure in the lock chamber 311, and the small-diameter portion 298 is stopped outside the cylindrical portion 262. Therefore, the push lever 207 can be switched from off to on.

In Specific Example 4, a speed at which the lock pin 295 moves toward the holder 254 and a predetermined time are determined according to a spring constant of the spring 296, and an opening area of the timer passage 281. For example, as a spring constant of the spring 296 is larger, a moving speed of the lock pin 295 is faster and a predetermined time is shorter. In addition, as an opening area of the timer passage 281 is larger, a moving speed of the lock pin 295 is faster and a predetermined time is shorter.

Specific Example 5

Specific Example 5 of the restriction mechanism that can be provided in the drive-in machine 200 in FIG. 27 will be described with reference to FIG. 38. The restriction mechanism 316 shown in FIG. 38 includes the time-out valve 315, the lock valve 293, and the holder 254. The time-out valve 315 is the same as that shown in FIG. 30. The lock valve 293 is the same as that shown in FIG. 31. A spring 317 is interposed between the arm 318 and the support portion 305. The spring 317 is, for example, a compression spring made of a metal. The spring 317 biases the push lever 207 shown in FIG. 27 upward in the direction of the axis 213, moves the pin 253, the holder 254, and the plunger 256 toward the plunger guide 265 in FIG. 38, that is, biases them upward. A spring constant of the spring 317 is smaller than a spring constant of the biasing member 252. In the configuration shown in FIG. 38, the elastic member 260 shown in FIG. 29 is not provided. The other configurations in FIG. 38, FIG. 39, FIG. 40, FIG. 41 and FIG. 42 are the same as the configurations shown in FIG. 27, FIG. 28, FIG. 29, FIG. 30 and FIG. 31.

Figure 38:
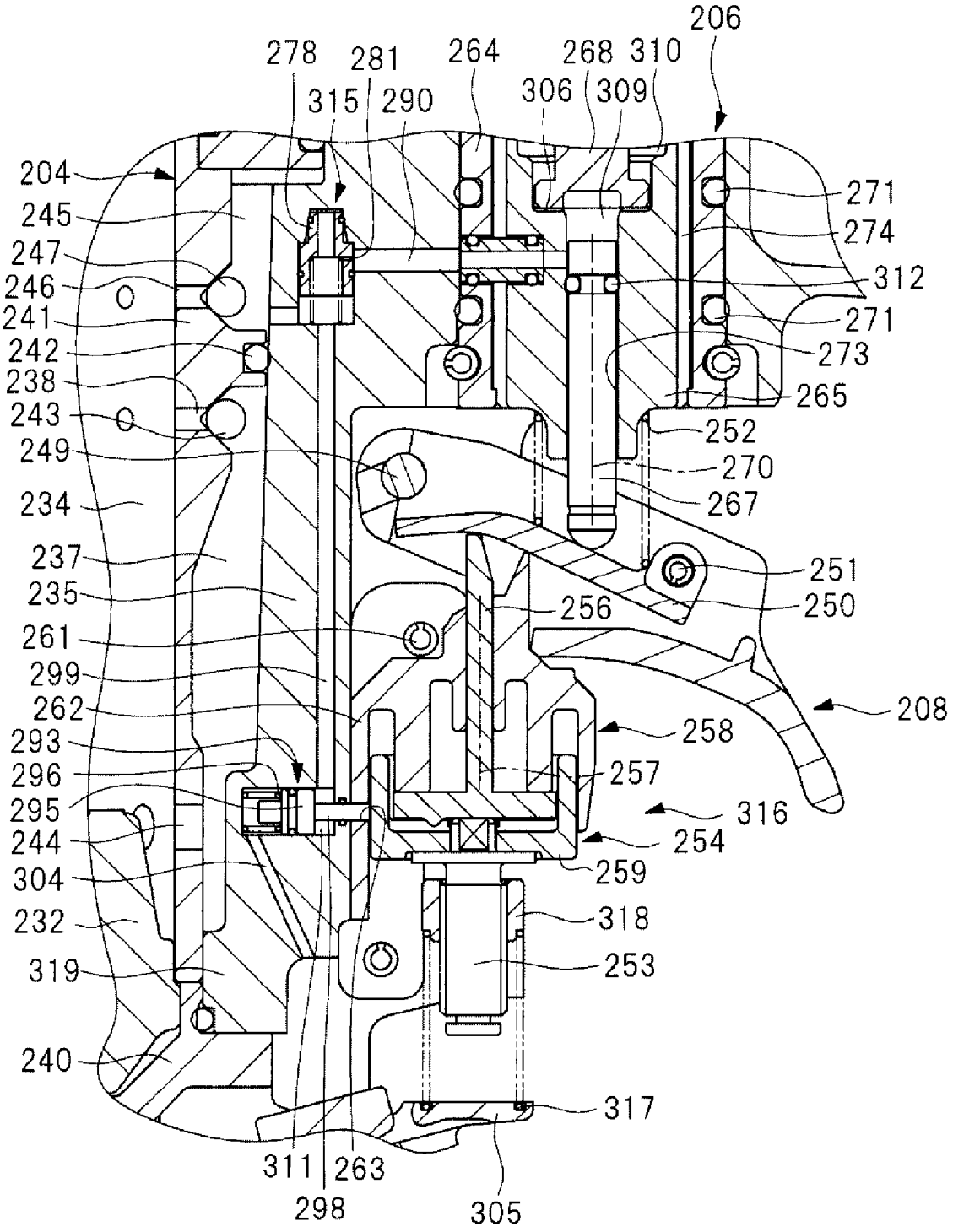
FIG. 38 shows Specific Example 5 of the restriction mechanism to which the drive-in machine shown in FIG. 27 can be applied and is a cross-sectional view showing an initial state of the restriction mechanism.

Operations and actions when the restriction mechanism 316 in FIG. 38 is provided in the drive-in machine 200 shown in FIG. 27 will be described. First, a case in which the drive-in machine 200 is in an initial state will be described with reference to FIG. 27 and FIG. 38. The initial state of the drive-in machine 200 means a state in which no compressed air is supplied to the accumulation chamber 210 shown in FIG. 27, the operator moves the push lever 207 shown in FIG. 27 away from the material to be driven 81, and the operator does not apply an operating force to the trigger 208.

In the initial state of the drive-in machine 200, a biasing force of the spring 317 is transmitted to the cylinder 258 via the disk portion 259, and the cylinder 258 comes in contact with the stopper 261 and is stopped. The trigger 208 comes in contact with the cylinder 258 and is stopped, and the trigger arm 250 comes in contact with the plunger 256 and is stopped. In addition, the small-diameter portion 298 of the lock pin 295 is positioned in the shaft hole 263 and comes in contact with the outer circumferential surface of the holder 254, and the lock pin 295 is stopped. That is, the lock pin 295 positions the cylinder 258 in the direction of the axis 270. In addition, the recess 310 and the passage 290 are connected.

When compressed air is supplied to the accumulation chamber 210 shown in FIG. 27, as in Specific Example 4 of the restriction mechanism, compressed air in the accumulation chamber 210 flows into the lock chamber 311 via the recess 310, the passage 290, and the passage 299. Therefore, the lock pin 295 moves away from the holder 254 in FIG. 38 due to a pressure in the lock chamber 311, and as shown in FIG. 39, the lock pin 295 comes in contact with the wall 235 and is stopped.

Figure 39:
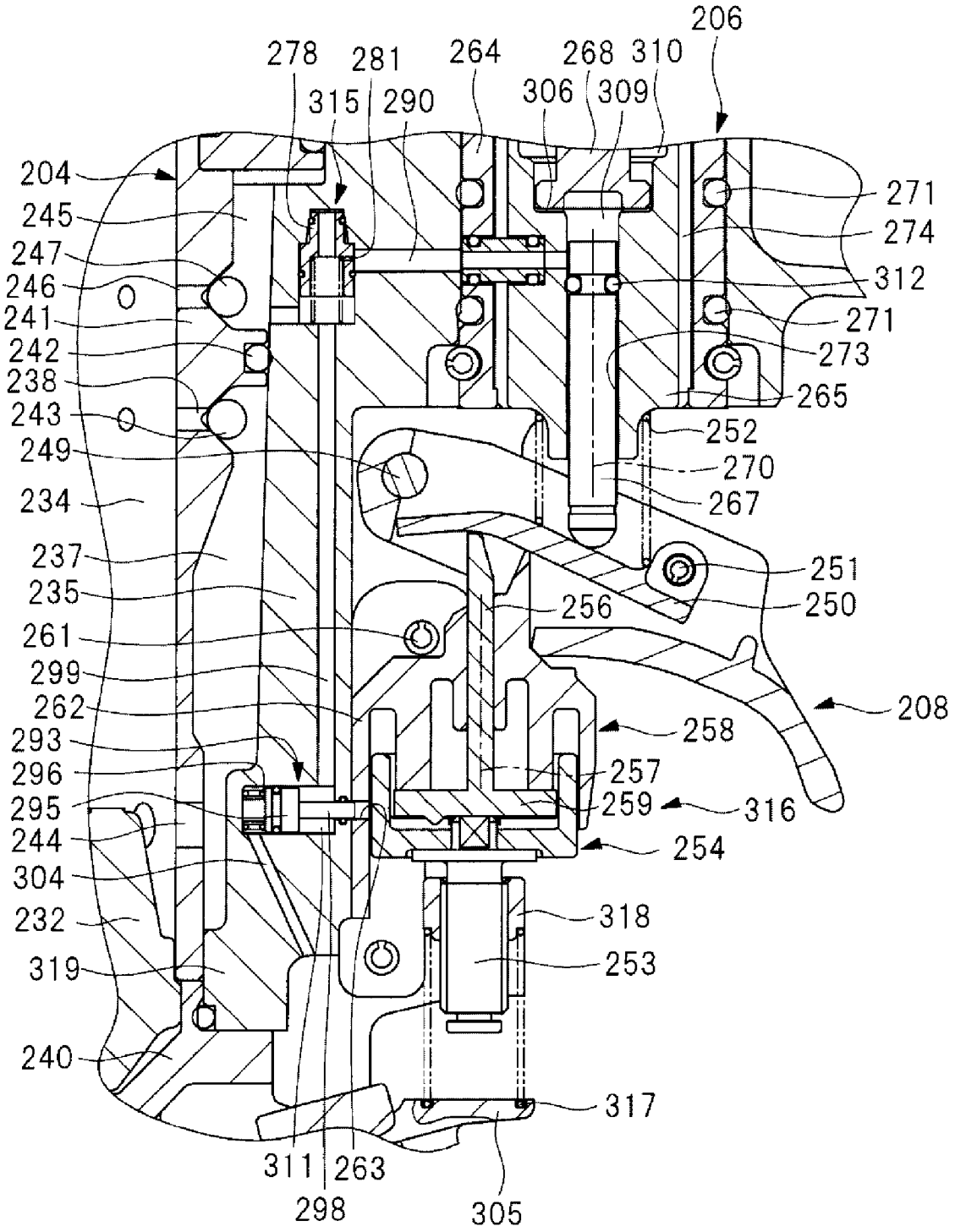
FIG. 39 shows Specific Example 5 of the restriction mechanism and is a cross-sectional view of a state in which compressed air is supplied to an accumulation chamber.
Figure 40:
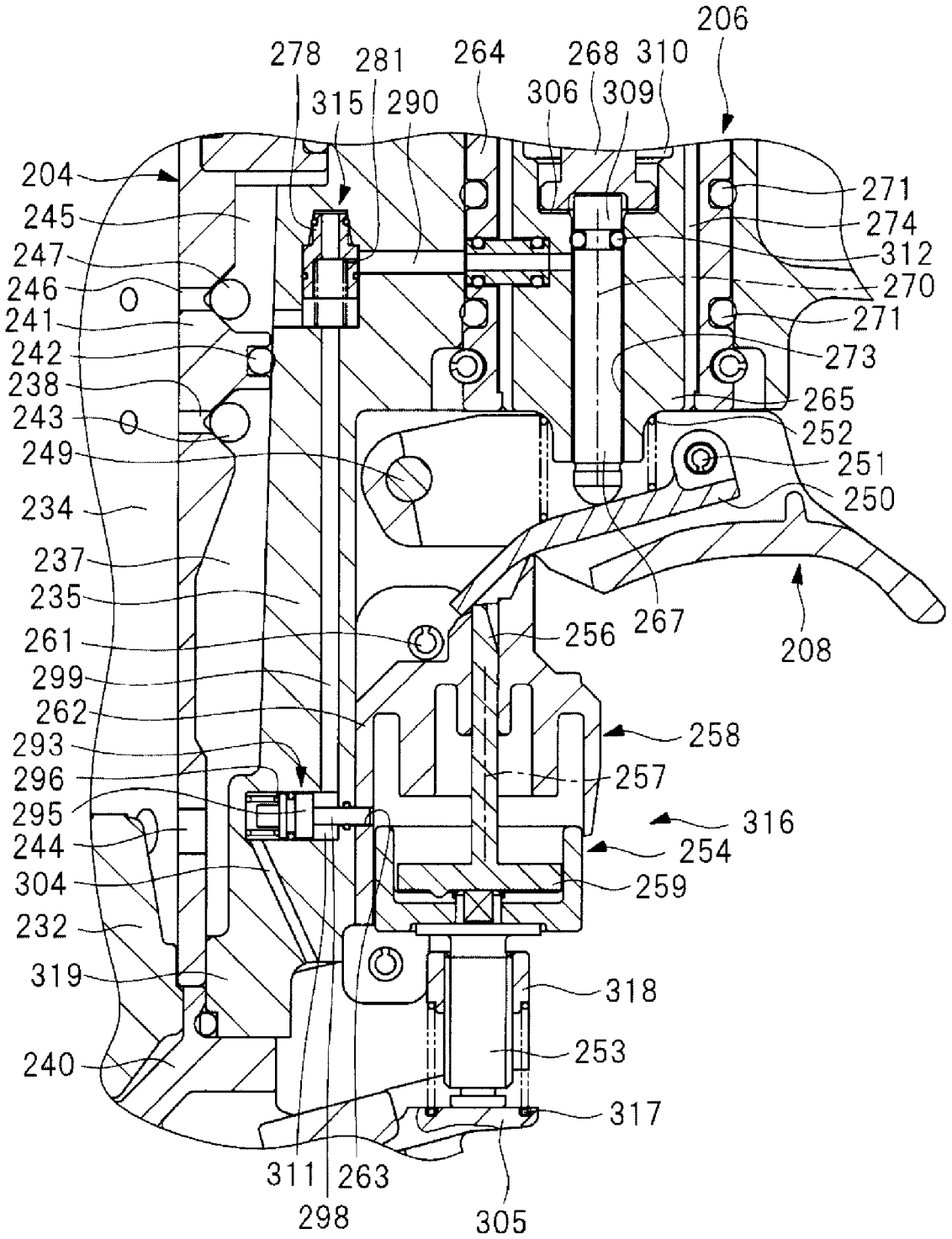
FIG. 40 shows Specific Example 5 of the restriction mechanism and is a cross-sectional view of a state in which the trigger is being operated.

When the restriction mechanism 316 is in the state in FIG. 39 and the push lever 207 shown in FIG. 27 is separated from the material to be driven 81, if the operator applies an operating force to the trigger 208, the trigger 208 moves counterclockwise in FIG. 39 around the support shaft 249, and the trigger 208 comes in contact with the plunger guide 265 and is stopped as shown in FIG. 40.

When the trigger 208 moves counterclockwise in FIG. 39, an operating force of the trigger 208 is transmitted to the trigger arm 250. A spring constant of the spring 317 is smaller than a spring constant of the biasing member 252. Therefore, when the trigger arm 250 applies a force to the plunger 256 in the principle of lever using the support shaft 251 as a force point, a contact point between the plunger 267 and the trigger arm 250 as a fulcrum, and a contact point between the trigger arm 250 and the plunger 256 as an action point, the spring 317 contracts, and the plunger 256 moves toward the support portion 305 in the direction of the axis 270.

In addition, the plunger 267 moves toward the plunger 268, and the sealing member 312 blocks the recess 310 and the passage 290. However, the plunger 268 does not move away from the step 306. Therefore, like the trigger valve 206 shown in FIG. 34, in the trigger valve 206, the sealing member 277 is separated from the plunger guide 265. Therefore, compressed air in the accumulation chamber 210 is supplied to the head valve chamber 217 via the air passage 218, and the striking portion 205 does not perform a driving operation.

On the other hand, as shown in FIG. 40, compressed air in the lock chamber 311 is discharged to the outside of the main housing 201 via the passage 299, the passage 290, and a gap between the plunger 267 and the plunger guide 265 from a time point at which the operator applies an operating force to the trigger 208, and the sealing member 312 blocks the recess 310 and the passage 290, that is, the reference time point. Therefore, the lock pin 295 gradually moves toward the holder 254 from the reference time point.

In addition, when the restriction mechanism 316 is in a state in FIG. 40, a state in which the operator applies an operating force to the trigger 208 is maintained, and within a predetermined time from the reference time point, the small-diameter portion 298 of the lock pin 295 is positioned in the shaft hole 263, and does not reach the inside of the cylindrical portion 262. That is, the holder 254 can move away from the support portion 305 in the direction of the axis 270.

Figure 41:
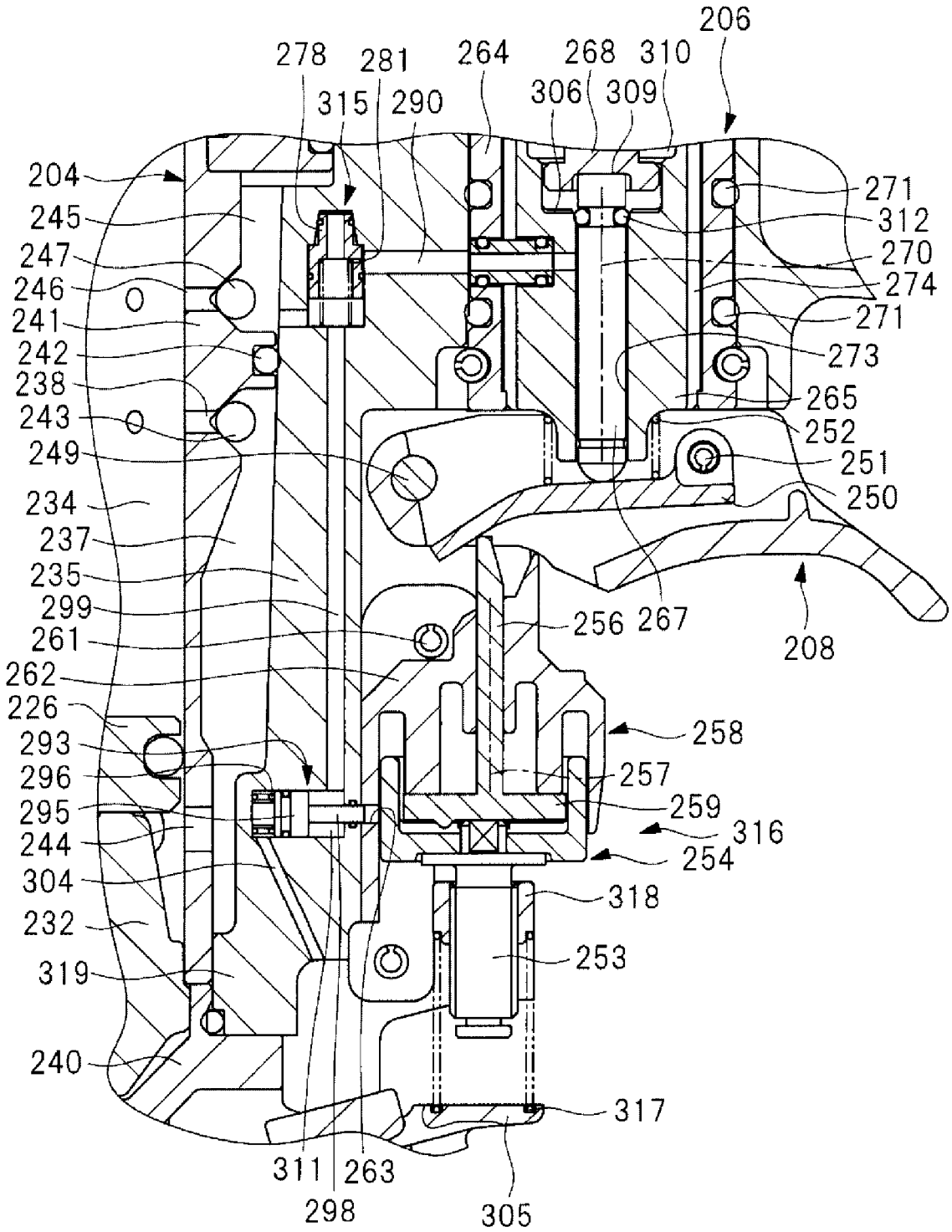
FIG. 41 shows Specific Example 5 of the restriction mechanism and is a cross-sectional view of a state in which the trigger is being operated and the push lever is in contact with a material to be driven.

Therefore, when the operator presses the push lever 207 shown in FIG. 27 against the material to be driven 81, and a movement force of the push lever 207 is transmitted to the pin 253 via the arm 318, the holder 254 and the plunger 256 move away from the support portion 305 in the direction of the axis 270 as shown in FIG. 41. Then, an operating force of the trigger arm 250 is transmitted to the plunger 267 using the support shaft 251 as a fulcrum, a contact point between the plunger 256 and the trigger arm 250 as a force point, a contact point between the trigger arm 250 and the plunger 267 as an action point. Then, when the plunger 267 moves away from the step 306, the sealing member 277 blocks the accumulation chamber 210 and the passage 276 like the trigger valve 206 shown in FIG. 36. In addition, the sealing member 314 is separated from the trigger valve guide 264, and the passage 276 and the passage 274 are connected. Therefore, compressed air in the head valve chamber 217 is discharged to the outside of the main housing 201 via the air passage 218, the passage 276, and the passage 274. Therefore, the striking portion 205 performs a drive-in operation, and as shown in FIG. 41, the piston 226 collides with the bumper 232.

Figure 42:
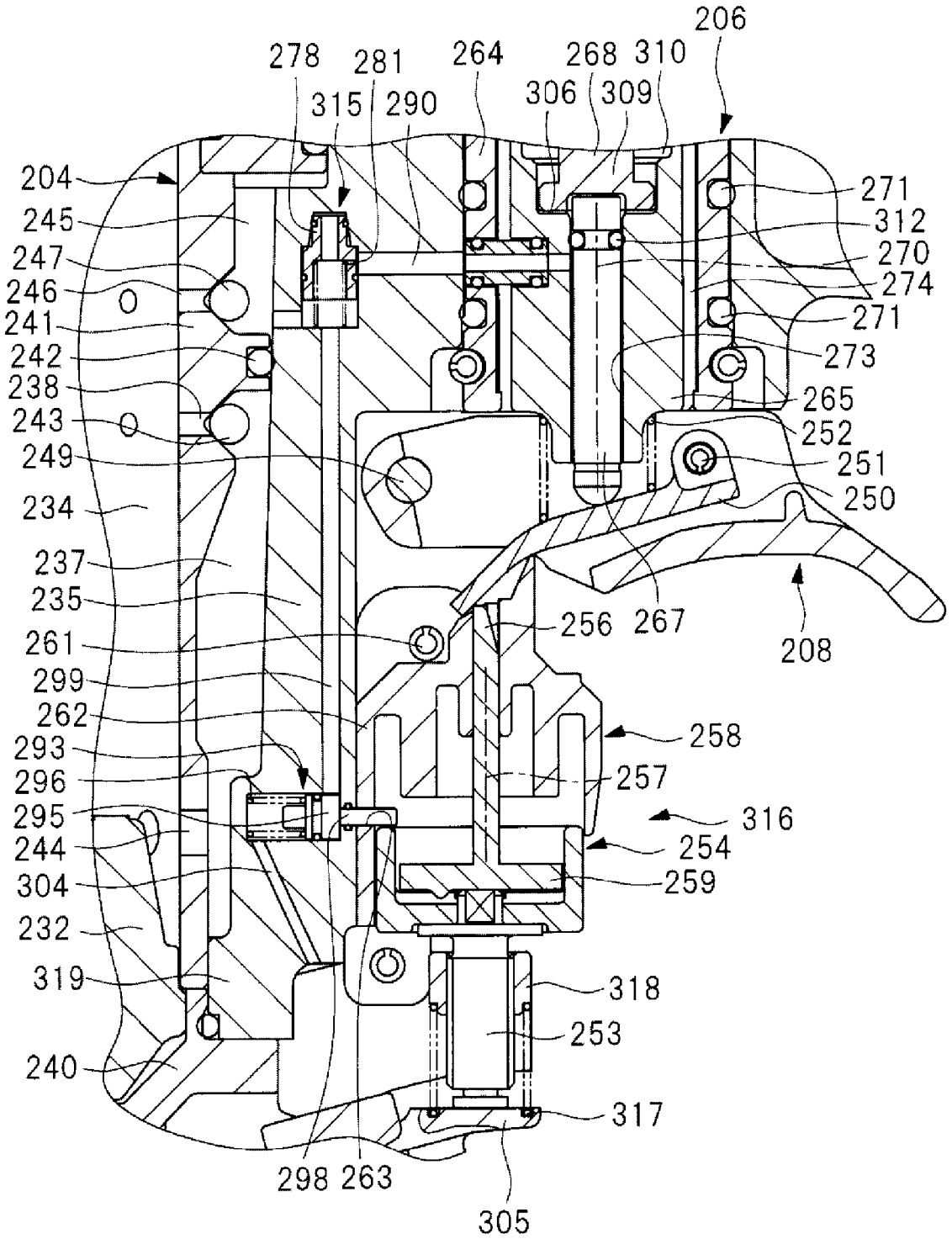
FIG. 42 shows Specific Example 5 of the restriction mechanism and is a cross-sectional view of a state in which the striking portion restricts driving of a nail.

On the other hand, when the restriction mechanism 316 is in a state in FIG. 40, a state in which the operator applies an operating force to the trigger 208 is maintained, and a predetermined time has elapsed from the reference time point, as shown in FIG. 42, the small-diameter portion 298 of the lock pin 295 reaches the inside of the cylindrical portion 262. The small-diameter portion 298 is positioned between the holder 254 and the stopper 261 in the direction of the axis 270.

Therefore, even if the operator presses the push lever 207 shown in FIG. 27 against the material to be driven 81, the lock pin 295 prevents the holder 254 and the plunger 256 from moving away from the support portion 305 in the direction of the axis 270 in FIG. 42.

In the restriction mechanism 316, a speed at which the lock pin 295 approaches the holder 254 and a predetermined time are determined according to an opening area of the timer passage 281 and a spring constant of the spring 296, which is the same as in Specific Example 4 of the restriction mechanism.

The above description relates to an example in which, when the operator uses the drive-in machine 200, first an operating force is applied to the trigger 208, next the push lever 207 is brought into contact with the material to be driven 81, and the striking portion 205 is operated.

On the other hand, when the drive-in machine 200 shown in FIG. 27 and FIG. 28 has a configuration shown in FIG. 38, FIG. 39, FIG. 40, FIG. 41 and FIG. 42, the operator can use the drive-in machine 200 in another operation example.

In the other operation example, as shown in FIG. 39, compressed air is supplied to the accumulation chamber 210 in FIG. 27, the restriction mechanism 316 is brought into a state shown in FIG. 39, the operator brings the push lever 207 into contact with the material to be driven 81, and an operating force is then applied to the trigger 208. In the other operation example, a reaction force when the push lever 207 is in contact with the material to be driven 81 is transmitted to the stopper 261 via the pin 253, the holder 254, the disk portion 259, and the cylinder 258. Therefore, the trigger 208 and the trigger arm 250 are remained in a stopped state.

In this manner, in a state in which the push lever 207 is in contact with the material to be driven 81, when the operator applies an operating force to the trigger 208 shown in FIG. 39, the striking portion 205 performs a driving operation as in FIG. 41. Then, when a state in which the operator brings the push lever 207 in contact with the material to be driven 81 is maintained, and an operating force of the trigger 208 is released, the restriction mechanism 316 is brought into a state shown in FIG. 39. Thereafter, in a state in which the push lever 207 is in contact with the material to be driven 81, when the operator alternately repeats an operation of applying an operating force to the trigger 208 and an operation of releasing an operating force of the trigger 208, continuous driving of the plurality of nails 80 into the material to be driven 81, that is, a continuous striking operation, can be performed.

As described above, the drive-in machine 200 in which the restriction mechanism 316 is provided can perform other operation examples. In such a drive-in machine 200, when an operating force is first applied to the trigger 208 and then the operator uses the push lever 207 by pressing it against the material to be driven 81, if the push lever 207 is pressed against the material to be driven 81 within a predetermined time from the reference time point, the striking portion 205 performs a driving operation. On the other hand, when an operating force is first applied to the trigger 208 and then the operator performs pressing the push lever 207 against the material to be driven 81, if the push lever 207 is pressed against the material to be driven 81 after a predetermined time has elapsed from the reference time point, the striking portion 205 does not perform a driving operation. Therefore, the same effects as in Specific Example 1 can be obtained.

In Embodiment 1 and Embodiment 2, the predetermined time preferably longer than 1 second and shorter than 8 seconds. In particular, the predetermined time is preferably longer than 2 seconds and shorter than 5 seconds. In addition, the predetermined time is preferably longer than 2 seconds and shorter than 3 seconds.

Meanings of items described in Embodiment 1 and Embodiment 2 will be described. The drive-in machines 100 and 200 are an example of drive-in machines. The triggers 41 and 208 are an example of operation members. The push levers 13 and 207 are an example of contact members. The nails 80 are an example of fastening members. The nails 80 include those having a head and those having no head. In addition, the nails 80 include those having an axial shape and those having an arch shape. The striking portions 16 and 205 are an example of striking portions. The piston upper chambers 84 and 229 are an example of first pressure chambers. The cylinder valve chamber 101 is an example of a second pressure chamber.

The ports 231 and 321 are an example of first passages. The cylinder 15 and the head valve 225 are an example of valve elements. The trigger valve 206 and the push lever valve 30 are an example of control mechanisms. The trigger valve 20 is an example of a first valve. The push lever valve 30 is an example of a second valve. The trigger valve 206 is an example of a third valve.

The restriction mechanisms 154 and 316 are an example of restriction mechanisms. The accumulation chambers 50A and 210 are an example of accumulation chambers. The pin drive units 70 and 128, and the lock valve 293 are an example of restriction valves. The outer tubular member 35, the second plunger 156, the trigger arm 250, the plunger 256, and the disk portion 259 are an example of transmission members. The second air chamber 70B, the air chamber 142, and the lock chamber 311 are an example of restriction chambers. The pins 71, the lock pins 295, and the pin 152 are an example of pins. The plunger 268 is an example of a first plunger, and the plunger 267 is an example of a second plunger. The space 309 is an example of a space, and the space 309 can be ascertained as a fourth pressure chamber. The cylinder 258 is an example of a support member.

The initial positions of the pins 71, lock pins 295 and the pin 152 are an example of allowable positions of pins, and the restriction positions of the pins 71, lock pins 295, and the pin 152 are an example of restriction positions of pins. Stopping of the pins 71, lock pins 295, and the pin 152 at the initial position is an example of a first function. Positioning of the pins 71, lock pins 295, and the pin 152 at the restriction position is an example of a second function.

A state in which the port 96 of the push lever valve 30 is opened, that is, the push lever valve 30 is turned on, is a first state. In addition, a state in which the port 96 is closed, that is, the push lever valve 30 is turned off, is a second state.

In a first state of the trigger valve 206, the sealing member 277 of the trigger valve 206 comes in contact with the trigger valve guide 264, and the port 231 is opened. In a second state of the trigger valve 206, the sealing member 277 of the trigger valve 206 is separated from the trigger valve guide 264, and the port 231 is blocked. A first pressure and a second pressure are a pressure of a compressed fluid applied to a valve element in a direction in which the valve element opens the first passage.

Compressed air is an example of a compressed fluid. Regarding the compressed fluid, an inert gas, for example, nitrogen gas, and a rare gas, can be used in addition to air. Restricting an operation of a push lever, restricting an operation of a push lever valve, restricting an operation of a trigger valve, restricting an operation of a plunger, restricting an operation of a holder, and restricting an operation of a push lever plunger are an example of inhibiting an operation of such an element or mechanism.

The drive-in machine is not limited to those described in the embodiments, and various modifications can be made without departing from the spirit and scope of the invention. For example, a lock pin or pin that moves in a direction intersecting a movement direction of the push lever 13 is used as a part of the restriction mechanism. However, the form and operation of the restricting member are arbitrary as long as a state in which movement of the push lever is restricted and a state in which movement of the push lever is not restricted can be switched in the same manner as above. Accordingly, a structure on the side of a push lever restricted by a restricting member is also set.

In addition, in the above examples, compressed air is used to drive a striking portion and a restricting member drive unit. However, it is effective to provide a restriction mechanism that functions in the same manner as above as long as a trigger and push lever of which on and off are set in the same manner as above during a driving operation are used to control a driving operation.

In addition, in Specific Example 1 to Specific Example 5, the same power source, that is, compressed air, is used for the striking portion and the restriction mechanism. On the other hand, a power source for the striking portion and a power source for the restriction mechanism can be different from each other. However, in order to simplify the configuration of the entire drive-in machine and reduce costs thereof, a drive source for the restricting member and a drive source for the striking portion are preferably the same.

In addition, the above configuration can be selected only in a mode of the continuous striking operation, and the configuration may not operate during a single striking operation. In this case, during the single striking operation, a restricting member that restricts movement of a lock pin or pin can be provided. In addition, a structure in which supply and discharge of compressed air to and from a pin drive unit or a lock valve are limited can be used.

In addition, in a structure in which a compressed fluid is sent and a valve element opens a first passage, a first pressure and a second pressure acting in a direction in which the valve element opens may both be the same as a pressure in the accumulation chamber, or may both be different from a pressure in the accumulation chamber.

In addition, in Embodiment 1 and Embodiment 2, the nailing machine has been described as an example of the drive-in machine. The drive-in machine of the embodiment is not limited to the nailing machine as long as it has a trigger and a push lever, and the fastening member is driven into a material to be driven. For example, the present invention can also be applied to a drive-in machine in which the striking portion performs a driving operation on a screw, a rotational force is applied to the screw, and the screw is tightened.

The invention claimed is:

1. A drive-in machine comprising:

an operation member that is operated by an operator;

a plunger that is operated by the operation member;

a trigger valve that has the plunger;

a contact member that is brought into contact with a material to be driven;

a striking portion that drives a fastening member into the material to be driven;

a first pressure chamber that contains a compressed fluid;

a valve element that controls the opening and closing of a first passage through which the compressed fluid is sent to the first pressure chamber, a control mechanism having a first state and a second state for controlling the opening and closing of the valve element, and a restriction mechanism that controls switching of the control mechanism between the first state and the second state, wherein, in the first state, the first passage is opened by the valve element when the operation member is operated and the contact member is in contact with the material to be driven, in the second state, the first passage is blocked by the valve element when the operation member is not being operated and/or the contact member is not in contact with the material to be driven, wherein the trigger valve supplies the compressed fluid to the restriction mechanism when the operation member is operated, wherein the restriction mechanism is configured to function when the operation member is operated and the contact member is separated from the material to be driven into for a predetermined time, and the restriction mechanism is configured to restrict an operation of the contact member, wherein the predetermined time is longer than 1 second and shorter than 8 seconds.

2. The drive-in machine according to claim 1, wherein an accumulation chamber in which the compressed fluid is stored is provided, and the restriction mechanism includes a restriction valve that is operated due to a pressure of the compressed fluid sent from the accumulation chamber.

3. The drive-in machine according to claim 2, wherein the restriction mechanism includes a transmission member that is operated due to an operating force of the contact member and transmits an operating force of the contact member to the control mechanism.

4. The drive-in machine according to claim 3, wherein, in the restriction mechanism, the restriction valve restricts an operation of the transmission member, and changing of the state of the control mechanism from the second state to the first state due to an operating force of the contact member is restricted.

5. The drive-in machine according to claim 3, wherein the restriction valve includes a restriction chamber into which the compressed fluid flows from a reference time point and a pressure increases, and a pin that operates according to a pressure in the restriction chamber and comes in contact with or is separated from the transmission member.

6. The drive-in machine according to claim 3, wherein the transmission member is attached to the operation member.

7. The drive-in machine according to claim 3, wherein a second pressure chamber that controls an operation of the valve element, and a first valve that is provided on a passage through which the compressed fluid in the accumulation chamber is sent to the second pressure chamber and is opened and closed according to an operation of the operation member, are provided, wherein the control mechanism includes a second valve that is disposed downstream from the first valve in the passage and opens and closes the passage according to an operation of bringing the contact member into contact with the material to be driven, and wherein, in the first state of the control mechanism, the second valve is opened, and in the second state of the control mechanism, the second valve is closed.

8. The drive-in machine according to claim 3, wherein the control mechanism includes a third valve that adjusts a pressure of the compressed fluid sent from the accumulation chamber, operates the valve element, and opens and closes the first passage with the valve element, and wherein the third valve has a first state in which, when the situation in which both of the operation member is being operated and the contact member is being in contact with the material to be driven is established, the first passage is opened with the valve element using a pressure of the compressed fluid sent from the accumulation chamber as a first pressure, and a second state in which, when at least one of the situation in which the operation member is being operated and the contact member is being in contact with the material to be driven is not established, the first passage is blocked by the valve element using a pressure in the accumulation chamber as a second pressure lower than the first pressure.

9. The drive-in machine according to claim 8, wherein the third valve has a first plunger and a second plunger that are disposed in series to which an operating force of the operation member and an operating force of the contact member are transmitted, and a space that is formed between the first plunger and the second plunger, and biases the second plunger toward the operation member due to a pressure of the compressed fluid sent from the accumulation chamber, and wherein a support member that supports the second plunger which is biased due to a pressure in the space is provided.

10. The drive-in machine according to claim 5, wherein the pin has a restriction position at which it is in contact with the transmission member and an allowing position at which it is separated from the transmission member, and wherein the pin is operated such that it moves from the allowing position toward the restriction position at the reference time point, and the pin is operated such that it moves toward the allowing position when the striking portion performs driving within the predetermined time.

11. The drive-in machine according to claim 10, wherein the pin is positioned at the restriction position before the compressed fluid is introduced into the accumulation chamber, and when the compressed fluid is introduced into the accumulation chamber, moves to the allowing position from the restriction position.

12. The drive-in machine according to claim 5, wherein the pin has an allowing position at which it is in contact with the transmission member and a restriction position at which it is separated from the transmission member, and wherein the pin is operated such that it moves from the allowing position toward the restriction position at the reference time point, and the pin is operated such that it moves toward the allowing position when the striking portion performs driving within the predetermined time.

13. The drive-in machine according to claim 1, wherein the contact member comprises a first member and a second member, and the first member and the second member are provided with protrusions respectively, when the restriction mechanism operates, the protrusions are driven so as not to come in contact with each other, and an operation of the first member is not transmitted to the second member.

14. The drive-in machine according to claim 13, wherein the second member is rotated by the restriction mechanism.

15. A drive-in machine comprising:

an operation member that is operated by an operator;

a plunger that is operated by the operation member;

a trigger valve that has the plunger;

a contact member that is brought into contact with a material to be driven;

a striking portion that drives a fastening member into the material to be driven;

a first pressure that contains a compressed fluid;

a valve element that controls the opening and closing of a first passage through which the compressed fluid is sent to the first pressure chamber, a control mechanism having a first state and a second state for controlling the opening and closing of the valve element, and a restriction mechanism that controls switching of the control mechanism between the first state and the second state, wherein, in the first state, the first passage is opened by the valve element when the operation member is operated and the contact member is in contact with the material to be driven, in the second state, the first passage is blocked by the valve element when the operation member is not being operated and/or the contact member is not in contact with the material to be driven, wherein the trigger valve supplies the compressed fluid to the restriction mechanism when the operation member is operated, wherein the restriction mechanism is configured to function when the operation member is operated and the contact member is separated from the material to be driven into for a predetermined time, and the restriction mechanism is configured to restrict an operation of the contact member, wherein the contact member comprises a first member and a second member, and the first member and the second member are provided with protrusions respectively, when the restriction mechanism operates, the protrusions are driven so as not to come in contact with each other, and an operation of the first member is not transmitted to the second member.

* * * * *